US006766869B2

(12) United States Patent
Brand et al.

(10) Patent No.: US 6,766,869 B2
(45) Date of Patent: Jul. 27, 2004

(54) REMOTE LOCK-OUT SYSTEM AND METHOD FOR A HORIZONTAL DIRECTIONAL DRILLING MACHINE

(75) Inventors: Ivan R. Brand, Pella, IA (US); Scott Kilborn, Gilman, IA (US); Hans Kelpe, Pella, IA (US); Gregg A. Austin, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 10/179,474

(22) Filed: Jun. 25, 2002

(65) Prior Publication Data

US 2002/0195275 A1 Dec. 26, 2002

Related U.S. Application Data

(63) Continuation-in-part of application No. 09/466,502, filed on Dec. 17, 1999, now Pat. No. 6,408,952.

(60) Provisional application No. 60/324,676, filed on Sep. 25, 2001.

(51) Int. Cl.[7] ..... E21B 44/00

(52) U.S. Cl. ..... 175/24; 175/27; 175/45; 340/853.4; 340/853.6

(58) Field of Search ..... 175/24, 27, 11, 175/26, 40, 45, 48, 61; 340/853.2, 853.3, 853.4, 853.5, 853.6

(56) References Cited

U.S. PATENT DOCUMENTS

| | | | |
|---|---|---|---|
| 4,907,658 A | 3/1990 | Stangl et al. | |
| 4,968,978 A | 11/1990 | Stolarczyk | |
| 5,337,002 A | 8/1994 | Mercer | |
| 5,465,798 A | 11/1995 | Edlund et al. | |
| 5,469,155 A | 11/1995 | Archambeqult et al. | |
| 5,556,253 A | 9/1996 | Rozendaal et al. | |
| 5,633,589 A | 5/1997 | Mercer | |
| 5,698,981 A | 12/1997 | Mercer | |
| 5,746,278 A | 5/1998 | Bischel et al. | |
| 5,764,062 A | 6/1998 | Mercer | |
| 5,767,678 A | 6/1998 | Mercer | |
| 5,944,121 A | 8/1999 | Bischel et al. | |
| 6,035,951 A | 3/2000 | Mercer et al. | |
| 6,047,783 A | 4/2000 | Mercer et al. | |
| 6,057,687 A | 5/2000 | Mercer | |
| 6,079,506 A | 6/2000 | Mercer | |
| 6,095,260 A | 8/2000 | Mercer et al. | |
| 6,161,630 A | 12/2000 | Stump et al. | |
| 6,285,860 B1 | 9/2001 | Szarka et al. | |
| 6,408,952 B1 * | 6/2002 | Brand et al. | 175/24 |

OTHER PUBLICATIONS

D100X120 Navigator, Vermeer, Apr. 2003.*

* cited by examiner

*Primary Examiner*—William Neuder
(74) *Attorney, Agent, or Firm*—Crawford Maunu PLLC

(57) ABSTRACT

A remote lock-out system and method are employed with a drilling machine. The remote lock-out system includes a remote lock-out override controller capable of interrupting a drilling operation of the drilling machine. The remote lock-out override controller includes a transmitter and a receiver. A remote lock-out controller is capable of issuing a lock-out signal and a run signal, wherein the lock-out signal, when received by the HDD machine, initiates suspension of the HDD machine drilling operation, and the run signal initiates enablement of the HDD machine drilling operation. The remote lock-out controller includes a transmitter and a receiver. The HDD machine drilling operation generally includes displacing and rotating the drill string, and can further include supplying a drilling fluid through the drill string.

25 Claims, 35 Drawing Sheets

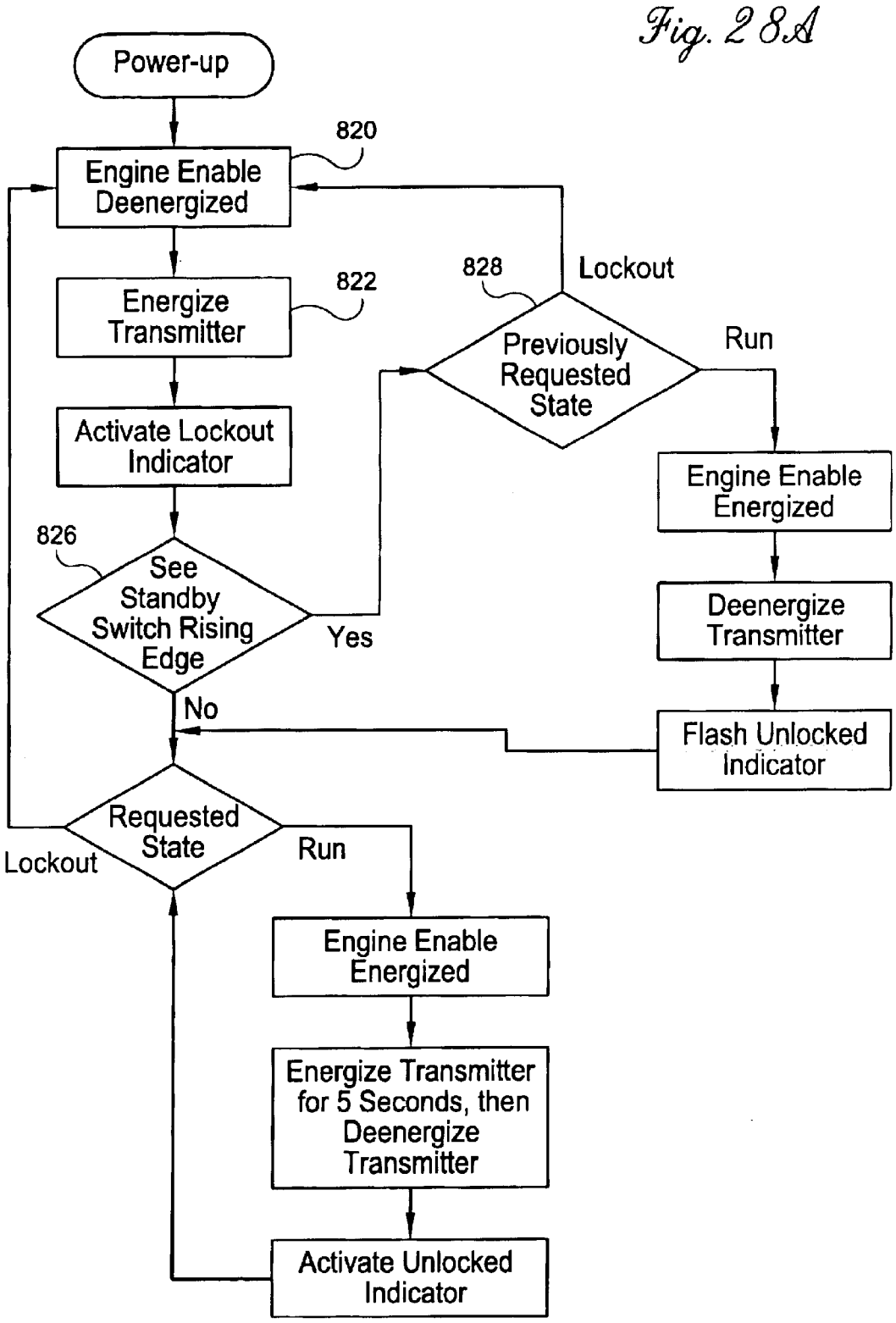
Fig. 28A
Power-up
820
Engine Enable Deenergized
822
Energize Transmitter
Activate Lockout Indicator
826
See Standby Switch Rising Edge
Yes
No
828
Lockout
Previously Requested State
Run
Engine Enable Energized
Deenergize Transmitter
Flash Unlocked Indicator
Requested State
Lockout
Run
Engine Enable Energized
Energize Transmitter for 5 Seconds, then Deenergize Transmitter
Activate Unlocked Indicator

REMOTE LOCK-OUT SYSTEM AND METHOD FOR A HORIZONTAL DIRECTIONAL DRILLING MACHINE

REFERENCE TO RELATED APPLICATIONS

This application is a continuation-in-part of U.S. Ser. No. 09/466,502, filed Dec. 17, 1999 now U.S. Pat. No. 6,408,952, and claims the benefit of U.S. Ser. No. 60/324,676, filed Sep. 25, 2001, both of which are hereby incorporated herein by reference in their respective entireties.

FIELD OF THE INVENTION

The present invention relates generally to the field of underground boring and, more particularly, to a system and method of altering operation of an underground boring system, including disabling drill string movement and fluid flow through the drill string, from a location remote from the boring system.

BACKGROUND OF THE INVENTION

Horizontal drilling machines are routinely used for installing a wide variety of utilities underground, without the need for digging a trench and disrupting the ground surface. These machines, and associated methods of use, result in the drilling machine being located a significant distance from the terminating end of its associated drill string, typically several hundred feet, and in certain cases thousands of feet. This trenchless technique for installing utilities is especially useful in areas where ground conditions are congested, and thus it is not unusual for the terminating end of the drill string to be out of the line of sight of the drilling machine.

A typical horizontal drilling process involves the production of a pilot bore, wherein the drill string is advanced from an entry point along a predetermined bore path to an exit point. The process includes significant rotational power and significant thrust force applied to the drill string. In addition, a significant amount of fluid is typically pumped through the drill string to aid in the cutting process.

At the exit point, the drill string is directed out of the ground, the originally installed drill bit is removed, and a reamer and swivel are installed. The swivel is attached to the drill string on one end and to the product being installed on the other end. Once these connections are made, the drilling machine retracts the drill string while rotating to provide final sizing of the hole, while at the same time pulling-in the product.

Systems that provide remote control of mobile equipment are known in the industry for remotely controlling many types of equipment. These include remote control of cranes, remote control of some agricultural equipment, etc. Such systems have also been developed for horizontal directional drilling machines. These systems generally utilize one-way communication, typically by use of a transmitter in a remote unit held by the operator stationed near the termination end of the drill string, wherein the drilling machine includes a receiver. A suggested approach to addressing the potential hazards facing operators at the exit location of a bore involves the use of a device that permits a worker at the exit location to terminate advancement or rotation of the drill string/cutting head. Although such an approach would appear to allow the operator to terminate drill string/cutting head advancement and/or rotation, this and other known approaches to addressing the problem of unintended drill string/cutting head movement at the exit location fail to provide unambiguous assurance to the operator at the exit location that the instruction to terminate drill string/cutting head advancement/rotation has been received by the drilling machine.

Such conventional and suggested approaches also fail to provide unambiguous assurance to the operator at the exit location that the steps required to disable drill string/cutting head advancement/rotation at the drilling machine have been successfully completed. Further, such conventional and suggested approaches fail to provide unambiguous assurance to the worker that all drill string/cutting head advancement/rotation will remain disabled, particularly in circumstances where the drilling machine engine is intentionally or unintentionally shut-off and then turned-on or where communication connectivity between the operator and the drilling machine is suspect or lost. Moreover, the potential hazard of dispensing high-pressure drilling fluid at the exit location remains unaddressed by such conventional and suggested approaches.

There exists a need in the excavation industry for an apparatus and methodology for preventing drill string/cutting head movement and, in addition, disabling cutting fluid flow by an operator situated remotely from the drilling machine. There exists the further need for such an apparatus and methodology that provides unambiguous assurance to the operator that all drill string/cutting head movement and fluid flow will remain disabled until such time as there is intentional re-enabling of the drilling machine for normal operation. There exists yet an additional need for such an apparatus and methodology that prevents unintended shutdown of machine operation under circumstances in which machine disablement is neither requested nor appropriate. The present invention fulfills these and other needs.

SUMMARY OF THE INVENTION

The present invention is directed to a system and method for remotely altering operation of a horizontal directional drilling (HDD) machine through use of a remote lock-out signaling protocol. According to system embodiments of the present invention, a remote lock-out system is employed with a drilling machine which includes a control system, a driving apparatus coupled to a drill string, and a cutting head or reamer coupled to the drill string. The remote lock-out system includes a remote lock-out override controller capable of interrupting a drilling operation of the drilling machine. The remote lock-out override controller includes a transmitter and a receiver. The system also includes a remote lock-out controller is capable of issuing a lock-out signal and a run signal, wherein the lock-out signal, when received by the HDD machine, initiates suspension of the HDD machine drilling operation, and the run signal initiates enablement of the HDD machine drilling operation. The remote lock-out controller includes a transmitter and a receiver. The HDD machine drilling operation generally includes displacing and rotating the drill string, and can further include supplying a drilling fluid through the drill string.

In one implementation, the signal transmitted by the remote lock-out override controller is utilized as a handshake signal by the remote lock-out controller. In one approach, the drilling machine operation is enabled only if the handshake signal is detected as between the remote lock-out override controller and remote lock-out controller. In another approach, the remote lock-out controller does not indicate a lock-out condition unless the handshake signal generated by the remote lock-out override controller is continuously received by the remote lock-out controller. In a further approach, the remote lock-out controller does not indicate a run condition unless the handshake signal is repeatedly received by the remote lock-out controller. In yet another approach, the remote lock-out override controller transmits a notification signal to the remote lock-out controller and the HDD machine remains in a current operating state in response to loss of lock-out signal detection by the remote lock-out override controller. The current operating state can be one of a lock-out state or a run state.

In one configuration, each of the remote lock-out override controller and remote lock-out controller is embodied as a module separate from the control system of the HDD machine. The remote lock-out override controller includes an interface for communicatively coupling to the HDD machine control system. Alternatively, the remote lock-out override controller is integrated as part of the control system of the HDD machine.

In accordance with another embodiment, a system for remotely altering operation of a horizontal directional drilling (HDD) system includes a remote lock-out controller capable of transmitting a lock-out signal or a run signal, and a remote lock-out override module capable of controlling primary and secondary power transmission components of the horizontal drilling system. At least one sensor on the drilling machine is capable of providing input that corresponds to transmission of power to the drill string or mud system. The remote lock-out override module disrupts power transmission to the drill string by disabling the primary power transmission system upon receiving a lock-out request indicative of a lock-out state from the remote lock-out controller, and transmits a verification signal only after the sensor indicates an absence of power transfer. The remote lock-out override module continues to monitor the sensor while in the lock-out state and disrupts power transmission to the drill string by the secondary power transmission system if the sensor indicates a subsequent transfer of power while still in the lock-out state. According to one implementation, the primary power transmission system includes a hydraulic power system, and the secondary power transmission system includes an internal combustion engine.

According to another embodiment, a remote lock-out system for a horizontal directional drilling (HDD) system includes a remote lock-out controller comprising a transceiver for transmitting and receiving radio communications. A remote lock-out override module is capable of controlling power transmission components of the HDD system. The remote lock-out override module includes a transceiver for transmitting and receiving radio communications and a manual override switch. The remote lock-out system continuously monitors for radio communication between the remote lock-out controller and the remote lock-out override module at start-up and prevents operation of the drilling machine until the radio communication is established or until an override state is initiated in response to actuation of the manual override switch. The remote lock-out system automatically terminates the override state when the radio communication is established, such that the remote lock-out controller initiates a drilling machine lock-out even if the drilling machine were previously set into an override state.

In accordance with a further embodiment, a remote lock-out system for a horizontal directional drilling (HDD) system includes a remote lock-out controller comprising indicators capable of indicating to the operator various conditions including normal run mode, lock-out mode, loss of radio communication, and failure to respond to lock-out. The remote lock-out controller further includes a transceiver for facilitating bidirectional communications with the control system of the HDD system, a run switch for initiating run logic of the control system, and a lock-out switch for initiating lock-out logic of the control system. Actuation of the lock-out switch initiates lock-out logic for interrupting power transmission to the drilling machine. For example, actuation of the lock-out switch initiates lock-out logic for interrupting power transmission to the drilling machine via a primary power transmission system in accordance with first lock-out logic and for interrupting power transmission to the drilling machine via a secondary power transmission system in accordance with second lock-out logic.

According to another embodiment, a method for remotely altering operation of a horizontal directional drilling (HDD) machine involves continuously monitoring for radio communication between a remote lock-out controller and a remote lock-out override module at HDD machine start-up, wherein the remote lock-out override module is communicatively coupled to a control system of the HDD machine. The method further involves preventing operation of the drilling machine until the radio communication is established or until an override state is initiated in response to actuation of a manual override switch, and automatically terminating the override state when the radio communication is established, such that a drilling machine lock-out is initiated even if the drilling machine were previously set into an override state. A handshake signaling protocol can be employed to establish the radio communication.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

BRIEF DESCRIPTION OF THE DRAWINGS

FIG. 28*a* is a flow chart of operating logic implemented in accordance with another embodiment of a remote LOCK-OUT override module of the present invention with an additional function of verifying a last requested state;

Figure 1:
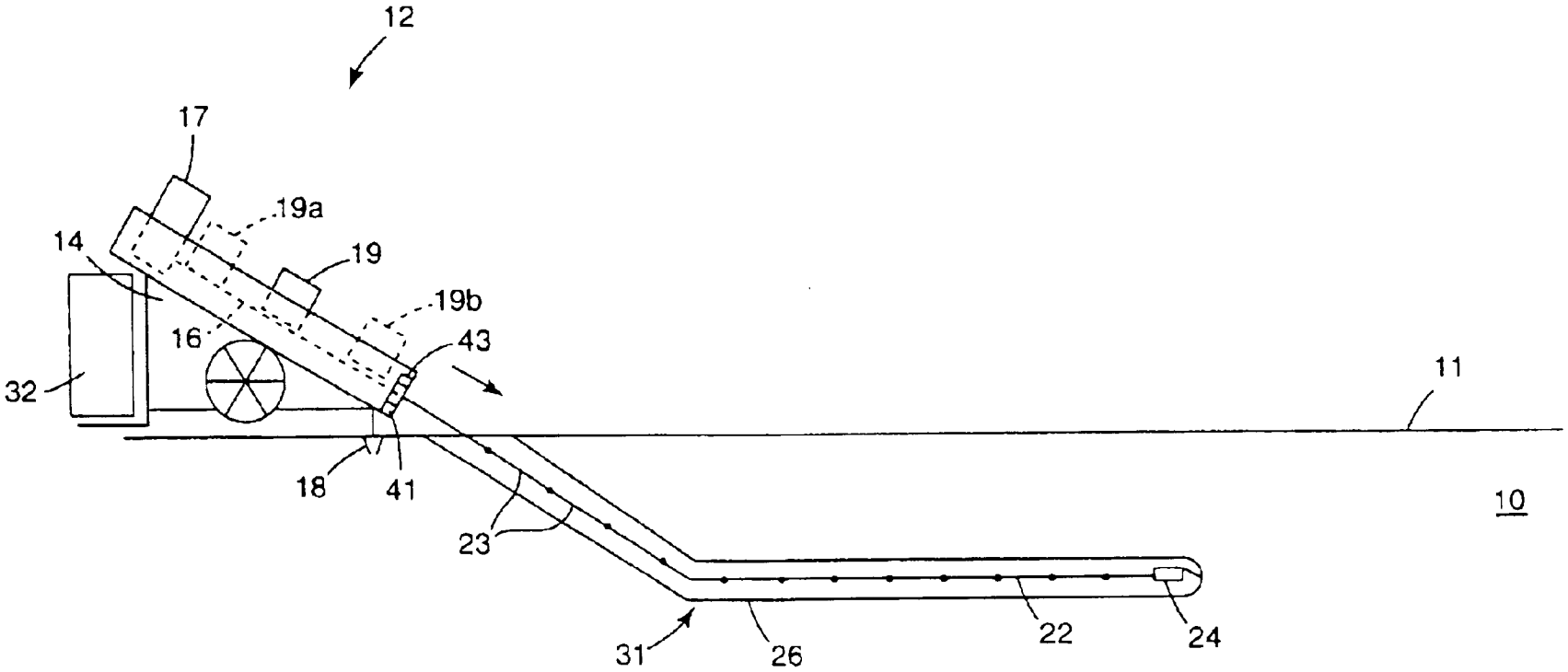
FIG. 1 is a side view of an underground boring apparatus in accordance with an embodiment of the present invention.

While the invention is amenable to various modifications and alternative forms, specifics thereof have been shown by way of example in the drawings and will be described in detail hereinbelow. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF VARIOUS EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

In general terms, a control system and method for a horizontal directional drilling machine incorporates a transceiver on the drilling machine and a transceiver on a remote unit wherein the remote unit and drilling machine are capable of cooperatively providing appropriate assurance of a disruption in the transmission of rotary, fluid, and longitudinal power to a remotely located drilling bit. Systems and methods of the present invention provide for remotely altering operation of a horizontal directional drilling machine, including remotely preventing and/or limiting movement of a cutting head or reamer and disabling dispensing of fluid, foam and/or air into the borehole. A LOCK-OUT signal is transmitted from a location remote from the drilling machine, preferably by use of a portable or hand-manipulatable remote unit operated by an operator remotely situated with respect to the drilling machine. The LOCK-OUT signal transmitted by the remote unit is received at the drilling machine.

In response to the received LOCK-OUT signal, a controller of the drilling machine initiates control signals to stop and prevent movement of the drill string, such as by stopping and disabling displacement and rotation of the drill string to which the cutting head or reamer is coupled. The controller also disables dispensing of fluid, foam and/or air into the borehole in response to the received LOCK-OUT signal. After initiating the necessary control signals, the controller further monitors signals from the machine that correlate to the status of the machine to verify that such movements have been disabled. After confirmation, the controller issues a verification signal that is transmitted back to the remote unit. In addition, the controller continues to monitor the signals to ensure that the LOCK-OUT state is maintained, and will initiate further actions if the controller detects that the LOCK-OUT state being violated.

The present invention is useful in protecting operators who are involved with changing the tooling installed on the terminating end of the drill string. This is accomplished by providing a system and method that allows the operator located near the terminating end of the drill string to securely lock out the drilling machine to prevent movement of the drill string and pumping of drilling fluid.

Referring now to the figures and, more particularly to FIG. 1, there is illustrated an embodiment of a horizontal directional drilling (HDD) machine which incorporates a control system and methodology for implementing a remote LOCK-OUT methodology of the present invention. The term LOCK-OUT is generally understood in various fields as a safety protocol by which a component or process is intentionally disabled (i.e., locked-out). In addition, an indication of such disablement may be communicated in some manner (i.e., tagged-out). Enabling of the intentionally disabled component or process typically involves the completion of a verification step or sequence of steps of limited complexity that protects against inadvertent reinstatement of the process or component activity.

Systems and methods of the present invention are directed to implementing a LOCK-OUT methodology by which certain operations of an HDD machine are disabled or limited upon receiving a LOCK-OUT command from a remote source. Systems and methods of the present invention are also directed to remotely altering and/or controlling the operation of an HDD machine when operating in one of a number of modes, such as a CREEP mode, ROTATE mode, PUSH mode, PULLBACK mode and rod manipulation mode, and when implementing cutting head steering changes.

The advantages and benefits of the present invention may be realized by incorporating a LOCK-OUT methodology of the present invention in new HDD machine designs. Advantageously, a LOCK-OUT methodology of the present invention may be incorporated in certain existing HDD machines, typically by upgrading the controller's software and provision of a remote unit of the present invention.

FIG. 1 illustrates a cross-section through a portion of ground 10 where a horizontal directional drilling operation takes place. The HDD machine 12 is situated aboveground 11 and includes a platform 14 on which is situated a tilted longitudinal member 16. The platform 14 is secured to the ground by pins 18 or other restraining members in order to prevent the platform 14 from moving during the drilling or boring operation. Located on the longitudinal member 16 is a thrust/pullback pump 17 for driving a drill string 22 in a forward and/or reverse longitudinal direction. The drill string 22 is made up of a number of drill string members or rods 23 attached end-to-end.

Also located on the tilted longitudinal member 16, and mounted to permit movement along the longitudinal member 16, is a rotation motor or pump 19 for rotating the drill string 22 (illustrated in an intermediate position between an upper position 19*a* and a lower position 19*b*). In operation, the rotation motor 19 rotates the drill string 22 which has a cutting head or reamer 24 attached at the end of the drill string 22.

A typical boring operation takes place as follows. The rotation motor 19 is initially positioned in an upper location 19*a* and rotates the drill string 22. While the boring tool 24 is rotated, the rotation motor 19 and drill string 22 are pushed in a forward direction by the thrust/pullback pump 17 toward a lower position into the ground, thus creating a borehole 26.

The rotation motor 19 reaches a lower position 19*b* when the drill string 22 has been pushed into the borehole 26 by the length of one drill string member 23. With the rotation motor 19 situated at lower position 19*b*, a clamp 41 then grips the drill string to 22 to stop all downhole drill string movement. A clamp sensor 43 senses actuation of clamp 41 and generates a clamp signal when the clamp 41 properly engages the drill string 22. Clamp sensor 43 may sense displacement of the clamp mechanism and may generate a clamp signal when the clamp mechanism has traveled a distance sufficient to provide for secured engagement with the drill string 22.

The rotation motor 19 is then uncoupled from the clamped drill string 22 and pulled back to upper location 19*a*. A new drill string member or rod 23 is then added to the drill string 22 either manually or automatically. The clamping mechanism then releases the drill string and the thrust/pullback pump 17 drives the drill string 22 and newly added rod 23 into the borehole. The rotation motor 19 is thus used to thread a new drill string member 23 to the drill string 22, and the rotation/push process is repeated so as to force the newly lengthened drill string 22 further into the ground, thereby extending the borehole 26.

Commonly, water or other fluid is pumped through the drill string 22 by use of a mud or water pump. If an air hammer is used as the cutting implement 24, an air compressor is employed to force air/foam through the drill string 22. The water/mud or air/foam flows back up through the borehole 26 to remove cuttings, dirt, and other debris. A directional steering capability is provided for controlling the direction of the boring tool 24, such that a desired direction can be imparted to the resulting borehole 26. Exemplary systems and methods for controlling an HDD machine of the type illustrated in the Figures are disclosed in commonly assigned U.S. Pat. Nos. 5,746,278 and 5,720,354, and U.S. application Ser. No. 09/405,890 and 09/405,889 filed concurrently on Sep. 24, 1999; all of which are hereby incorporated herein by reference in their respective entireties.

Figure 2:
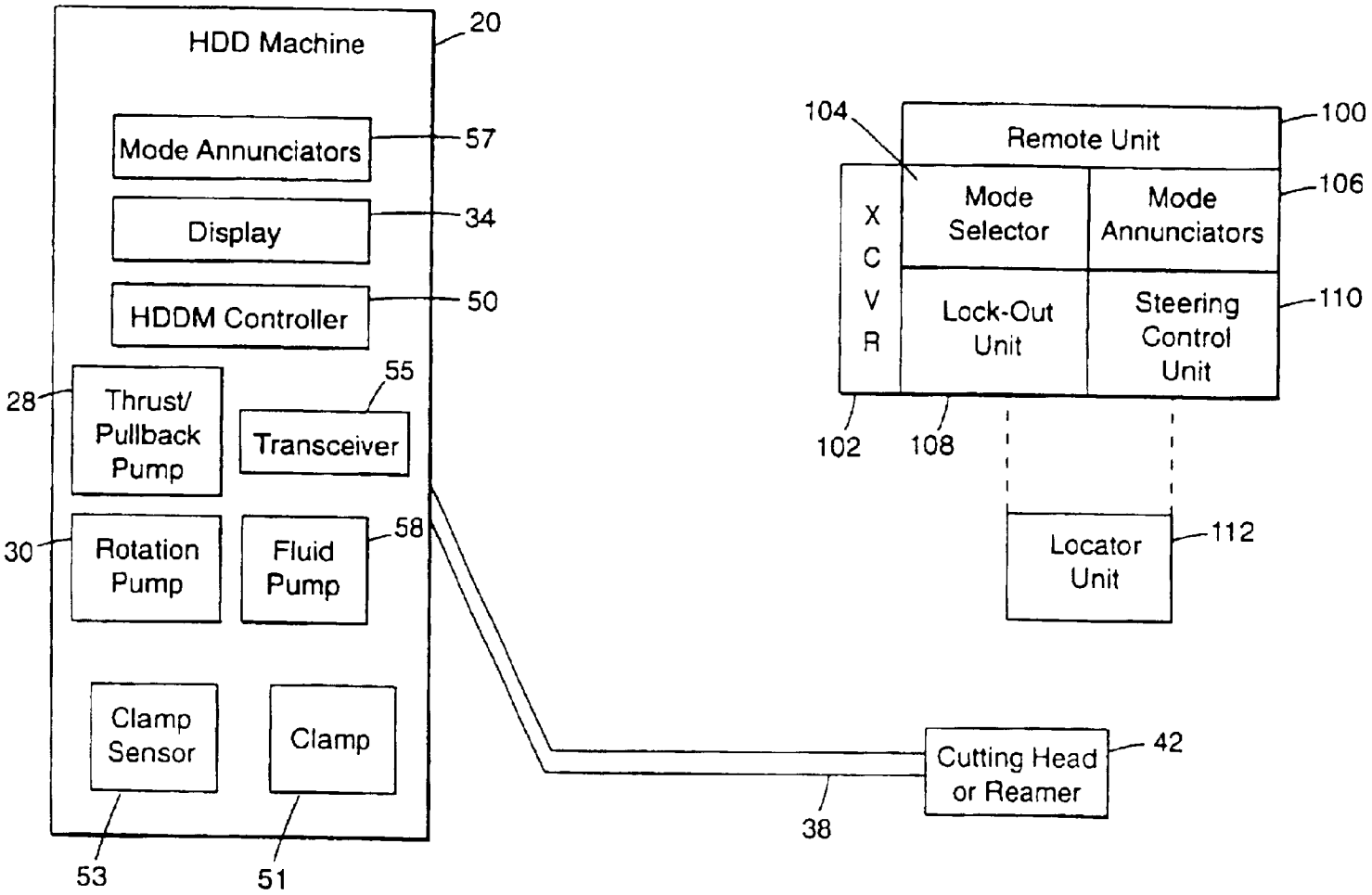
FIG. 2 is a block diagram of a remote unit operable by a remote operator that cooperates with a controller of a horizontal directional drilling (HDD) machine to implement a remote LOCK-OUT methodology in accordance with an embodiment of the present invention.

FIG. 2 is a block diagram of a remote unit 100 that cooperates with a controller 50 of a horizontal directional drilling machine (HDDM) to implement a remote LOCK-OUT methodology in accordance with an embodiment of the present invention. Many of the components of HDD machine 20 shown in FIG. 2 are generally representative of those having like numerical references with respect to HDD machine 20 shown in FIG. 1. As such, the HDD machine shown in FIG. 1 may be readily retrofitted to include the system components and/or controller software associated with the system of FIG. 2 in order to implement a LOCK-OUT methodology according to the principles of the present invention.

With continued reference to FIG. 2, HDD machine 20 includes a main controller or processor, referred to herein as HDDM controller 50, which controls the operations of HDD machine 20 when operating in several different modes, including a LOCK-OUT mode. HDDM controller 50 controls the movement of a cutting head or reamer 42 and drill string 38 by appropriately controlling a thrust/pullback pump 28, alternatively referred to as a displacement pump 28, and a rotation pump 30, each of which is mechanically coupled to the drill string 38. HDDM controller 50 also controls a fluid pump 58, alternatively referred to as a "mud" pump, which dispenses a cutting fluid (e.g., water, mud, foam, air) to the cutting head 42 via the drill string 38.

The HDD machine 20 further includes a clamping apparatus 51 which is used to immobilize the drill string 38 during certain operations, such as when adding or removing a drill rod to/from the drill string 38. In one embodiment, the HDD controller 50 provides for limited usage of the thrust/pullback pump 28 and rotation pump 30 when operating in a LOCK-OUT mode. As will be discussed in greater detail hereinbelow, the HDD controller 50 activates the clamping mechanism during a LOCK-OUT procedure to prevent movement of the downhole drill string 38. Upon receiving a signal from a clamp sensor 53 that the clamping mechanism 51 has properly engaged and immobilized the drill string 38, the HDD controller 50 permits limited thrust/pullback pump 28 and rotation pump 30 usage. The HDD controller 50 may coordinate the manipulation of drill rods in cooperation with an automatic rod loader apparatus of the type disclosed in commonly assigned U.S. Pat. No. 5,556,253, which is hereby incorporated herein by reference in its entirety.

HDDM controller 50 is further coupled to a display 34 and/or a number of mode annunciators 57. Display 34 may be used to communicate various types of information to the HDD machine operator, such as pump pressures, engine output, boring tool location and orientation data, operating mode information, remote steering and operating requests/commands, and the like. Mode annunciators 57 provide the machine operator with particularized information concerning various functions initiated by or in cooperation with remote unit 100. Mode annunciators 57 typically include one or more visual, audible, and/or tactile (e.g., vibration) indicators. A transceiver 55 is provided on HDD machine 20 to facilitate the communication of signals and information between HDD machine 20 and remote unit 100.

Remote unit 100 is preferably configured as a hand-held unit that incorporates controls which are readily actuatable by an operator situated remote from the HDD machine 20. In one embodiment, all of the controls and/or switches provided on the hand-held remote unit 100 are readily actuatable by an operator using only one hand, that being the hand holding the remote unit 100. The remote unit 100 may incorporate ergonomic features that facilitate easy grasping and retention of the unit 100 in the hand, and features that promote easy interaction between the remote user and the remote unit 100. According to this embodiment, remote unit 100 includes a belt clip or other arrangement that facilitates easy detachability between remote unit 100 and the remote user.

In accordance with another embodiment, remote unit 100 may be incorporated into a portable locator or tracking unit 112 as is known in the art. A remote operator may use locator 112, which incorporates remote unit 100 functionality, to perform conventional tasks, such as scanning an area above the cutting head 42 for purposes of detecting a magnetic field produced by an active sonde provided within the cutting head 42. In addition to the availability of standard locator functions, various LOCK-OUT and remote steering functions according to the present invention may be selectively implemented using a locator modified to incorporate remote unit 100 functionality. Examples of such known locators are disclosed in U.S. Pat. Nos. 5,767,678; 5,764,062; 5,698,981; 5,633,589; 5,469,155; 5,337,002; and 4,907,658; all of which are hereby incorporated herein by reference in their respective entireties. These systems may be advantageously modified to include components and functionality described herein to provide for LOCK-OUT and remote steering capabilities in accordance with the principles of the present invention.

The embodiment of remote unit 100 shown in FIG. 2 includes a LOCK-OUT unit 108 which incorporates a LOCK-OUT control or switch. The LOCK-OUT unit 108, in response to actuation of the LOCK-OUT switch by the remote user, initiates a LOCK-OUT sequence which results in the expedient termination of drill string 38/cutting head 42 movement and fluid flow to the cutting head 42. As will be discussed in greater detail hereinbelow, and in contrast to conventional safety schemes, the LOCK-OUT unit 108 and mode annunciators 106 of remote unit 100 cooperate with HDDM controller 50 of HDD machine 20 to assure the remote operator, without ambiguity, that all drill string 38/cutting head 42 movement has been disabled. The remote operator, after receiving verification that the LOCK-OUT sequence had been successfully completed, may then work closely or directly with the cutting head 42 and/or drill string 38 with confidence, knowing that no further cutting head 42/drill string 38 movement or fluid dispensing will occur until the LOCK-OUT state is purposefully and properly reset by both the remote operator and the HDD machine operator.

Remote unit 100 also includes a mode selector 104 and a number of mode annunciators 106. Mode selector 104 permits the remote operator to select one of a number of different operating modes, such as a CREEP, ROTATE, PUSH, and PULLBACK modes, and when implementing boring tool steering changes via steering control unit 110. An indication of the selected mode and other information, such as a warning indication, is communicated to the remote user via mode annunciators 106. Mode annunciators 106 typically include one or more visual, audible, and/or tactile (e.g., vibration) indicators. Alternatively, or in addition to mode annunciators 106, remote unit 100 may be provided with a display.

A transceiver 102 of remote unit 100 permits the remote unit 100 to communicate with HDD machine 20 via transceiver 55 of HDD machine 20. To facilitate communication between remote unit 100 and HDD machine 20, one or more repeaters may be situated at appropriate locations at the drilling site. The use of repeaters may be desirable or required when hills or other natural or manmade obstructions lie between the remote unit 100 and HDD machine 20. Repeaters may also be used to provide for increased signal-to-noise (SNR) ratios. Communication between remote unit 100 and HDD machine 20 may be enhanced by using one or more repeaters when drilling boreholes having lengths on the order of thousands of feet (e.g., one mile). Those skilled in the art will appreciate that a number of communication links and protocols may be employed to facilitate the transfer of information between remote unit 100 and HDD machine 20, such as those that employ wire or free-space links using infrared, microwave, laser or acoustic telemetry approaches, for example.

Figure 3A:
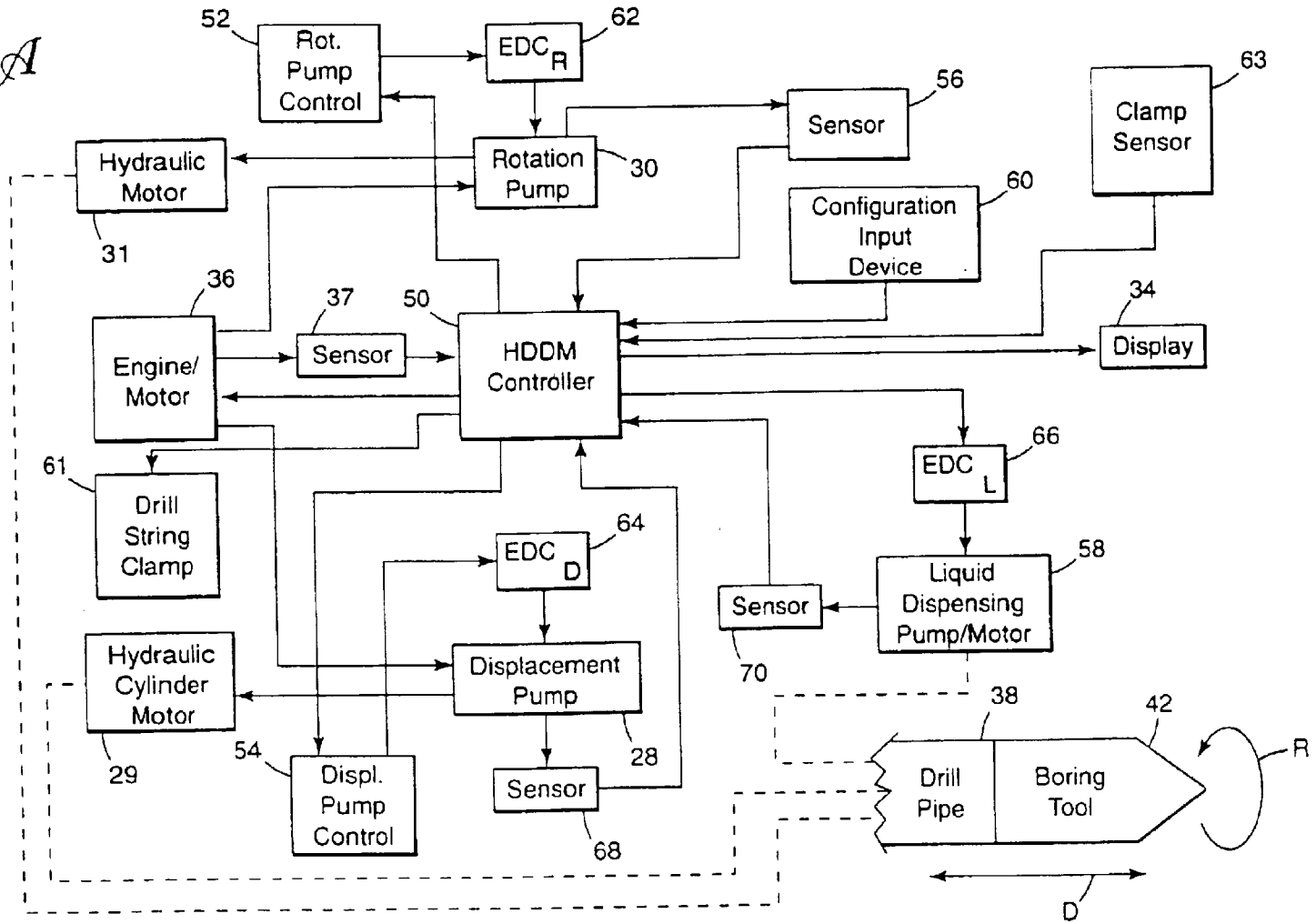
FIG. 3A depicts a control system of an HDD machine that cooperates with a remote unit to implement a remote LOCK-OUT methodology in accordance with an embodiment of the present invention.
Figure 3B:
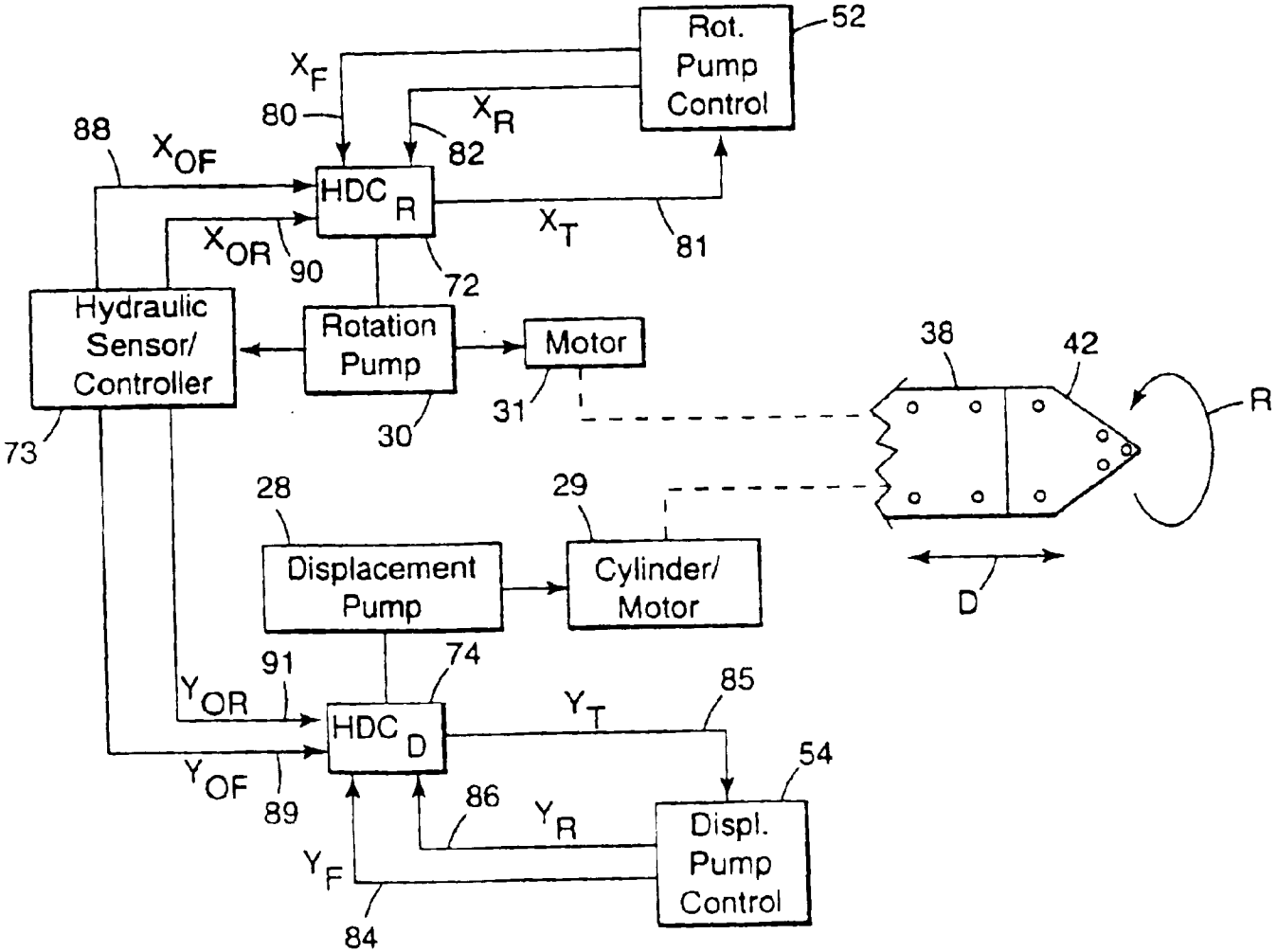
FIG. 3B depicts a control system of an HDD machine that cooperates with a remote unit to implement a remote LOCK-OUT methodology in accordance with another embodiment of the present invention.

Referring now to FIG. 3A, there is illustrated one embodiment of a control system of an HDD machine for controlling drilling activities during normal operation and for implementing a LOCK-OUT methodology in accordance with the principles of the present invention. Although specific control system implementations are depicted in FIGS. 3A and FIG. 3B, it will be understood that a control system suitable for effecting a LOCK-OUT methodology of the present invention may be implemented using electrical, mechanical, or hydraulic control elements or any combination thereof.

With continued reference to FIG. 3A, the operation of a displacement pump 28 and a rotation pump 30 is controlled by HDDM controller 50. HDDM controller 50 is also coupled to an engine/motor 36 of the HDD machine which provides source power respectively to the displacement and rotation pumps 28 and 30. A rotation pump sensor 56 is coupled to the rotation pump 30 and HDDM controller 50, and provides an output signal to HDDM controller 50 corresponding to a pressure or pressure differential, or alternatively, a speed of the rotation pump 30. A rotation pump control 52 and a displacement pump control 54 provide for manual control over the rate at which drilling or back reaming is performed. During idle periods, the rotation and displacement pump controls 52 and 54 are preferably configured to automatically return to a neutral setting at which no rotation or displacement power is delivered to the cutting head 42 for purposes of enhancing safety.

Modification to the operation of the displacement pump 28 and rotation pump 30 is controlled by HDDM controller 50. A rotation pump sensor 56, coupled to the rotation pump 30 and HDDM controller 50, provides an output signal to HDDM controller 50 corresponding to the pressure or pressure differential, or alternatively, the rotation speed of the rotation pump 30. A displacement pump sensor 68, coupled to the displacement pump 28 and HDDM controller 50, provides an output signal to HDDM controller 50 corresponding to the pressure level of the displacement pump 28 or, alternatively, the speed of the displacement pump 28. A rotation pump control 52 and a displacement pump control 54 provide for manual control over the rate at which drilling or back reaming is performed.

An operator typically sets the rotation pump control 52 to a desired rotation setting during a drilling or back reaming operation, and modifies the setting of the displacement pump control 54 in order to change the rate at which the cutting head 42 is displaced along an underground path when drilling or back reaming. The rotation pump control 52 transmits a control signal to an electrical displacement control 62 ($EDC_R$) coupled to the rotation pump 30. $EDC_R$ 62 converts the electrical control signal to a hydrostatic control signal which is transmitted to the rotation pump 30 for purposes of controlling the rotation rate of the cutting head 42.

The operator also sets the displacement pump control 54 to a setting corresponding to a preferred boring tool displacement rate. The operator may modify the setting of the displacement pump control 54 to effect gross changes in the rate at which the cutting head 42 is displaced along an underground path when drilling or back reaming. The displacement pump control 54 transmits a control signal to a second EDC 64 ($EDC_D$) coupled to the displacement pump 28. $EDC_D$ 64 converts the electrical control signal received from the controller 64 to a hydrostatic control signal, which is then transmitted to the displacement pump 28 for purposes of controlling the displacement rate of the cutting head 42.

The HDD machine also includes a liquid dispensing pump/motor 58 (hereinafter referred to as a liquid dispensing pump) which communicates liquid through the drill string 38 and cutting head 42 for purposes of providing lubrication and enhancing boring tool productivity. The operator generally controls the liquid dispensing pump 58 to dispense liquid, preferably water, a water/mud mixture or a foam, at a preferred dispensing rate by use of an appropriate control lever or knob provided on the control panel 32 shown in FIG. 1. Alternatively, the dispensing rate of the liquid dispensing pump 58, as well as the settings of the rotation pump 30, displacement pump 28, and engine 36, may be set and controlled using a configuration input device 60, which may be a keyboard, keypad, touch sensitive screen or other such input interface device, coupled to HDDM controller 50. HDDM controller 50 receives the liquid dispensing setting produced by the control lever/knob provided on the control panel 32 or, alternatively, the configuration input device 60, and transmits an electrical control signal to a third EDC 66 ($EDC_L$) which, in turn, transmits a hydrostatic control signal to the liquid dispensing pump 58.

A feedback control loop provides for automatic adjustment to the rate of the displacement pump 28 and rotation pump 30 in response to varying drilling conditions. The feedback control loop further provides for automatic adjustment to the rate at which a drilling fluid is dispensed to the cutting head 42. HDDM controller 50 communicates the necessary control signals to the displacement pump 28, rotation pump 30, and liquid dispensing pump 58 to implement the LOCK-OUT and remote steering/remote control methodologies of the present invention.

The HDDM controller 50 is also coupled to a drill string clamp 61 and a clamp sensor. The HDDM controller 50 controls the drill string clamp 61 to immobilize the drill string during a LOCK-OUT procedure in which limited usage of the thrust/pullback pump 28 and rotation pump 30 is provided. The HDDM controller 50 activates the clamping mechanism during a LOCK-OUT procedure to prevent movement of the downhole drill string and, upon receiving a signal from a clamp sensor 53 verifying proper engagement between the clamp 61 and the drill string, the HDDM controller 50 permits limited thrust/pullback pump 28 and rotation pump 30 usage, such as when manipulating rods being added to or removed from the clamped drill string.

In FIG. 3B, there is illustrated an alternative embodiment of the present invention, in which control of the displacement pump 28 is provided through hydraulic control signals, rather than electrical control signals employed in the embodiment described hereinabove. In accordance with one mode of operation, the operator sets the rotation pump control 52 to an estimated optimum rotation setting for a drilling or reaming operation. The rotation pump control 52 transmits a control signal to a hydraulic displacement control ($HDC_R$) 72 which, in turn, transmits a hydraulic control signal to the rotation pump 30 for purposes of controlling the rotation rate of the cutting head or reamer 42.

Various types of hydraulic displacement controllers (HDC's) use hydraulic pilot signals for effecting forward and reverse control of the pump servo. A pilot signal is normally controlled through a pilot control valve by modulating a charge pressure signal typically between 0 and 800 pounds-per-square inch (psi). $HDC_R$ 72, in response to the operator changing the setting of the rotation pump control 52, produces corresponding changes to the forward pilot signal, $X_F$ 80, and the reverse pilot signal, $X_R$ 82, thus altering the rate of the rotation pump 30. Line $X_T$ 81 is a return line from $HDC_R$ 72 to the rotation pump control 52. Similarly, in response to the operator changing the setting of the displacement pump control 54, the displacement pump control 54 correspondingly alters the forward pilot signal, $Y_F$ 84, and the reverse pilot signal, $Y_R$ 86, of $HDC_D$ 74, which controls the displacement pump 28, thus altering the displacement rate. Line $Y_T$ 85 is a return line from $HDC_D$ 74 to the displacement pump control 54.

The hydraulic sensor/controller 73 senses the pressure of the rotation pump 30 or, alternatively, the rotation speed of the rotation pump 30, by monitoring the flow rate through an orifice to measure rotation, and is operable to transmit hydraulic override signals $X_{OF}$ 88 and $X_{OR}$ 90 to the $HDC_R$ 72, and hydraulic override signals $Y_{OF}$ 89 and $Y_{OR}$ 91 to the $HDC_D$ 74. When, for example, the hydraulic sensor/controller 73 senses that the pressure of the rotation pump 30 has exceeded the upper acceptable pressure limit, $P_L$, override signals $Y_{OF}$ 89 and $Y_{OR}$ 91 are transmitted to the $HDC_D$ 74 in order to appropriately reduce the cutting head or reamer displacement rate while maintaining the rotation of the cutting head or reamer at a desired rate, such as a substantially constant rate. Once the pressure of the rotation pump 30 has recovered to an acceptable level, the hydraulic sensor/controller 73 instructs $HDC_D$ 74 to increase the displacement rate.

The hydraulic sensor/controller 73 may be coupled to an HDDM controller of the type described in connection with FIG. 3A or, alternatively, may incorporate the functionality of HDDM controller 50. In an embodiment in which limited rotation and displacement pump usage is provided during implementation of a LOCK-OUT procedure, the hydraulic sensor/controller 73 or HDDM controller coupled thereto controls the drill string clamp 61 and receives signals from the clamp sensor 63 in a manner described previously with regard to the embodiment of FIG. 3A.

Figure 4:
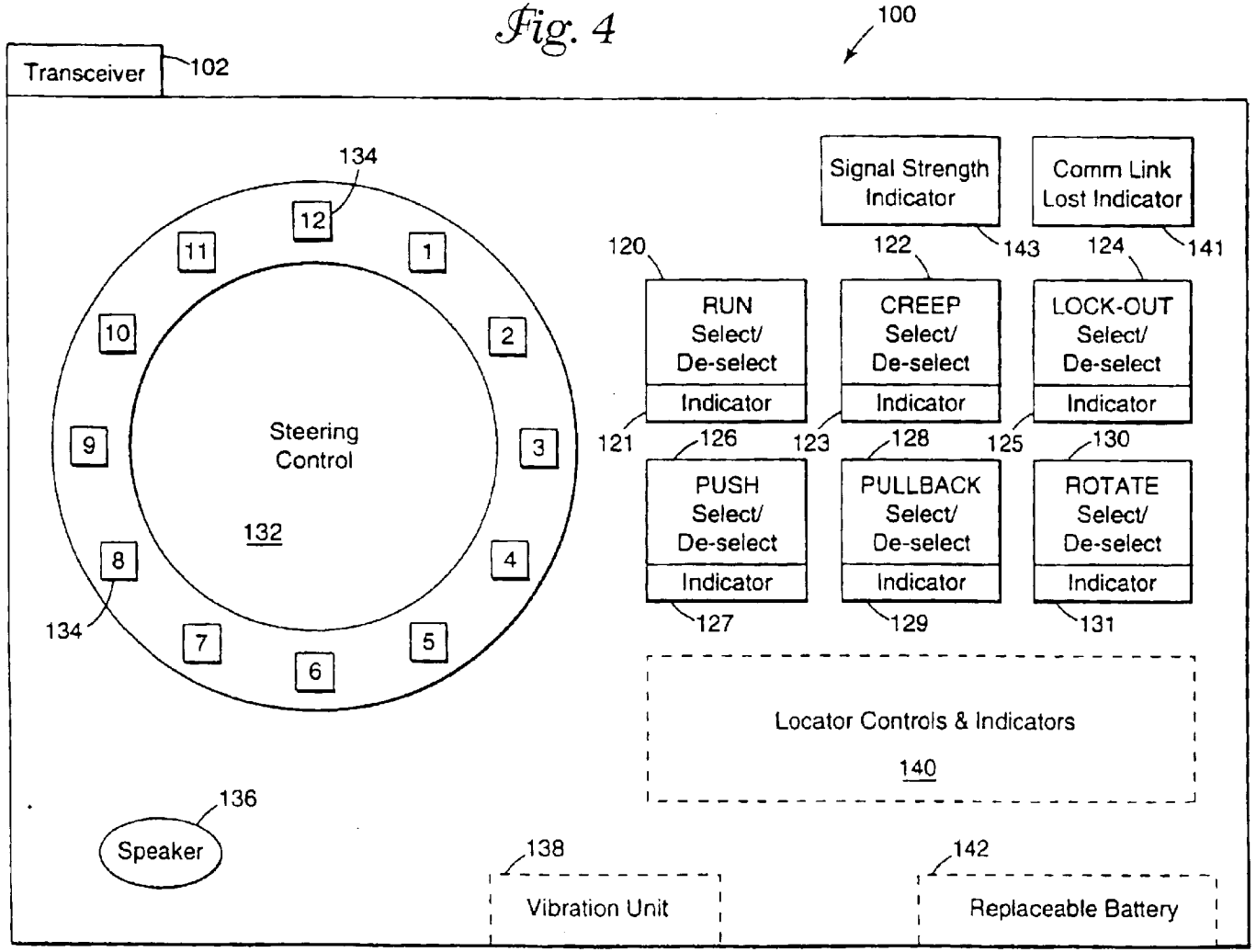
FIG. 4 is a block diagram of a remote unit that cooperates with a controller of an HDD machine to implement a remote LOCK-OUT methodology in accordance with an embodiment of the present invention.

Turning now to FIG. 4, there is illustrated a remote unit 100 according to an embodiment of the present invention. Remote unit 100 shown in FIG. 4 includes a number of user actuatable controls for selecting and de-selecting a variety of remote control functions. As previously discussed, remote unit 100 may alternatively be incorporated into a portable locator. According to an alternative configuration, various locator controls and indicators 140 may instead be incorporated as part of remote unit 100.

In general, a remote user may use remote unit 100 to implement a LOCK-OUT methodology according to the present invention exclusive of or in addition to other remote control capabilities. In one system configuration, for example, remote unit 100 includes only those controls and indicators necessary to perform LOCK-OUT functions (e.g., LOCK-OUT control 124, LOCK-OUT indicator 125, RUN control 120, RUN indicator 121, and COMM LINK LOST indicator 141).

A user initiates the LOCK-OUT procedure by actuation of LOCK-OUT control 124. A LOCK-OUT indicator 125 provides a visual indication of the LOCK-OUT procedure status, such as the selection or de-selection of LOCK-OUT control 124 and verification that the LOCK-OUT sequence has been successfully completed by the HDD machine. In one embodiment, LOCK-OUT control 124 includes a mushroom-type push button switch incorporating a twist release mechanism and a key cap. According to this embodiment, LOCK-OUT indicator 125 includes a red illumination element, such as a lamp or light emitting diode (LED), for example, which may be controlled in a constant illumination mode, flashing mode, and extinguished mode.

According to a second system configuration, remote unit 100 may, in addition to the controls and indicators of the first system configuration discussed above, further include a CREEP mode control 122 and associated CREEP indicator 123. By actuation of CREEP control 122, the remote user may place the HDD machine into a "CREEP" mode. When placed in CREEP mode, the thrust or displacement rate of the drill string/boring tool is reduced to a user defined low speed level. In one embodiment, the remote user may modify the creep rate of boring tool displacement by adjustment of a CREEP SPEED control (not shown). It is noted that, upon proper termination of the CREEP mode of operation, the HDD machine operator must return the manual thrust/pullback control to a "neutral" position before resuming normal thrust/pullback operations.

A CREEP mode of operation may be selected by the remote user actuating CREEP control 122. In one embodiment, CREEP control 122 includes a pushbutton-type toggle switch which may incorporate an illumination element as an indicator 123 to indicate the state of CREEP control 122. For example, CREEP control 122 may include a yellow-lighted pushbutton-type toggle switch. Normal drilling operations may be remotely reinstated by appropriate termination of CREEP mode and actuation of RUN control 120. RUN control 120 may include a pushbutton-type toggle switch and associated green-colored illumination element 121.

In accordance with a third system configuration, remote unit 100 may, in addition to the controls and indicators of the first and second system configurations discussed above, also provide the capability to send steering requests/commands to the HDD machine via steering control 132. Remote unit 100 includes a steering control 132 that permits the remote user to remotely effect steering changes to the heading of the boring tool.

In one embodiment, steering control 132 includes 12 lighted (e.g., white) pushbutton momentary switches 134 that define a clock-face pattern. When pushed, a selected switch 134 illuminates and all other switches 134 are extinguished. When certain other remote control functions are evoked, such as functions initiated by actuation of ROTATE control 130 or PULLBACK control 128, for example, all switches 134 of steering control 132 are extinguished and steering control 132 is disabled.

When the remote user desires that the boring tool be steered a certain direction, such as toward a 2 o'clock direction from a 12 o'clock direction, for example, an appropriate momentary switch 134 (e.g., "2" o'clock switch 134) is actuated by the remote user to select the desired clock-based steering direction. In accordance with one steering mode embodiment, actuation of a selected momentary switch 134 results in the transmission of a steering signal from transceiver 102 of remote unit 100. The steering signal is received by the transceiver 55 of the HDD machine 20, shown in FIG. 2, and presented on display 34. An RS-232 interface may be provided between the HDDM controller 50 and display 34. A replication of the steering control clock-face of the remote unit 100 may, for example, be graphically presented on display 34 of the HDD machine. The HDD machine operator may make the necessary adjustments at the HDD machine to effect the requested steering changes.

According to an alternative embodiment, the steering signal transmitted by remote unit 100 is received at the HDD machine and acted upon directly by HDDM controller 50, rather than by the machine operator, via the closed-loop control system of the HDD machine. The steering request/command made by the remote user may be displayed on the HDD machine display 34 in the manner described above. The machine operator may, if desired, override, suspend or terminate an automatic steering operation initiated by the remote user.

The remote user may control other HDD operations, including controlling forward and reverse displacement of the drill string/boring tool and rotation of the drill string/boring tool. Remote control over these three operations is initiated by actuation of a PUSH control 126, PULLBACK control 128, and ROTATE control 130, respectively. Selection and de-selection of each of these controls 126,128, 130 results in illumination and extinguishing of associated PUSH, PULLBACK, and ROTATE indicators 127,129, and 131, respectively. In accordance with one embodiment, PUSH control 126 is associated with white PUSH indicator 127, PULLBACK control 128 is associated with blue PULLBACK indicator 129, and ROTATE control 130 is associated with blue ROTATE indicator 131.

Remote unit 100 further includes a COMM LINK LOST indicator 141 which is illuminated whenever a loss of communication connectivity between the remote unit 100 and HDD machine is detected. Remote unit 100 may also include a signal strength indicator 143. A multiple colored indicator 143, for example, may be used to indicate the relative strength of the signal transmitted between HDD machine and remote unit 100. For example, the signal strength indicator 143 may provide for the generation of green light, yellow light, and red light. Illumination of a green light, for example, may indicate reception of a strong signal (e.g., high signal-to-noise (SNR) ratio). Illumination of a yellow light may be indicative of an acceptable but reduced signal strength level. Illumination of a red light may be indicative of an unacceptable signal strength level. Frequent illumination of the yellow and/or red lights may indicate that repeaters should be deployed in order to increase the strength of the signal transmitted between the remote unit 141 and HDD machine.

Audible warnings or alert messages, both verbal and non-verbal, may be broadcast to the remote user via a speaker 136 provided on the remote unit 141. The speaker preferably broadcasts audible messages at an appropriate level, but no louder than is permitted under applicable regulations (e.g., no greater than 106 Dba) A vibration unit 138 may also be provided to communicate a tactile warning or alert message to the remote user. The remote unit 100 is powered by a battery 142 that can be readily replaced in the field, preferably without the need for tools. The battery is preferably a rechargeable battery.

Figure 5:
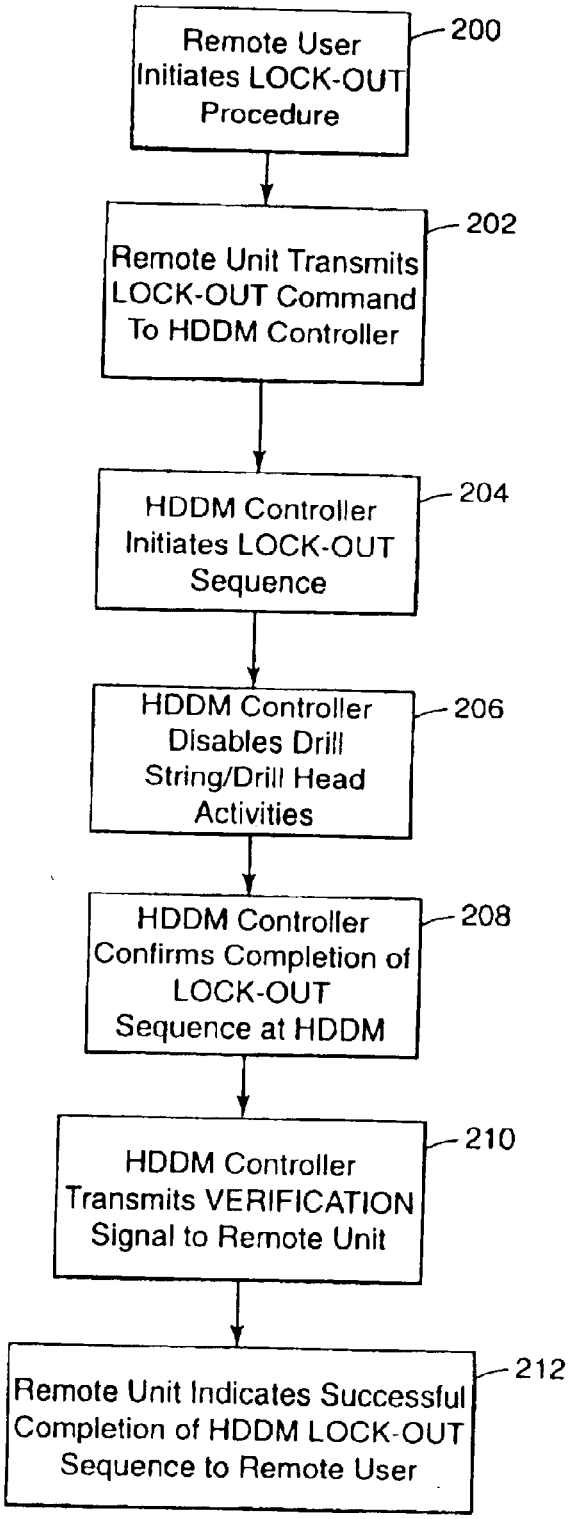
FIG. 5 is a flow diagram that illustrates various steps associated with cooperative operation between a remote unit and a controller of an HDD machine when implementing a remote LOCK-OUT methodology in accordance with an embodiment of the present invention.

Referring now to FIG. 5, there is illustrated a flow diagram that illustrates various steps associated with cooperative operation between a remote unit and a controller of an HDD machine when implementing a remote LOCK-OUT methodology in accordance with an embodiment of the present invention. The remote unit turns on whenever the remote user actuates either the LOCK-OUT control or the RUN control. The LOCK-OUT procedure is initiated 200 in the field by a remote user, such as a user situated down-hole of the HDD machine, using the remote unit described hereinabove. The remote unit transmits 202 a LOCK-OUT command to the HDDM controller. In response to the LOCK-OUT command, the HDDM controller initiates 204 a LOCK-OUT sequence locally at the HDD machine.

In general terms, the HDDM controller disables 206 drill string/cutting head activities when implementing the LOCK-OUT sequence. The HDDM controller confirms 208 successful completion of the LOCK-OUT sequence at the HDD machine. After confirming successful completion of the LOCK-OUT sequence, the HDDM controller transmits 210 a VERIFICATION signal (e.g., "COMMAND-ACKNOWLEDGED" signal) to the remote unit. In response to receipt of the VERIFICATION signal, the remote unit provides 212 an indication to the remote user that the LOCK-OUT sequence at the HDD machine has been successfully completed.

Figure 6:
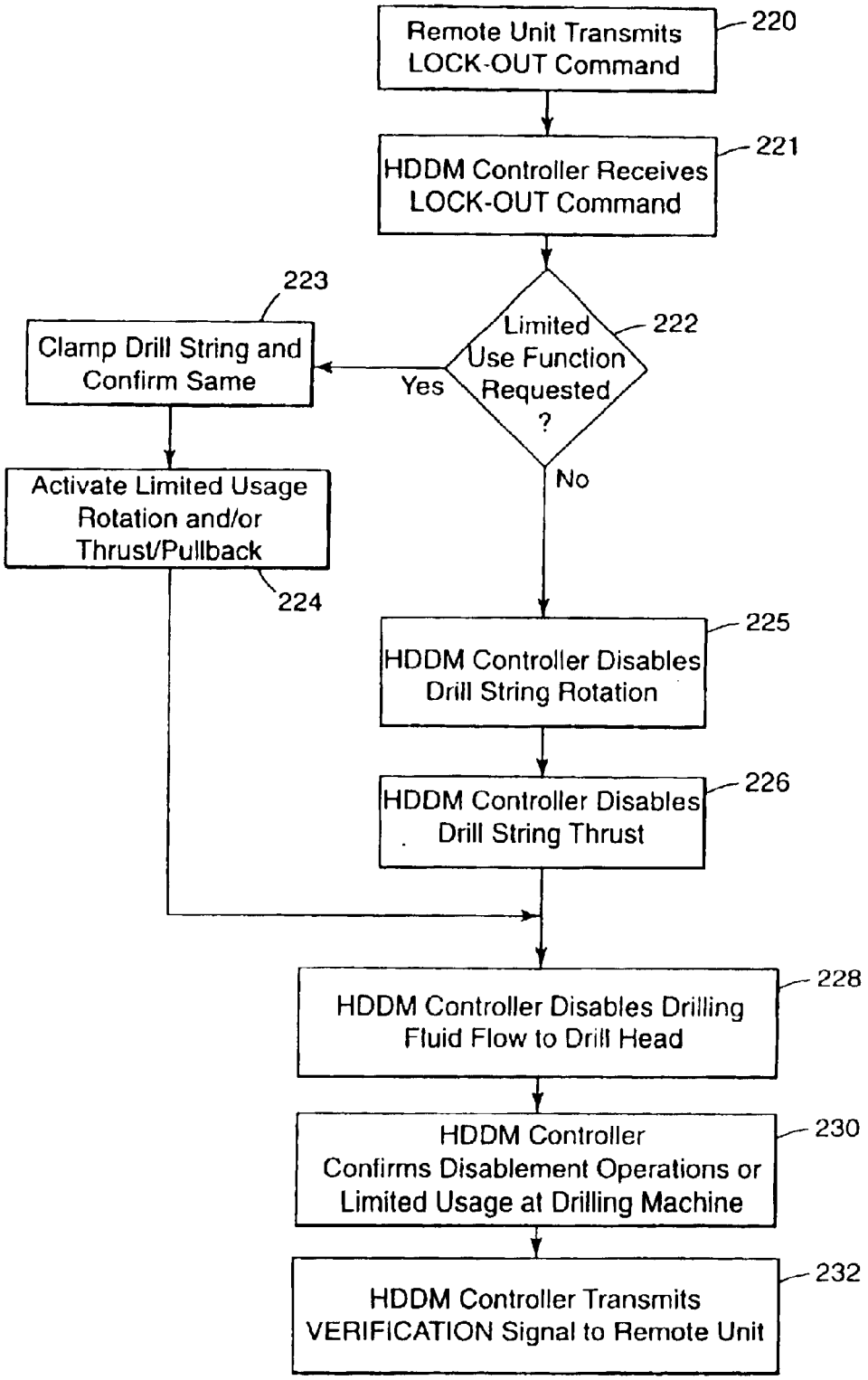
FIG. 6 is a flow diagram that illustrates various steps of a remote LOCK-OUT methodology implemented by a controller of an HDD machine in accordance with an embodiment of the present invention.

FIG. 6 is a flow diagram that illustrates various steps of a remote LOCK-OUT methodology implemented by a controller of an HDD machine in accordance with an embodiment of the present invention. According to this embodiment, a limited set of drilling machine functions may be made available as part of the LOCK-OUT procedure. The LOCK-OUT sequence, as discussed above, is initiated by the remote unit transmitting 220 a LOCK-OUT command to the HDD machine. The HDDM controller receives 221 the LOCK-OUT command and, in response, performs a number of operations to prevent all drill string/cutting head or reamer movement and, if requested, allows for limited usage of the driving apparatus.

If limited usage of the driving apparatus is requested 222 by the machine operator, then the drill string is clamped 223 to prevent all downhole drill string movement. Confirmation 223 of drill string immobilization received from a sensor at the clamping mechanism is required before limited usage of the driving apparatus is permitted. After receiving a confirmation signal from the clamp mechanism sensor, the HDDM controller provides 224 for limited usage of the rotation and thrust/pullback facilities of the drilling machine to perform certain desired tasks, such as rod manipulation. If limited usage of the driving apparatus is not requested 222, the HDDM controller disables drill string rotation 225 and also disables 226 drill string displacement or thrust.

The HDDM controller further disables 228 drilling fluid flow into the borehole, such as drilling fluid supplied to the cutting head via the drill string. This operation is of particular importance in applications where a high-pressure fluid dispensing capability at the cutting head is utilized. For example, fluid pressures on the order of 1,200 psi (pounds per square inch) at the fluid dispensing nozzle at the cutting head are common. Further, many available fluid dispensing units pump fluid through the drill string/cutting head at 200 gallons per minute. Those skilled in the art readily appreciate the importance of terminating the delivery of fluid to the cutting head as part of a comprehensive and effective LOCK-OUT methodology.

The HDDM controller confirms 230 that all drilling operations have been successfully disabled, such as drill string rotation, displacement, and fluid delivery to the cutting head, and, if applicable, that a limited usage mode of operation has been enabled (e.g., rod manipulation mode is enabled). The HDDM controller then transmits 232 a VERIFICATION signal to the remote unit.

Figure 7:
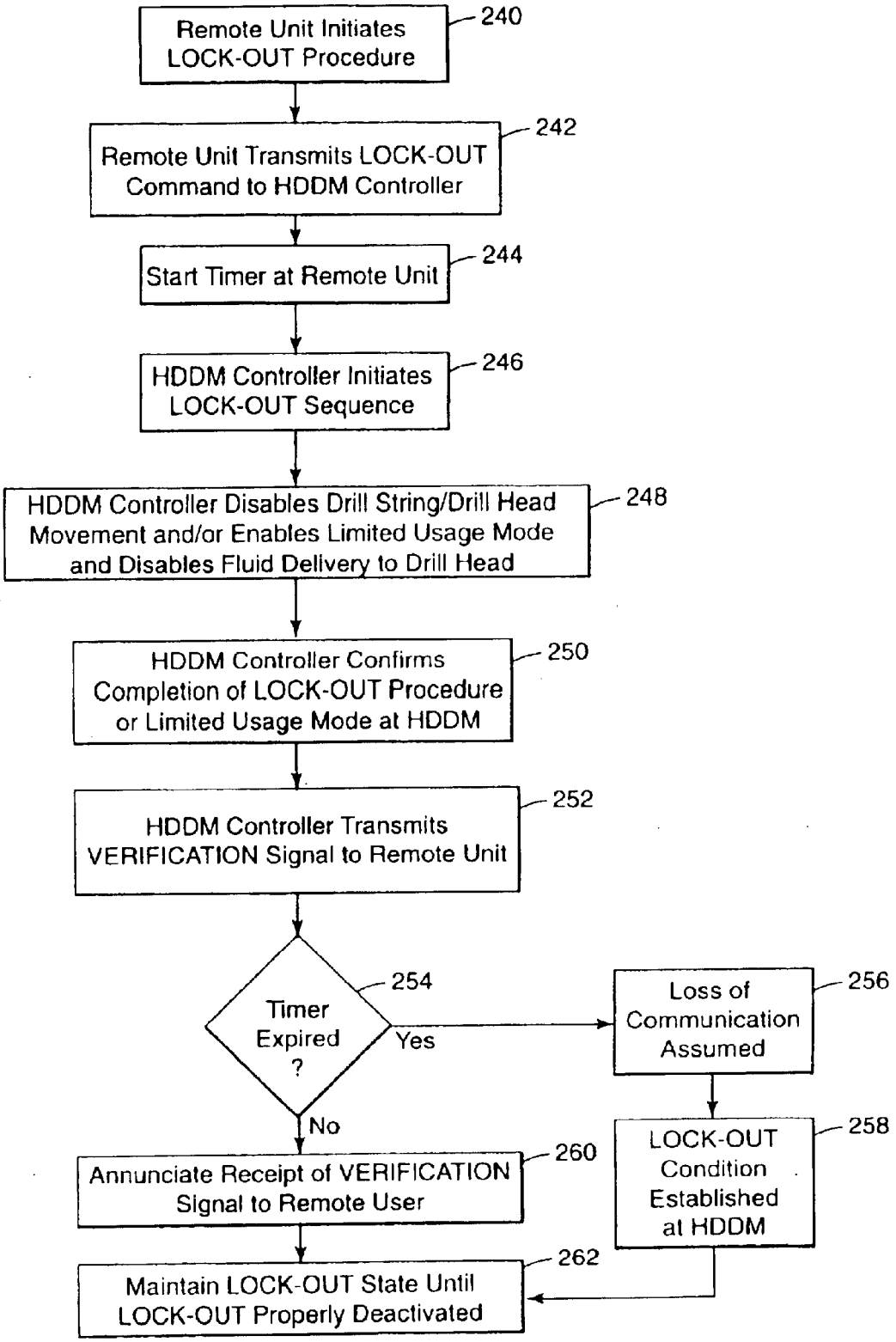
FIG. 7 is a flow diagram that illustrates various steps associated with cooperative operation between a remote unit and an HDD machine controller when implementing a remote LOCK-OUT methodology in accordance with another embodiment of the present invention.

FIG. 7 is a flow diagram that illustrates various steps associated with cooperative operation between a remote unit and an HDD machine controller when implementing a remote LOCK-OUT methodology in accordance with another embodiment of the present invention. According to this embodiment, the remote user initiates 240 the LOCK-OUT procedure using the remote unit, and, in response, the remote unit transmits 242 a LOCK-OUT command to the HDDM controller. A timer is started 244 at the remote unit upon transmitting 242 the LOCK-OUT signal to the HDDM controller. The timer is used to determine whether or not the LOCK-OUT procedure has been successfully completed with a predetermined time period, such as three seconds for example.

The HDDM controller initiates 246 the LOCK-OUT sequence in response to receipt of the LOCK-OUT command and performs the necessary operations to disable 248 drill string/cutting head movement and fluid delivery to the cutting head and, if applicable, enables limited usage of the rotation and/or thrust/pullback facilities of the drilling machine. The HDDM controller confirms 250 completion of the LOCK-OUT procedure or activation of a limited usage mode at the HDD machine and transmits 252 a VERIFICATION signal to the remote unit.

If the timer at the remote unit has not expired 254 when the VERIFICATION signal is received by the remote unit, successful receipt of the VERIFICATION signal is annunciated 260 to the remote user. The LOCK-OUT state is maintained 262 until the LOCK-OUT condition is properly deactivated.

If the timer at the remote unit has expired 254 when the VERIFICATION signal is received by the remote unit or if no VERIFICATION signal is received at all, a loss of communication between the remote unit and the HDD machine is assumed 256 and a LOCK-OUT condition is established 258 at the HDD machine. The LOCK-OUT state is maintained 262 at the HDD machine until the LOCK-OUT condition is properly deactivated.

Figure 8:
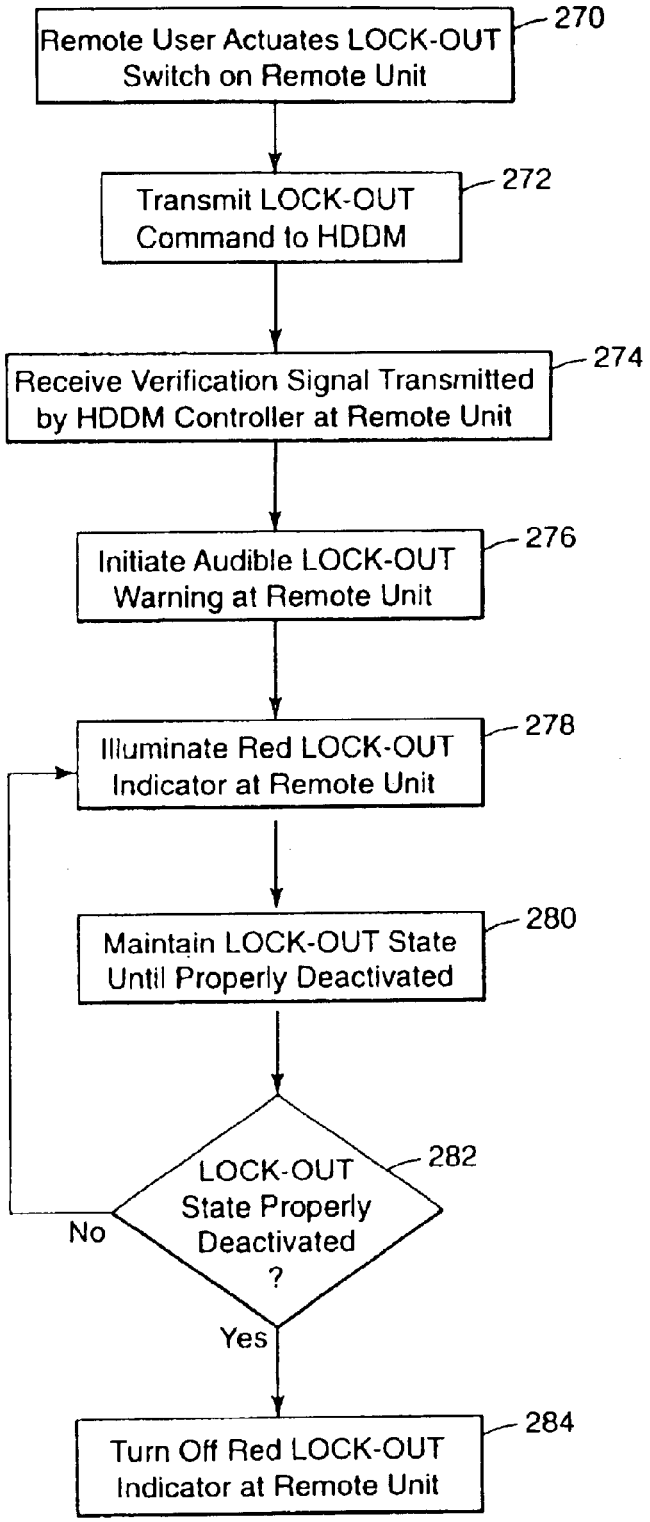
FIG. 8 is a flow diagram that illustrates various other steps of a remote LOCK-OUT methodology implemented by a remote unit in accordance with an embodiment of the present invention.

FIG. 8 is a flow diagram that illustrates various other steps of a remote LOCK-OUT methodology implemented by a remote unit in accordance with another embodiment of the present invention. According to this embodiment, the remote user actuates a LOCK-OUT switch on the remote unit 270 to initiate the LOCK-OUT sequence. The LOCK-OUT command is transmitted 272 by the remote unit. After the HDD machine successfully completes the LOCK-OUT sequence, the HDDM controller transmits a VERIFICATION signal which is received 274 by the remote unit. In response to receiving the VERIFICATION signal, the remote unit initiates 276 an audible LOCK-OUT response, such as a series of short beeps or a verbal LOCK-OUT message, for example.

A red LOCK-OUT indicator is also illuminated 278 on the remote unit as an indication to the remote user that the HDD machine is operating in a LOCK-OUT mode. Assuming that the remote user wishes to discontinue the LOCK-OUT condition, and properly deactivates 282 the LOCK-OUT mode in cooperation with the HDD machine operator, the red LOCK-OUT indicator is extinguished 284 on the remote unit and any audible LOCK-OUT warning broadcast by the remote unit is terminated. If the LOCK-OUT state is not properly deactivated, illumination of the red LOCK-OUT indicator is continued 278 at the remote unit and the LOCK-OUT state at the HDD machine is maintained 280. The audible LOCK-OUT warning may also be re-broadcast to the remote user.

Figure 9:
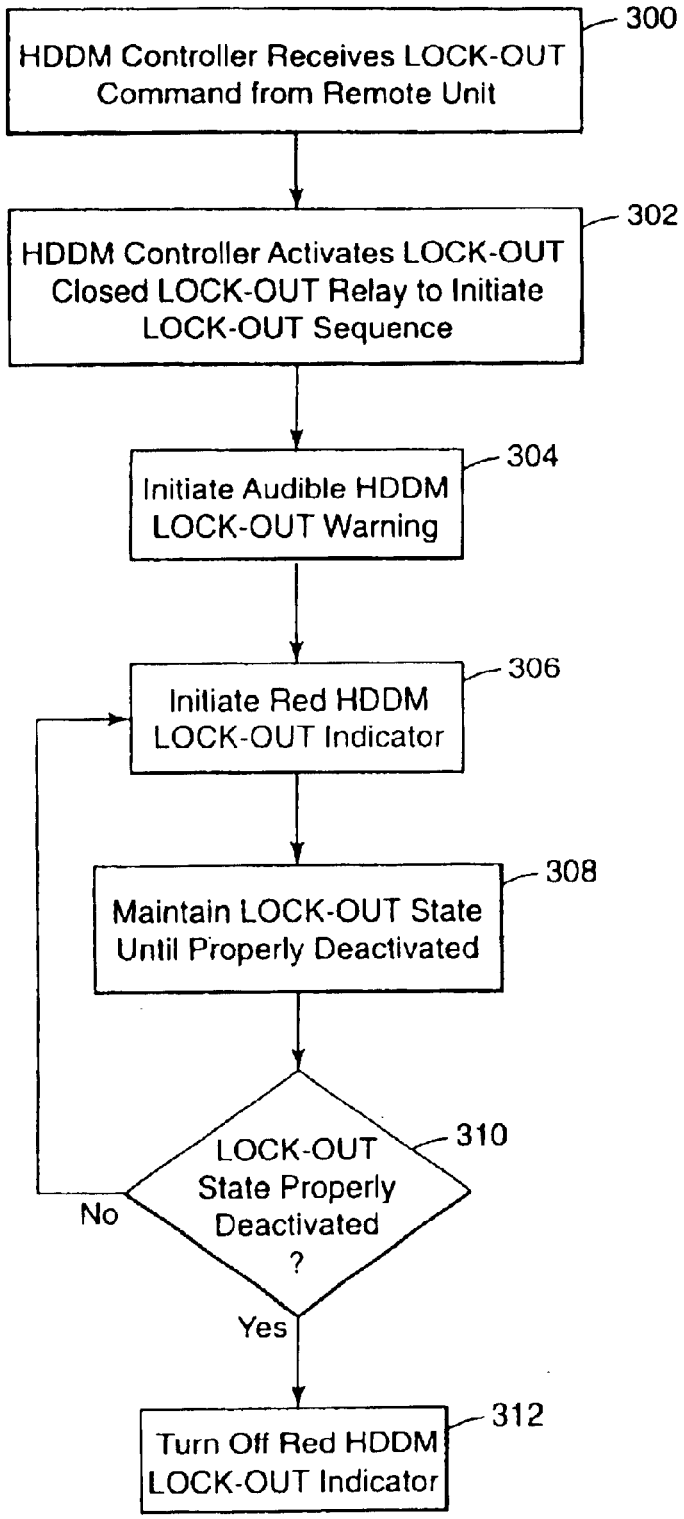
FIG. 9 is a flow diagram that illustrates various other steps of a remote LOCK-OUT methodology implemented by a controller of an HDD machine in accordance with an embodiment of the present invention.

FIG. 9 is a flow diagram that illustrates various other steps of a remote LOCK-OUT methodology implemented by a controller of an HDD machine in accordance with another embodiment of the present invention. According to the embodiment of FIG. 9, the HDDM controller receives 300 a LOCK-OUT command from the remote unit and, in response, activates a normally closed LOCK-OUT output to initiate the LOCK-OUT sequence 302. In its non-activated or normal state, the LOCK-OUT output remains deactivated, thereby assuring that a LOCK-OUT condition is maintained at the HDD machine should a power failure or LOCK-OUT sequence execution error occur at the HDD machine. To deactivate the LOCK-OUT state at the HDD machine, each of the steps constituting the LOCK-OUT sequence must be successfully implemented and verified as being successfully completed.

In response to the HDDM controller initiating the LOCK-OUT sequence 302, an audible LOCK-OUT warning is broadcast 304 at the HDD machine to alert the HDD machine operator that the HDD machine is operating in the LOCK-OUT mode. The audible warning may comprise, for example, three short beeps (e.g., 0.5 seconds ON and 0.5 seconds OFF) followed by a one second pause. This sequence of audible beeps may be repeated multiple times, such as three times. A red indicator at the HDD machine is also illuminated 306. The LOCK-OUT state is maintained 308 and the red indicator remains illuminated on the HDD machine until the LOCK-OUT mode is properly deactivated. When the LOCK-OUT state is properly deactivated 310, the red LOCK-OUT indicator on the HDD machine is extinguished 312 and any audible LOCK-OUT warning is terminated.

Figure 10:
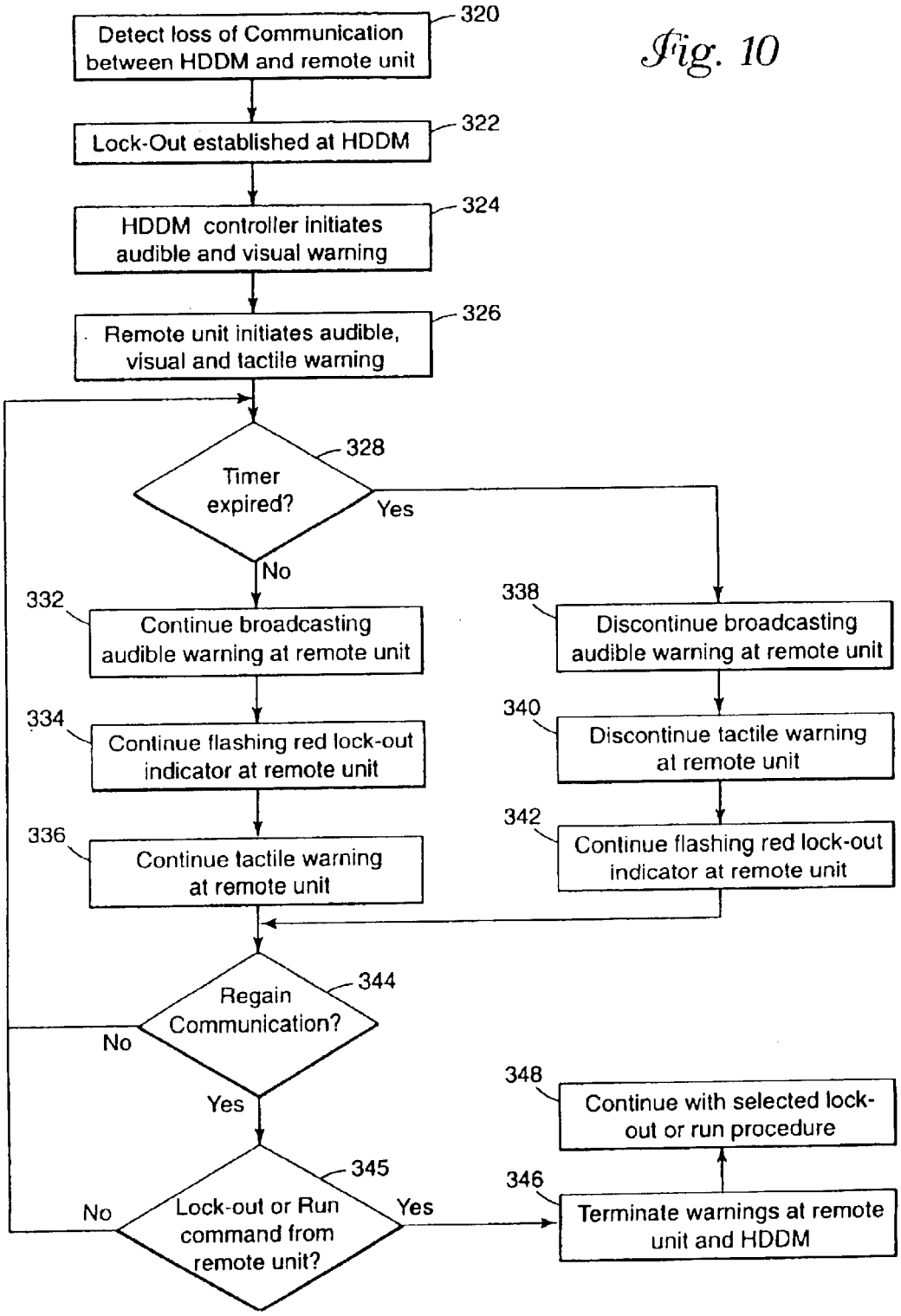
FIG. 10 is a flow diagram that illustrates various steps associated with cooperative operation between a remote unit and an HDD machine controller in response to a loss of communication connectivity therebetween in accordance with an embodiment of the present invention.

FIG. 10 is a flow diagram that illustrates various steps associated with cooperative operation between a remote unit and an HDD machine controller in response to a loss of communication connectivity between the remote unit and HDD machine in accordance with an embodiment of the present invention. A loss of communication connectivity is detected 320 between the remote unit and HDD machine. A loss of communication condition may arise in several contexts, such by receipt of an HDD machine signal of unacceptable strength or by the expiration of a countdown or countup timer at the remote unit as previously discussed, for example.

Various other signaling schemes known in the art may be employed to detect the occurrence of a loss of communication condition arising between the remote unit and the HDD machine. For example, a handshaking or polling signaling scheme may be employed by which signals are transmitted between the remote unit and the HDD machine on a periodic basis. The strength or quality of a received signal may be analyzed. For example, the remote unit may evaluate the SNR of a polling signal transmitted by the HDD machine and determine if the SNR of the received signal is adequate.

If a loss of communication connectivity between the remote unit and HDD machine is detected 320, the HDDM controller initiates 322 the LOCK-OUT sequence to transition the HDD machine to a LOCK-OUT mode of operation. A timer is activated upon detection of the loss communication connectivity between the remote unit and the HDD machine. It is noted that the engine of the HDD machine remains operating during and after establishing a LOCK-OUT condition at the HDD machine. The HDDM controller initiates 324 an audible and/or visual warning indicative of the loss of communication condition.

If the timer has not yet expired 328, the remote unit continues broadcasting 332 an audible warning and continues flashing 334 a red LOCK-OUT indicator at the remote unit. The remote unit continues providing 336 a tactile warning 326 to alert the remote user to the loss of communication condition. The audible and tactile warnings may, for example, comprise a continuous tone or vibration that continues for one minute or until other events discussed below occur. When the timer expires 328, broadcasting of the audible warning is discontinued 338. Provision of the tactile warning is also discontinued 340 upon expiration of the timer. The red LOCK-OUT indicator, however, remains flashing 342 at the remote unit to alert the operator as to the continuance of the LOCK-OUT mode of operation during the loss of communication condition.

The above-described warning sequence is repeated until communication connectivity is regained 344 between the remote unit and the HDD machine or until a LOCK-OUT or RUN command transmitted by the remote unit is received 345 and successfully processed by the HDD machine. Upon the occurrence of either of these events 344, 345, the audible, visual, and/or tactile warnings are terminated 346 at the remote unit and at the HDD machine, and the selected LOCK-OUT or RUN procedure is continued.

Figure 11:
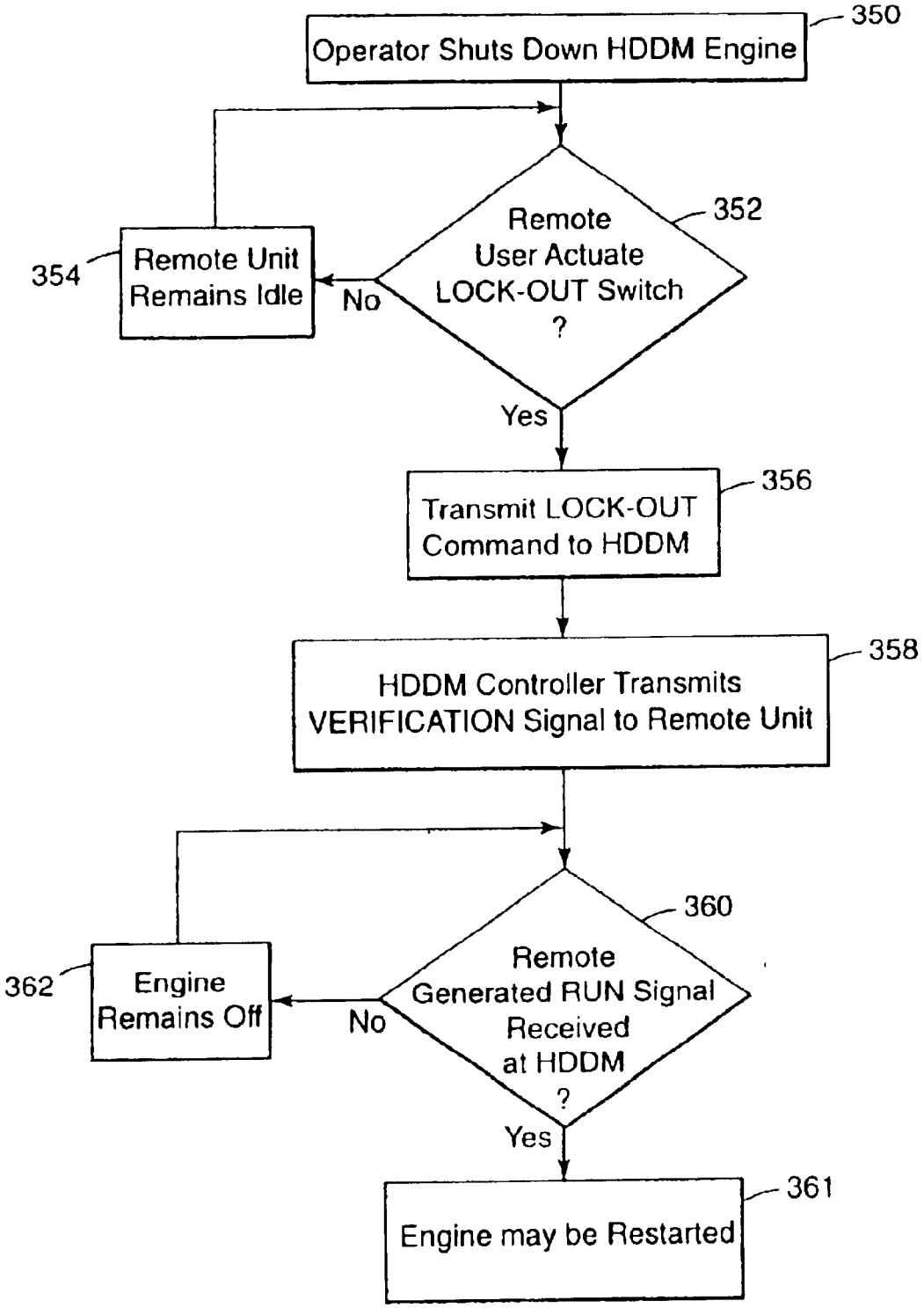
FIG. 11 is a flow diagram that illustrates various steps associated with cooperative operation between a remote unit and an HDD machine controller in response to an HDD machine engine shut-down condition in accordance with an embodiment of the present invention.

FIG. 11 is a flow diagram that illustrates various steps associated with cooperative operation between a remote unit and an HDD machine controller in response to an HDD machine engine shut-down condition in accordance with an embodiment of the present invention. According to this embodiment, it is assumed that the engine of the HDD machine is shut down 350 by the operator or by some other process. It is further assumed that all movement of the drill string/cutting head or reamer ceases soon after the engine of the HDD machine shuts down. The remote unit remains idle 354 until such time as the remote user attempts to actuate the LOCK-OUT control.

When the remote user actuates the LOCK-OUT control 352 during the time in which the HDD machine engine is shut down, the remote unit transmits 356 a LOCK-OUT command to the HDD machine. The HDDM controller transmits 358 a VERIFICATION signal to the remote unit indicating that a LOCK-OUT condition is maintained at the HDD machine, as is the case when the engine is shut down. The operator of the HDD machine will not be able to start the HDD machine engine 362 until the remote operator depresses the RUN control on the remote unit. If 360 the RUN signal is received by the HDD machine, the engine may be re-started 361 by the HDD machine operator.

Figure 12:
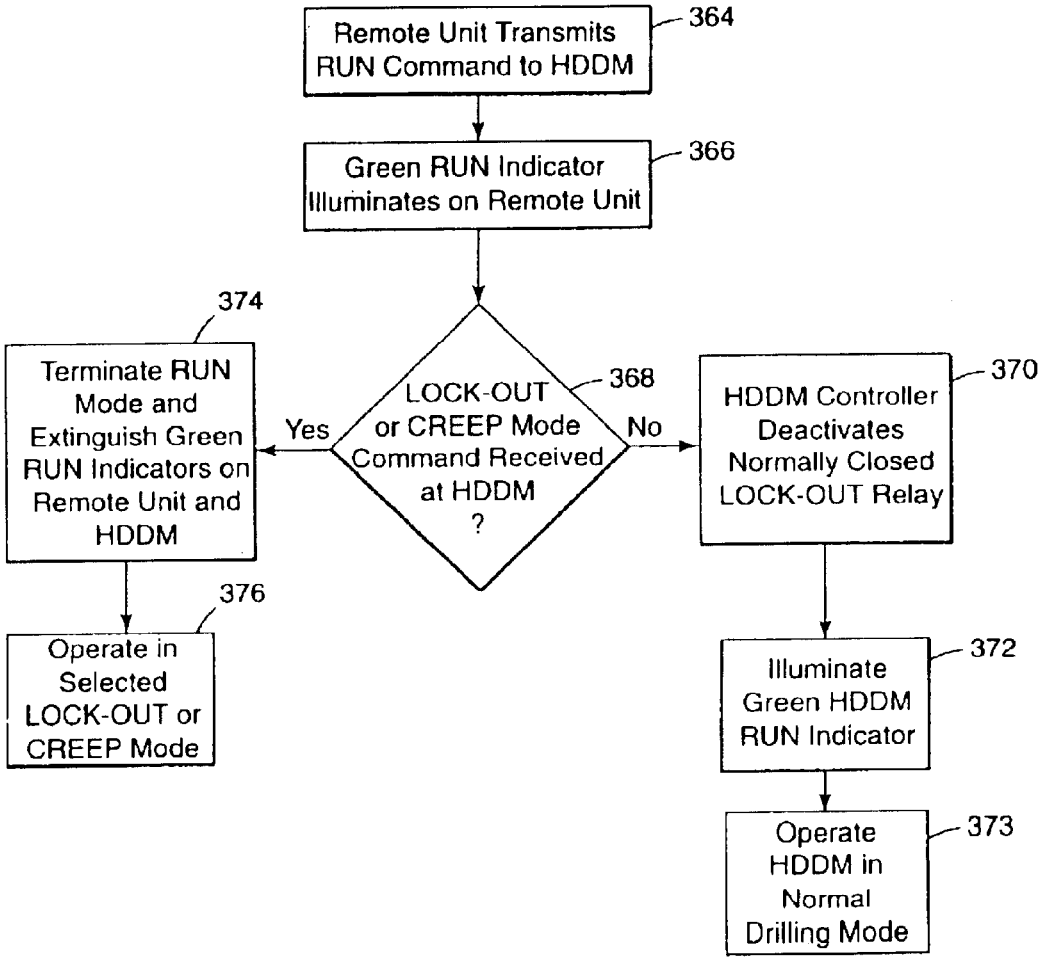
FIG. 12 is a flow diagram that illustrates various steps associated with cooperative operation between a remote unit and an HDD machine controller when operating in a RUN mode according to an embodiment of the present invention.

FIG. 12 is a flow diagram that illustrates various steps associated with cooperative operation between a remote unit and an HDD machine controller when operating in a RUN mode according to an embodiment of the present invention. The remote unit transmits 364 a RUN command to the HDD machine in response to user actuation of the RUN control at the remote unit. A green RUN indicator is illuminated 366 on the remote unit. The green RUN indicator will remain illuminated until such time as the remote user actuates either the LOCK-OUT control or the CREEP control. If 368 a LOCK-OUT or CREEP mode signal is not received at the HDD machine, the HDDM controller deactivates 370 the normally closed LOCK-OUT output and illuminates 372 the green HDD machine RUN indicator. The HDD machine may then be operated 373 in a normal drilling mode.

If 368 a LOCK-OUT or CREEP mode signal is received at the HDD machine, the HDDM controller terminates 374 the RUN mode and extinguishes the green HDD machine RUN indicator. The HDD machine operates 376 in the selected LOCK-OUT or CREEP mode.

Figure 13:
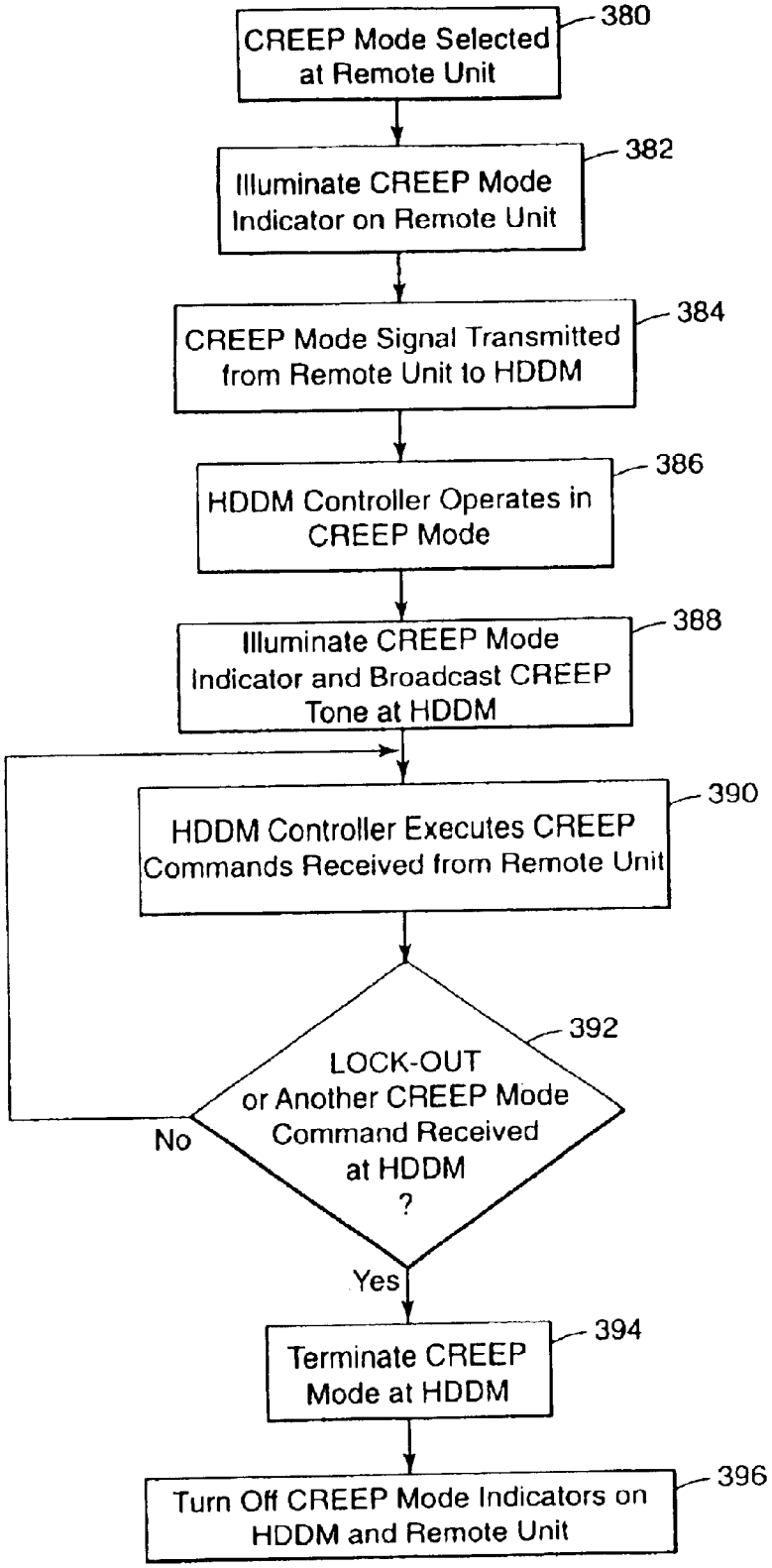
FIG. 13 is a flow diagram that illustrates various steps associated with cooperative operation between a remote unit and an HDD machine controller when operating in a CREEP mode according to an embodiment of the present invention.

FIG. 13 is a flow diagram that illustrates various steps associated with cooperative operation between a remote unit and an HDD machine controller when operating in a CREEP mode according to an embodiment of the present invention. A remote user initiates the CREEP mode of operation by actuating 380 the CREEP control on the remote unit. The CREEP mode indicator illuminates 382 on the remote unit and a CREEP mode signal is transmitted 384 from the remote unit to the HDD machine.

Upon receipt of the CREEP mode signal, the HDD machine 386 transitions to operation in the CREEP mode. A CREEP mode indicator is illuminated 388 on the HDD machine and an audible CREEP tone is broadcast. The CREEP tone may comprise a tone that is repeated every other second while the CREEP mode is active. The HDDM controller executes 390 CREEP commands received from the remote unit until such time as a LOCK-OUT signal or another CREEP mode signal is received at the HDD machine. If 392 either a LOCK-OUT signal or a subsequent CREEP mode signal is received at the HDD machine, the CREEP mode of operation is terminated 394 at the HDD machine, and the CREEP mode indicators/tones are extinguished 396 on the HDD machine and the remote unit.

FIGS. 14–17 are flow diagrams that illustrates various steps associated with cooperative operation between a remote unit and an HDD machine controller when operating in various remote operating and steering modes which may be selected 400 by user actuation of an appropriate control provided on the remote unit. The remote operating/steering modes depicted in FIGS. 14–17 include a ROTATE, PUSH, PULLBACK, and clock-based steering mode, respectively.

Figure 14:
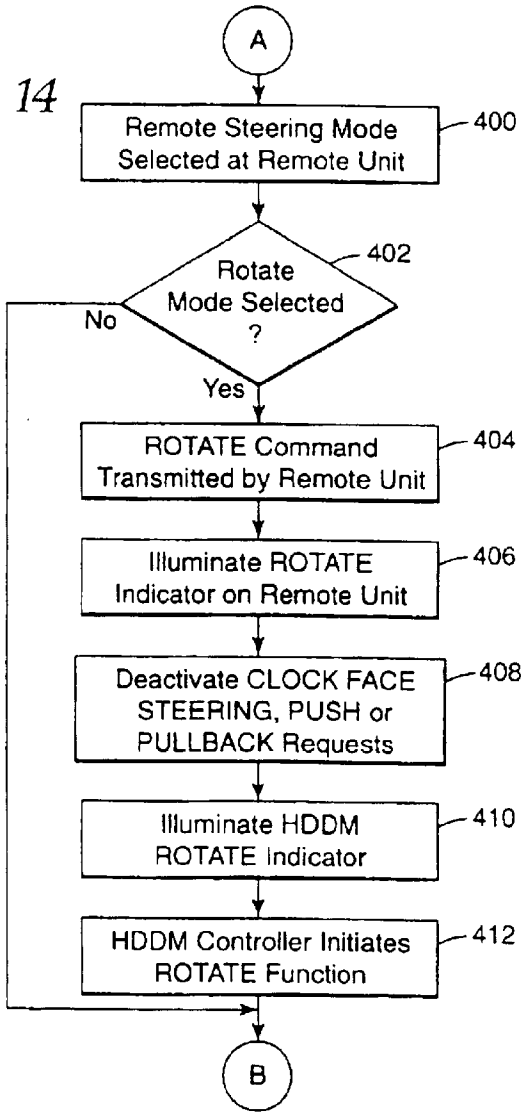
FIG. 14 is a flow diagram that illustrates various steps associated with cooperative operation between a remote unit and an HDD machine controller when operating in a ROTATE mode according to an embodiment of the present invention.
Figure 17:
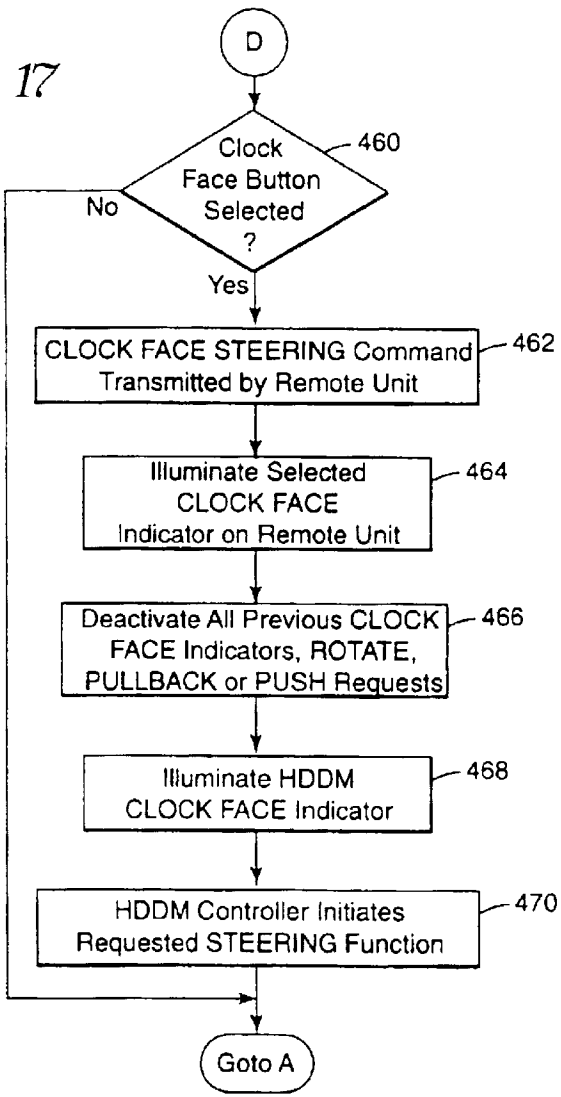
FIG. 17 is a flow diagram that illustrates various steps associated with cooperative operation between a remote unit and an HDD machine controller when implementing remote steering operations according to an embodiment of the present invention.

As is depicted in FIG. 14, if 402 the ROTATE mode is selected by the remote user, a ROTATE command is transmitted 404 by the remote unit. A ROTATE indicator is illuminated 406 on the remote unit, and subsequent CLOCK FACE STEERING, PUSH or PULLBACK requests are deactivated 408 while operating in the ROTATE mode. A ROTATE indicator is also illuminated 410 on the HDD machine.

The HDDM controller initiates 410 the ROTATE function, which may be accomplished through manual intervention or automatically. In one embodiment, as previously discussed, an RS-232 or other suitable communications interface may be provided between the HDDM controller and a display provided on the HDD machine. A ROTATE command received from the remote unit may result in the presentation of the ROTATE request on the display. The HDD machine operator may then manually initiate and control the ROTATE function. Alternatively, the ROTATE command received from the remote unit may be operated upon directly by the HDDM controller to automatically initiate the requested ROTATE function.

Figure 15:
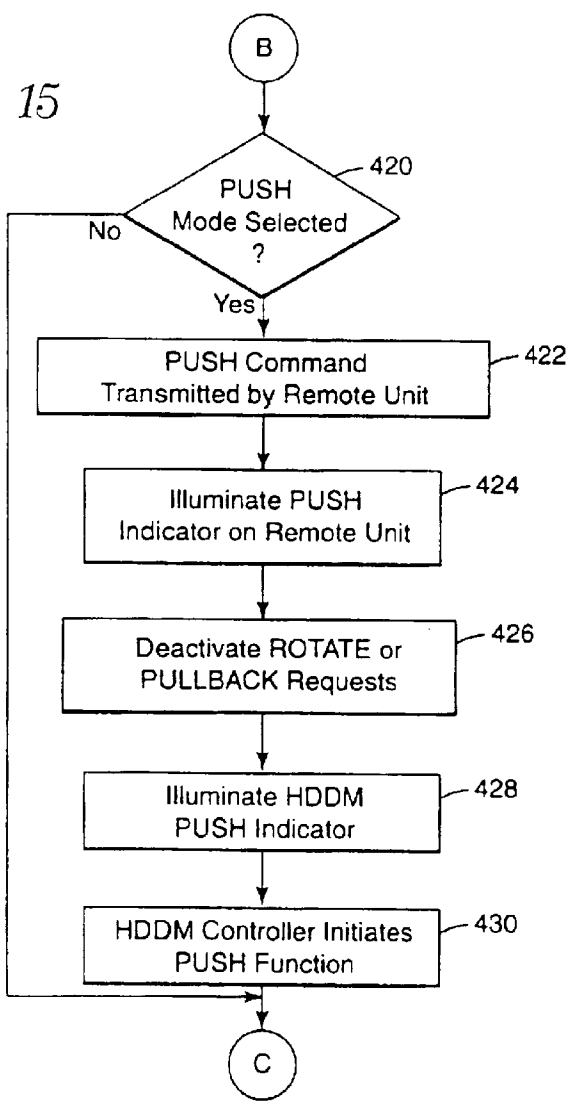
FIG. 15 is a flow diagram that illustrates various steps associated with cooperative operation between a remote unit and an HDD machine controller when operating in a PUSH mode according to an embodiment of the present invention.

In accordance with FIG. 15, if 420 the PUSH mode is selected by the remote user, a PUSH command is transmitted 422 by the remote unit. A PUSH indicator is illuminated 424 on the remote unit, and subsequent ROTATE or PULLBACK requests are deactivated 426 while operating in the PUSH mode. A PUSH indicator is illuminated 428 on the HDD machine.

The HDDM controller initiates 430 the PUSH function, which may be accomplished through manual intervention or automatically. A PUSH command received from the remote unit may result in the presentation of the PUSH request on the display of the HDD machine. The HDD machine operator may then manually initiate and control the PUSH function. Alternatively, the PUSH command received from the remote unit may be operated upon directly by the HDDM controller to automatically initiate the requested PUSH function.

Figure 16:
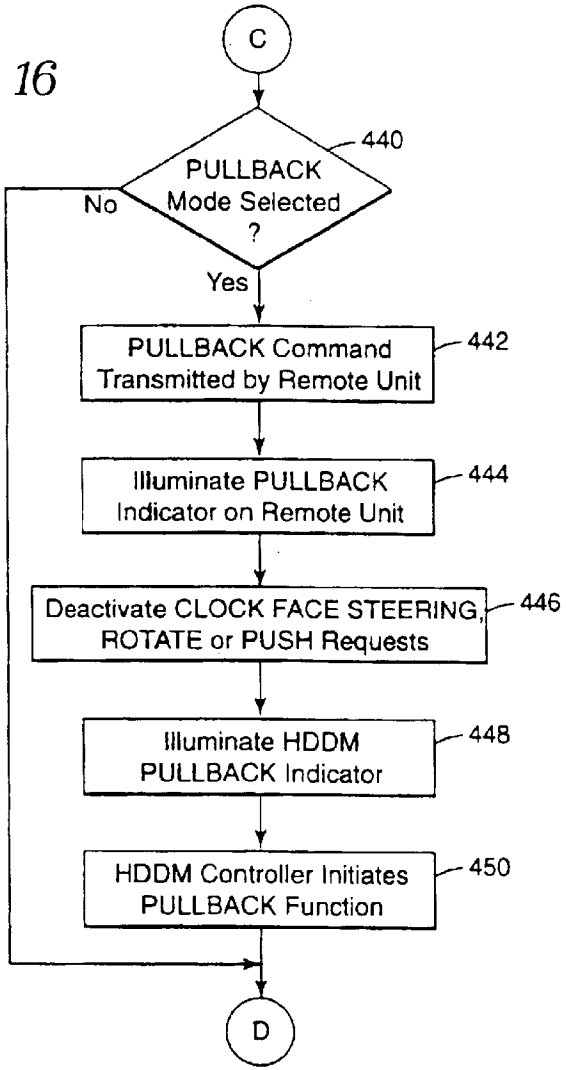
FIG. 16 is a flow diagram that illustrates various steps associated with cooperative operation between a remote unit and an HDD machine controller when operating in a PULL-BACK mode according to an embodiment of the present invention.

If 440 the PULLBACK mode is selected by the remote user, as is depicted in FIG. 16, a PULLBACK command is transmitted 442 by the remote unit. A PULLBACK indicator is illuminated 444 on the remote unit, and subsequent CLOCK FACE STEERING, ROTATE or PUSH requests are deactivated 446 while operating in a PULLBACK mode. A PULLBACK indicator is illuminated 448 on the HDD machine.

The HDDM controller initiates 450 the PULLBACK function, which may be accomplished through manual intervention or automatically. A PULLBACK command received from the remote unit may result in the presentation of the PULLBACK request on the display of the HDD machine. The HDD machine operator may then manually initiate and control the PULLBACK function. Alternatively, the PULLBACK command received from the remote unit may be operated upon directly by the HDDM controller to automatically initiate the requested PULLBACK function.

The remote user may issue clock face-based steering commands using, for example, the steering control 132 depicted in FIG. 4. If 460 the remote user depresses a selected clock face steering button on the remote unit, a CLOCK FACE STEERING command corresponding to the selected clock face "time" is transmitted 462 by the remote unit. The steering button selected by the remote user is illuminated 464 and all previously selected clock face buttons, if applicable, and any subsequent ROTATE, PULLBACK or PUSH requests are deactivated 466 while operating in the clock-based steering mode. A clock face indicator corresponding to that selected by the remote user is illuminated on the HDD machine. The HDD clock face indicator may, for example, constitute a clock face time location highlighted on a clock face graphically presented on the display of the HDD machine.

The HDDM controller initiates 470 the requested STEERING function, which may be accomplished through manual intervention or automatically. A STEERING command received from the remote unit may result in the presentation of the STEERING request on the display of the HDD machine. The HDD machine operator may then manually initiate and control the STEERING function. Alternatively, the STEERING command received from the remote unit may be operated upon directly by the HDDM controller to automatically initiate the requested STEERING function.

In general, a remote unit suitable for use in implementing a LOCK-OUT methodology of the present invention should be capable of transmitting and receiving signals to and from the HDD machine at locations below ground level (e.g., locations not in line-of-sight with the HDD machine). For example, the remote unit should by capable of maintaining communication connectivity with the HDD machine from the bottom of an 8 foot deep pit. Depending on a number of factors, it may be desirable to employ a repeater at ground level proximate the pit to enhance communication between the remote unit and HDD machine for relatively long bore lengths. The transmit range should be on the order of several thousand feet, which may be extended through use of one or more repeaters. As previously discussed, the remote unit should include lost or weak signal detection circuitry with an audible, visual, and/or tactile warning capability.

The remote unit may include circuitry that provides for external radio interference rejection and a capability to change frequencies in accordance with the appropriate waveband for the country or locale of use. Each remote unit preferably has a unique code so that each machine may be controlled by only one remote.

The remote unit is preferably configured for portability and durability, and is preferably wearable and capable of being operated with the use of only one hand. The rechargeable batteries provided in the remote unit are preferably field removable in a manner that does not require the use of tools.

The HDDM controller at the HDD machine may also include circuitry that provides for external radio interference rejection and a capability to change frequencies in accordance with the appropriate waveband for the country or locale of use. The HDDM controller should also include lost or weak signal detection circuitry with an audible, visual, and/or tactile warning capability. The transmit range of the HDD machine transceiver should be on the order of several thousand feet, which may be extended through use of one or more repeaters.

The HDD machine preferably includes an integrated battery charger for charging the batteries of a remote unit and may include a 12/24 Vdc input and self wiping contacts. The battery charger, which is coupled to the HDDM controller, is preferably capable of identifying a remote unit that is not properly programmed to communicate with the transceiver of the particular HDD machine and providing a warning in such a case. The HDDM controller is preferably capable of addressing the HDD machine transceiver with its own unique identification code.

According to one embodiment, the HDD machine includes mode annunciators of varying colors, such as red, yellow, and green indicators, which are easily visible in bright sunlight. A display provided on the HDD machine should similarly be readily visible in bright sunlight.

As previously discussed, a normally closed relay is employed at the HDD machine to activate and de-activate the LOCK-OUT sequence. In one embodiment, a 12 Vdc input signal is generated upon successful completion of the LOCK-OUT sequence. A normally open relay is preferably employed to activate and de-activate the previously described CREEP mode sequence.

A manual reset mechanism is provided at the HDD machine for purposes of resetting the LOCK-OUT state that has been established at the HDD machine resulting from a loss of communication connectivity between the remote unit and the HDD machine. The manual reset procedure requires the HDD machine operator to turn off the HDDM controller and use a reset tool to reset the HDDM controller for continued operation. The HDD machine operator does not have the ability to independently reset a LOCK-OUT condition initiated by the remote user, as was discussed previously.

An RS-232 or other suitable communications interface is preferably provided at the HDD machine to provide for the communication of data to and from a customer provided interface. All LOCK-OUT functions are preferably accessible via the RS-232 port.

In accordance with a particular embodiment of the present invention, a remote LOCK-OUT methodology of the present invention provides for initially transmitting a LOCK-OUT signal from a remote unit, receiving the LOCK-OUT signal at the drilling machine, and implementing machine controls necessary to LOCK-OUT movement of the drill string and fluid flow within the drill string. Additional processes performed include monitoring machine functions to verify a successful LOCK-OUT, transmitting from the drilling machine a verification signal that a successful LOCK-OUT has been achieved, receiving the verification signal at the remote unit, and actuating an operator indicator to communicate that a successful LOCK-OUT of the HDD machine has been achieved. If a verification signal is not received within several (e.g., 5) seconds of initially transmitting the LOCK-OUT signal, then a warning is communicated to the operator that the LOCK-OUT was not successful, such warning including flashing lights, and energizing a horn and vibrator, for example. Further processes provide for continuously monitoring for communication between the remote unit and the machine controller, and locking out the drilling machine whenever there is no communication.

Given the above-described methodology, it has been found that a key to operator acceptance of this methodology is the prevention of situations which result in unwanted LOCK-OUTs from occurring. For example, unwanted LOCK-OUTs occur when there is unexpected loss of communication between the remote unit and the drilling machine, such as when the remote operator enters a field of corn plants which blocks the signal or otherwise significantly disrupts signal communications.

According the another embodiment which is directed to addressing unwanted LOCK-OUTs from occurring, the present invention provides for improved operational characteristics of the overall system so that the operator is not subjected to such unwanted (i.e., unnecessary) LOCK-OUTs. In accordance with this embodiment, there is a provision of a guarantee that movement of the drill string is interrupted only at the appropriate time, when a LOCK-OUT condition has been requested. There is a provision for operation of the drilling machine in situations where the remote unit is out of range of communication, so that unwanted LOCK-OUTs are avoided in a way that maintains a reasonable level of safety.

There is a provision for warning the operator of the remote unit if a requested LOCK-OUT was not successful, for warning the operator of the remote unit if communications with the drilling machine have been interrupted, and for warning the operator of the drilling machine if the communications with the remote unit have been interrupted. There is a further provision for continuously monitoring the status of a LOCK-OUT state and providing for additional actions to ensure that the LOCK-OUT state is maintained. Some or all of these provisions can be incorporated into control modules/units which are capable of being installed on a variety of drive systems.

Figure 18:
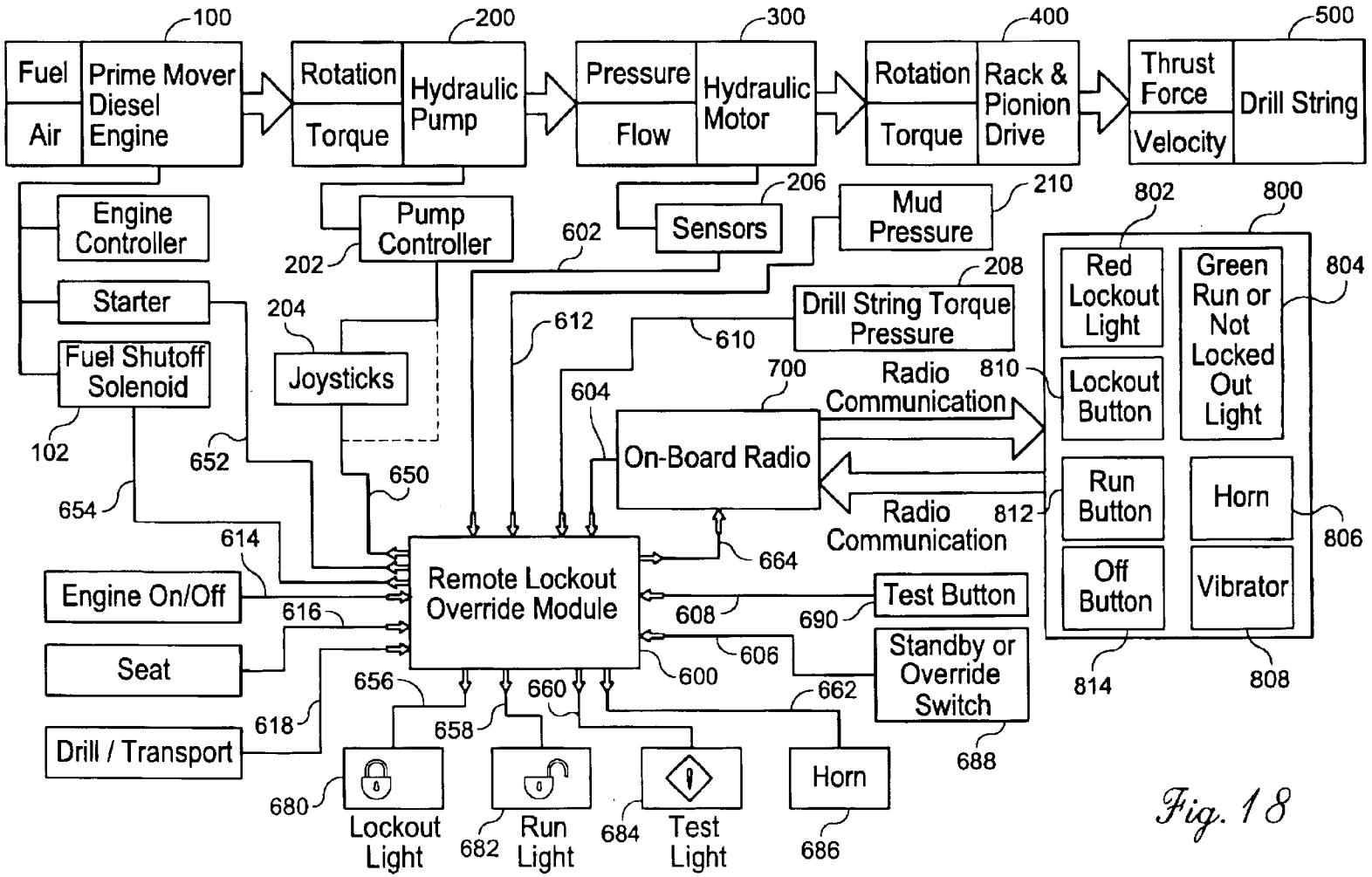
FIG. 18 is a schematic representation of the various components of a drilling machine involved in development of thrust force delivered to the drill string, such components including a drilling machine control system, remote LOCK-OUT machine controller, and a remote LOCK-OUT controller.

FIG. 18 illustrates various components of a drilling machine involved in development of a thrust force, which represents a potential hazard, to the drill string, and various components of a control system which is implicated in this illustrative embodiment of the present invention. The various elements of the drilling machine include a prime mover 100, which is typically a diesel engine. The prime mover 100 consumes fuel and air to generate rotation and torque to power a hydraulic pump 200. The hydraulic pump 200 converts rotation and torque into pressure and flow that allow the energy to be transmitted through hydraulic lines and to a hydraulic motor 300 in a manner that is very convenient for the mechanical requirements of the drilling machine. The hydraulic motor 300 converts the pressure and flow back into rotation and torque to power a pinion gear part of a rack and pinion assembly 400 that generates thrust force which is applied to the drill string 500. Many other configurations of mechanical elements can be utilized to provide this basic functionality. For example, a hydraulic cylinder can be utilized rather than a hydraulic motor, rack and pinion gear. The present invention is applicable to all such configurations.

Drill string rotation and the generation of fluid flow at the termination end of the drill string 500 are also potentially hazardous. A configuration in which a mud motor may be installed on the end of the drill string 500 results in an additional potential hazard, as mud motors are components that convert fluid power of the drilling mud into rotational power to the drill bit. In addition, the drilling fluids are typically pumped out of an orifice in the drilling bit, at relatively high velocity. The fluids could be an injection hazard, capable of being injected into the operator's skin.

System block diagrams similar to that of FIG. 18 can be developed for systems that provide rotational power to the drill string and fluid power for the drilling fluid that is transferred inside the drill string. Such other systems are not described herein, as the basic control functions related to those systems are essentially the same as those described herein.

FIG. 18 includes references to two unique inputs to a remote LOCK-OUT override module 600 that are associated with torque and mud systems: a torque pressure sensor 208, which generates a pressure signal 610, and mud pressure sensor 210, which generates a mud pressure signal 612. Transducers other than pressure sensors can be used. The transducers are used to produce an output which is directly and reliably an indication of transfer of power. For purposes of the instant embodiment, pressure sensors will be discussed, it being understood that the invention is not limited to same.

A variety of prime movers 100 can be utilized, including a gasoline engine, an electric motor, and the like. In the instant embodiment of a diesel engine, there are a couple of unique factors to consider. First, modern diesel engines typically are shut off with a valve that stops the flow of fuel to the engine. This valve is controlled by what is commonly known as the fuel shutoff solenoid 102. When a sufficient supply voltage, such as 12 Volts, is supplied to the fuel shutoff solenoid 102, fuel is allowed to flow to the engine. With 0 volts supplied, no fuel will flow and the engine will shutoff if running or will not start.

Second, it is not uncommon for modern diesel engines to include a turbo charger. Turbochargers include a component that is turning at a high speed, and thus requires very good lubrication that is typically supplied by an oil pump. If an engine is shutoff abruptly while being operated at relatively high speed, the turbocharger can continue turning while the lubricating oil is shutoff. As a result, the turbocharger can be damaged. Thus, it may not be acceptable to shutoff a diesel engine abruptly.

The hydraulic pump 200 represents a primary control component. The hydraulic pump 200 accepts power from the prime mover 100 in the form of rotation and torque. Typically, the rotational speed remains basically constant while the torque varies to meet the demand defined by the hydraulic pump 200. Engines are typically designed to operate in this manner, providing a relatively constant rotational speed while varying torque to match the loading requirements. If a different prime mover 100 were utilized, a different control structure may be appropriate. However, for the instant embodiment, the control structure assumes the diesel engine 100 is capable of self-regulation to provide this capability. Thus, the hydraulic pump 200 is controlled by a pump controller 202, which can be implemented in a variety of configurations as are known in the art.

Input from an operator is provided via some form of input device, typically in the form of a joystick 204. In some cases, the joystick 204 provides an electrical signal to the pump controller 202. In other cases, the joystick 204 provides a hydraulic pilot signal to the pump controller 202. In still other cases, the joystick 204 provides an actual mechanical movement to the pump controller 202.

All control system configurations are preferably implemented to allow an operator to control pressure and flow output from the hydraulic pump 200 in some way, which are sensed by a sensor 206, preferably a pressure sensor. As previously noted, the hydraulic fluid pressure and flow is transferred through hydraulic lines from the pump 200 to a motor 300 where it is converted to rotation and torque to the rack and pinion 400 and then into thrust force and travel of the drill string 500. In this manner, the pressure measured by the sensor 206 is an indication of the power being transferred to the drill string 500.

As is further shown in FIG. 18, the remote LOCK-OUT override module 600 includes a number of inputs. Such inputs include:

1) Signal 602 received from thrust pressure sensor 206.

2) Signal 610 received from torque pressure sensor 208.

3) Signal 612 received from mud pressure sensor 210.

4) Signal 608 received from a test button 690.

5) Signal 604 received from the an on-board radio 700 which is in constant communication with the remote LOCK-OUT controller 800.

6) Signal 606 received from an override switch 688.

7) An engine on/off input 614, which could be a voltage associated with an alternator, a speed pickup sensing the speed of the flywheel, or a pressure sensor sensing the lubricating oil pressure.

8) A seat switch 616.

9) A transport/drive switch 618.

Output signals from the remote LOCK-OUT override module 600 include:

1) Hydraulic Enable 650.

2) Starter Relay Enable 652.

3) Engine Enable 654, typically communicated to a fuel shutoff solenoid 102.

4) Lockout indicator drive signal 656.

5) Run indicator drive signal 658.

6) Test indicator drive signal 660.

7) Horn drive signal 662.

8) Signal 664 to the on-board radio 700.

The hydraulic enable 650 is designed to provide the capability to integrate with a wide variety of control systems. For systems where the output from the joysticks 204 is a voltage or amperage to the pump controller 202, this output can simply be an additional input to the pump controller 202. The pump controller 202 simply needs to be configured to recognize that when the hydraulic enable 650 is energized, the pump 200 can be activated, and, if it is not energized, then the pump 200 cannot be activated.

For other systems, the hydraulic enable 650 can supply a voltage to the joysticks 204. Here again, if the hydraulic enable 650 is de-energized, then the joysticks 204 would be forced to provide 0 volts or amps to the pump controller 202, and the pump 200 should not be capable of being activated.

For yet other systems, wherein there is a direct mechanical linkage between the joystick 204 and the pump controller 202, it may be necessary to install a solenoid activated hydraulic dump valve between the pump 200 and the motor 300. In this case, the hydraulic enable 650 would control the dump valve, such that any hydraulic pressure and flow generated by the pump 200, as controlled by the mechanical linkage, would be dumped to a tank, or otherwise diverted to prevent transmission of power, when the hydraulic enable 650 was de-energized.

In all configurations, it is possible to develop a system wherein the power transfer systems are disabled when the hydraulic enable 650 is de-energized, and enabled when energized. This applies to all three systems: thrust, torque and drilling fluid systems.

Starter relay enable 652 is configured to cooperate with the normal starting circuit in such a way that it is capable of preventing the starter from turning over the engine 100 when this output is de-energized. The engine enable 654 is typically configured to connect to the fuel shutoff solenoid 102, such that the fuel is shutoff, and thus the engine 100 shut off, whenever the engine enable 654 is de-energized.

Figure 19:
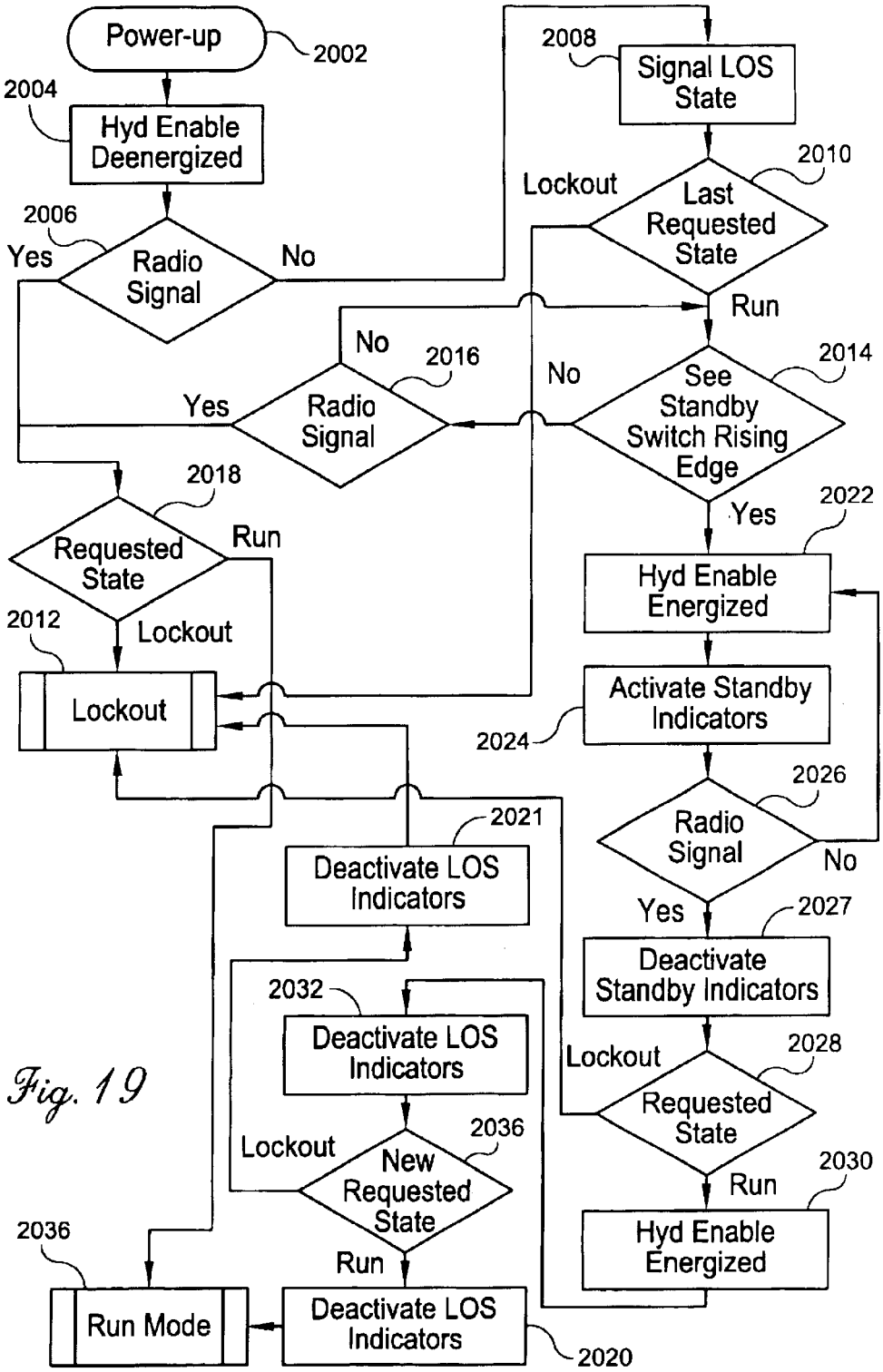
FIG. 19 is a flow chart of power-up logic implemented by a remote LOCK-OUT override module of the present invention.

FIG. 19 illustrates power-up logic implemented by a remote LOCK-OUT override module in accordance with an embodiment of the present invention. With reference to FIG. 19 and FIG. 18 as described above, the system is powered-up 2002 when the drilling machine is turned on using the machine's normal key switch. Upon initial power-up, the hydraulic enable 650 is de-energized 2004, ensuring that the drill string 500 will not move and no mud will be pumped through the drill string 500. At block 2006, input 604 from the on-board radio 700 is checked. If there is no radio communication with the remote LOCK-OUT controller 800, a Loss of Signal State is signaled at block 2008, such as by flashing both the LOCK-OUT light 680 and the run light 682.

At block 2010, the last requested state is checked. This is accomplished by providing a register in an EEPROM or equivalent non-volatile memory where the last requested state from the remote LOCK-OUT controller 800 is stored. If this last request state was Lockout, then the system immediately goes to block 2012 of initiating a LOCK-OUT, using a process that will be described below with reference to FIG. 22. If the last requested state was a run state, the system goes to block 2014.

At block 2014, the system pauses while waiting for the operator to activate the standby switch 688. The standby switch 688 includes a position wherein the signal 606 can only be provided when the switch 688 is rotated, thus, requiring the operator to intentionally rotate the switch 688. If the switch 688 is broken or has been modified to stay in the standby position, the rising edge of the signal 606 will not be detected and the system will not progress beyond this stage.

If the operator does not wish to progress into a standby state, the system will pause, waiting for a radio signal at block 2016. If the radio signal is detected, the system progresses to block 2018. This same process block will be encountered after block 2006 if the radio signal is present at power-up. Block 2018 results in implementation of the mode that is requested by the remote LOCK-OUT controller 800 at the time the radio signal is first received.

If the radio signal is not present and the operator decides to enter the standby state at block 2014, the switch 688 has been activated and the hydraulic enable 650 is energized at block 2022. At the same time, an indication that the standby state has been entered is activated at block 2024, such as by flashing both the LOCK-OUT light 680 and the run light 682.

The system continuously checks for the radio signal at block 2026. If the radio signal is received at block 2026, the standby indicators are deactivated at block 2027 and the requested state provided by the remote LOCK-OUT controller 800 is checked at block 2028. If a LOCK-OUT state is detected, then the system immediately initiates a LOCK-OUT at block 2012. If a run state is detected, the system continues to energize the LOCK-OUT hydraulics at block 2030 and to indicate a loss of signal state at block 2032. This condition remains until a new state is requested by the remote LOCK-OUT controller 800. This new state is either a run state, where the loss of signal indicators are deactivated at block step 2020 and the fully enabled run state is initiated at block 2036 using a process to be described with reference to FIG. 20, or a LOCK-OUT state, where the loss of signal indicators are deactivated at step 2021 and a LOCK-OUT is initiated at step 2012.

Figure 20:
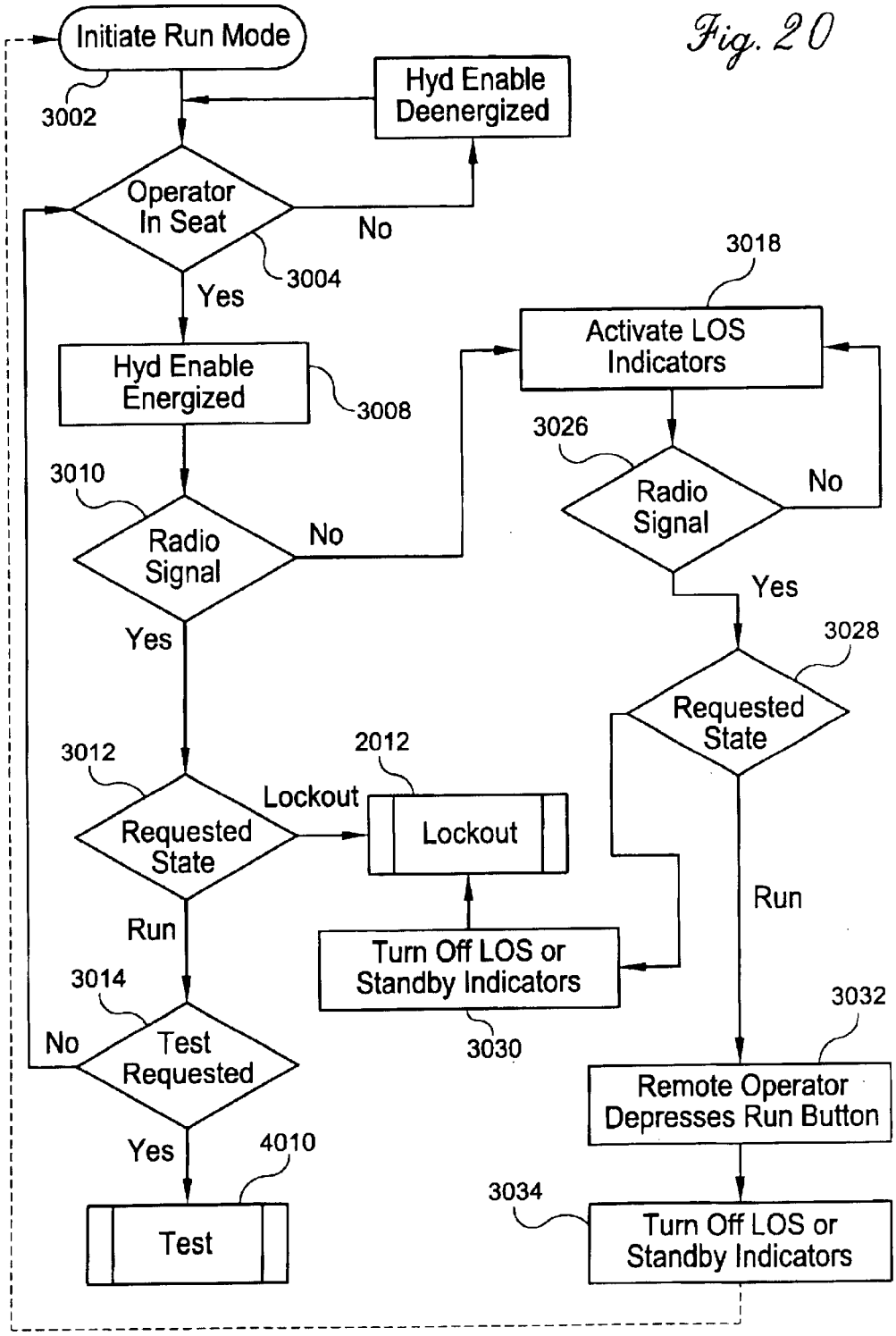
FIG. 20 is a flow chart of run logic implemented by a remote LOCK-OUT override module of the present invention.

FIG. 20 Illustrates a fully enabled run mode of the remote LOCK-OUT override module 800 in accordance with an embodiment of the present invention. As seen in FIG. 19, this mode can be entered in three ways. First, the run mode can be entered when radio communications are present at power-up, after the run command is issued from the remote LOCK-OUT controller 800. Second, the run mode can be entered when radio communications are not present at power-up, from an override mode that had been manually entered only if the last requested state was run and only after seeing a newly requested run command. Lastly, the run mode can be entered when radio communications are not present at power-up, after the radio communication is established.

The run mode is initiated at block 3002. Block 3004 illustrates verification that the operator is in the seat. This step actually overrides all functions, and would stop functions of the drill at any point. If the operator is in the seat, then the hydraulic enable 650 is energized at block 3008. At block 3010, the radio signal is constantly checked. If it is present, the requested status is checked at block 3012. If a LOCK-OUT state is requested, a LOCK-OUT is immediately initiated at block 2012, as will be more fully described with reference to FIG. 22. If run was requested, a test may be requested at block 3014 and implemented at block 4010. If the test mode is not requested at block 3014, then the run mode is maintained If the radio signal is lost at block 3010, the system transitions by indicating a Loss of Signal at block 3018. The system will not change state until the radio signal is again established at block 3026. The requested state is checked at block 3028. If a LOCK-OUT is requested, then the Loss of Signal indicators are turned off at block 3030 and a LOCK-OUT is immediately initiated at block 2012. If not, the Loss of Signal indicator is left on until a new state is requested at block 3032 when the operator at the remote unit depresses the run switch to change the requested state. The Loss of Signal Indicator is turned off at block 3034 and the run mode is again entered at block 3002.

Figure 21:
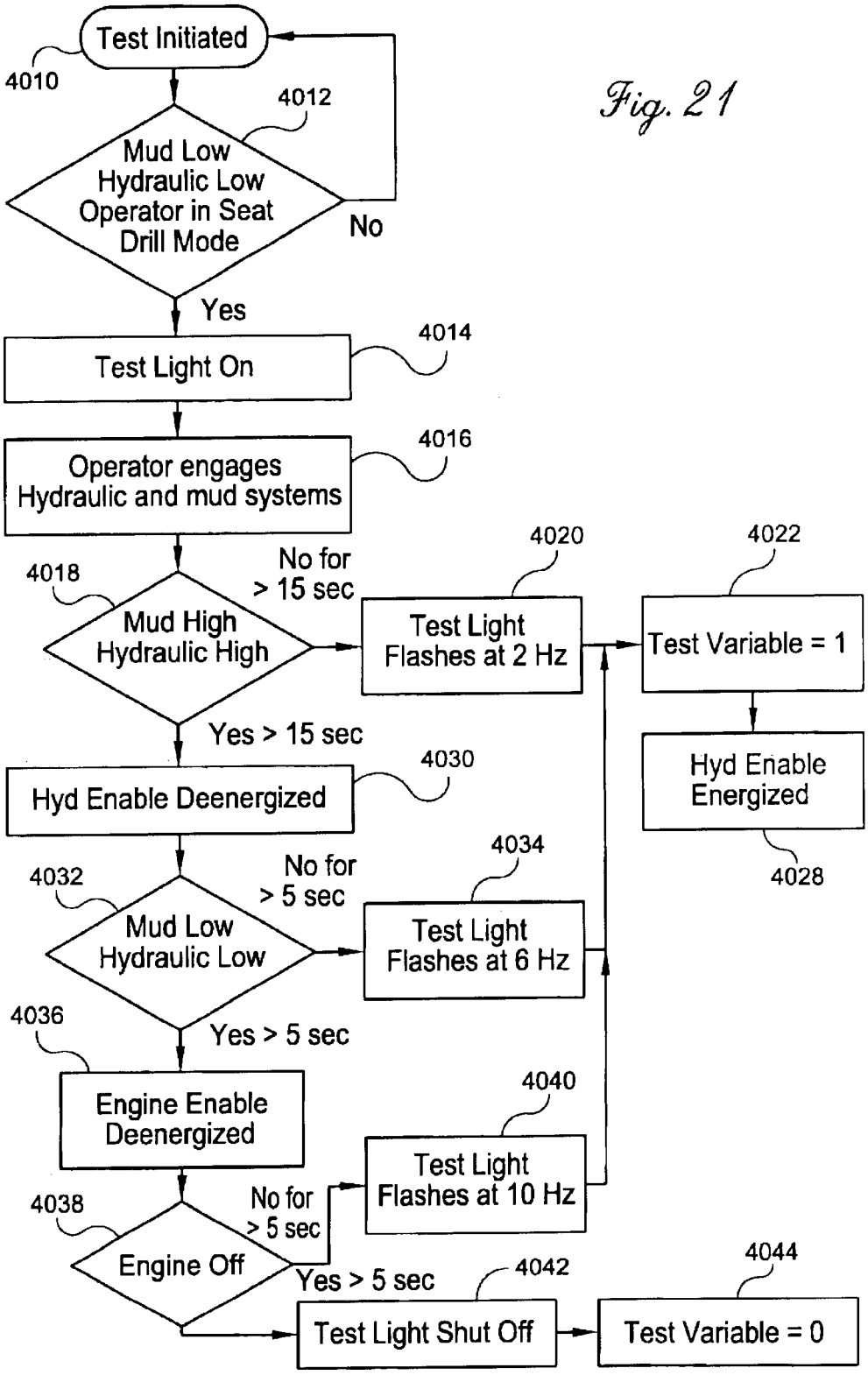
FIG. 21 is a flow chart of test logic implemented by a remote LOCK-OUT override module of the present invention.

FIG. 21 illustrates the remote LOCK-OUT override module's test logic in accordance with an embodiment of the present invention. The test mode is entered at block 4010 when the operator depresses the test button 690. The system notifies the operator that the test mode has been properly entered only after the confirming that the hydraulic pressures 602 and 610 and mud pressure 612 are all low, the operator is in the seat, and the machine is set in the drill mode at block 4012. Once confirmed, the test light 684 illuminates at block 4014. The operator must then turn on the pressures within a predetermined time, such as 15 seconds, by activating the joysticks 204 for example, at block 4016.

At block 4018, the system checks the integrity of the switches used for detecting high pressure. If a high pressure is not detected within the predetermined time (e.g., 15 seconds), the test light 684 flashes continuously at 2 Hz at block 4020, the test variable is set to one at block 4022, and the hydraulic enable 650 is energized at block 4028 to enable the test to be re-run. If a high pressure is detected at block 4018, the system de-energizes the hydraulic enable 650 at block 4030. De-energizing the hydraulic enable 650 should result in the rapid decay of pressures 602, 610, and 612.

The ability of the pressure switches to properly detect a low pressure is thus tested at block 4032. If the pressure readings are substantially low, approximately zero, by or before 5 seconds have elapsed, for example, then the pressure switches have passed the test. If the pressures are not low within 5 seconds, then the switches are assumed defective or operating anomalously, and, at block 4034, the test light 684 is set to continuously flash at 6 Hz, and the test variable is set to one at block 4022. If the pressure switches have tested properly at block 4032, then the system progresses to block 4036 where engine enable is de-energized to test the shutoff system.

The engine enable 654 is tested at block 4038. If the engine does not shut off, the test light 684 is set to flash continuously at 10 Hz at block 4040. The test variable is set to one at block 4022. If the engine enable 654 works properly and the engine shuts down, the test light 684 is shutoff at block 4042 and the test variable is set to zero at block 4044. At this point, the machine will be shut down, and restarting will bring the system back to the power-up point in the control logic flow. This description is one of several possible ways this system can be implemented. Additional parameters can be included in a similar test procedure, such as to test the fluid control system, for example.

Figure 22:
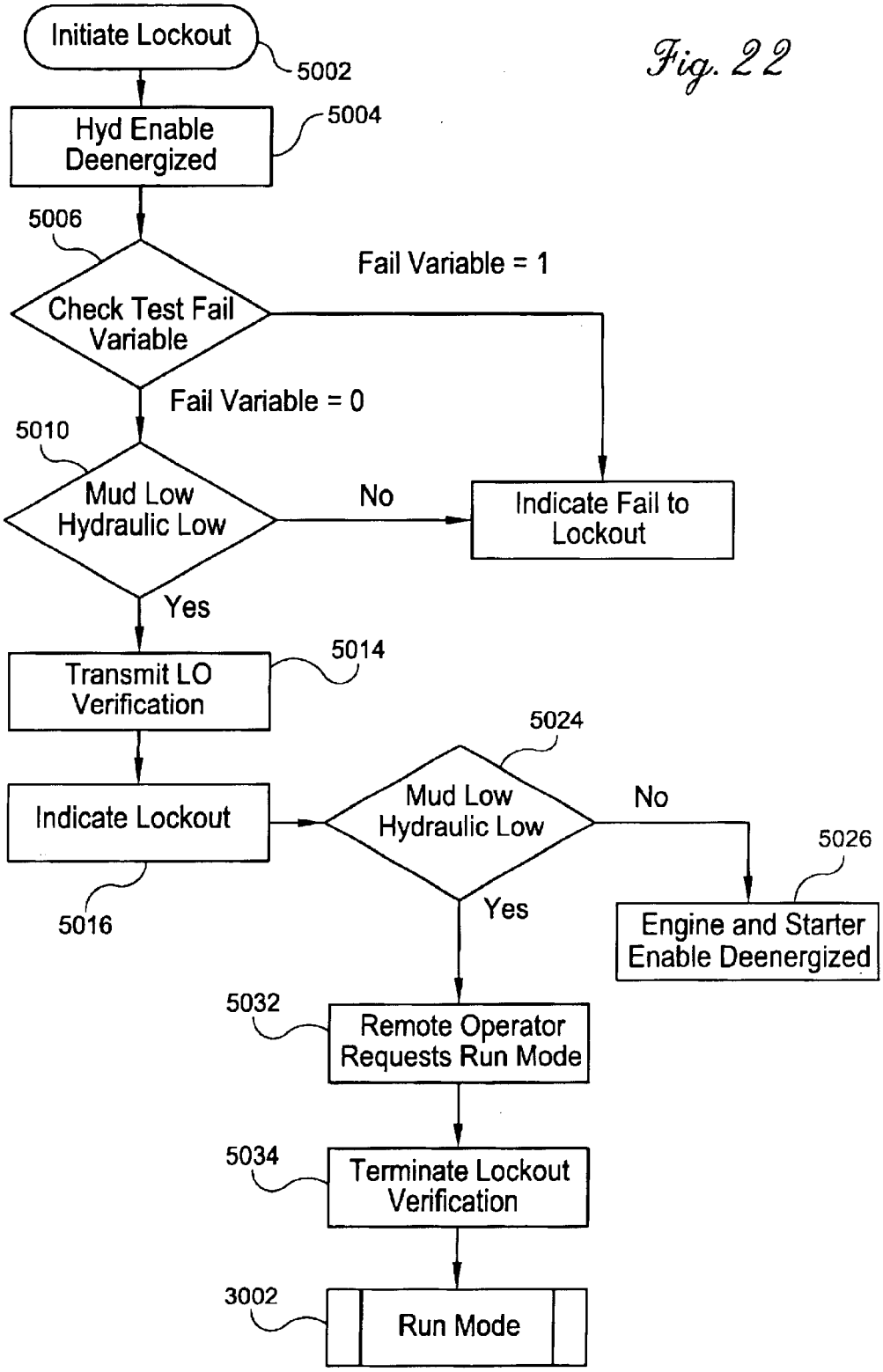
FIG. 22 is a flow chart of LOCK-OUT logic implemented by a remote LOCK-OUT override module of the present invention.

FIG. 22 illustrates LOCK-OUT logic of the remote LOCK-OUT override module 600 in accordance with an embodiment of the present invention. This logic initiates at block 5002 when a LOCK-OUT command is received from the remote LOCK-OUT controller 800. The hydraulic enable 650 is immediately de-energized at block 5004. The test variable is then checked at block 5006 to determine whether the inputs from the pressure sensors 206, 208, and 210 can be relied upon. If the test variable is 1, then a previous test determined that the sensors were unreliable and a verification signal will not be transmitted. In this case, the operator at the remote LOCK-OUT controller 800 will not receive a LOCK-OUT signal.

If the test variable is zero, then the previous test has indicated that the pressure sensors 206, 208, and 210 can be relied upon. The system will then check that the pressure inputs 602, 610 and 612 from pressure sensors 206, 208 and 210 are low, essentially zero, at block 5010. If these pressure inputs do not indicate low, a verification signal will not be transmitted. The operator at the remote LOCK-OUT controller 800 will not receive a LOCK-OUT signal in this case.

If the pressures inputs are low, the system will immediately transmit a LOCK-OUT verification at block 5014. A LOCK-OUT status will be indicated at the drilling machine by illuminating the LOCK-OUT light 680 at block 5016. At this point, the system will monitor for the radio signal. If present, no changes in operation are made. If the radio signal is lost, the LOCK-OUT condition and indication is maintained until the radio signal is reestablished.

At block 5016, after indicating the LOCK-OUT condition, the system monitors the pressure inputs 602, 610 and 612 for a high condition at block 5024 at the same time it is monitoring the radio signal. If at any time the hydraulic or mud pressures are not low, it is assumed that the LOCK-OUT condition is not being maintained. This could occur, for example, if there was a failure of a hydraulic component, or if there was a failure of one of the pressure sensors 202, 210, 208.

At block 5026, the engine enable 654 and starter enable 652 are de-energized, which will result in the engine being shut down. As previously noted, the characteristics of a diesel engine may prohibit the frequent utilization of this mode of shut down. However, with this secondary monitoring function, the engine shut down can be implemented if needed, even if it has undesirable side effects. The first level shut down, which is the hydraulic system, can be utilized as the primary shutdown mechanism. Other power transmission systems may have similar characteristics, where there are primary, secondary, tertiary, etc. shutdown systems or mechanisms. The outputs indicating power transmission can be monitored and the systems shut down in sequence as needed.

If, at block 5024, the pressures remain low, the system maintains the LOCK-OUT state. This is independent of the radio signal. At this point, if the radio signal is lost, no changes are made until the radio signal is again received. At that point, block 5032, a run state is requested, the LOCK-OUT verification signal is terminated at block 5034, and the system enters the run mode again at block 3002.

Referring once again to the system block diagram of FIG. 18, the drill/transport switch input 618 is utilized to enable transport functions of the drill independent of the remote LOCK-OUT system. If the switch input 618 corresponds to the operator's request for drill mode, then the LOCK-OUT system is enabled. If the switch input 618 corresponds to the operator's request for transport mode, then the hydraulics are enabled, the hydraulic enable 650 is energized, the engine enable 654 is energized, and the starter relay enable 652 is energized. This will allow the machine to be moved.

Figure 26:
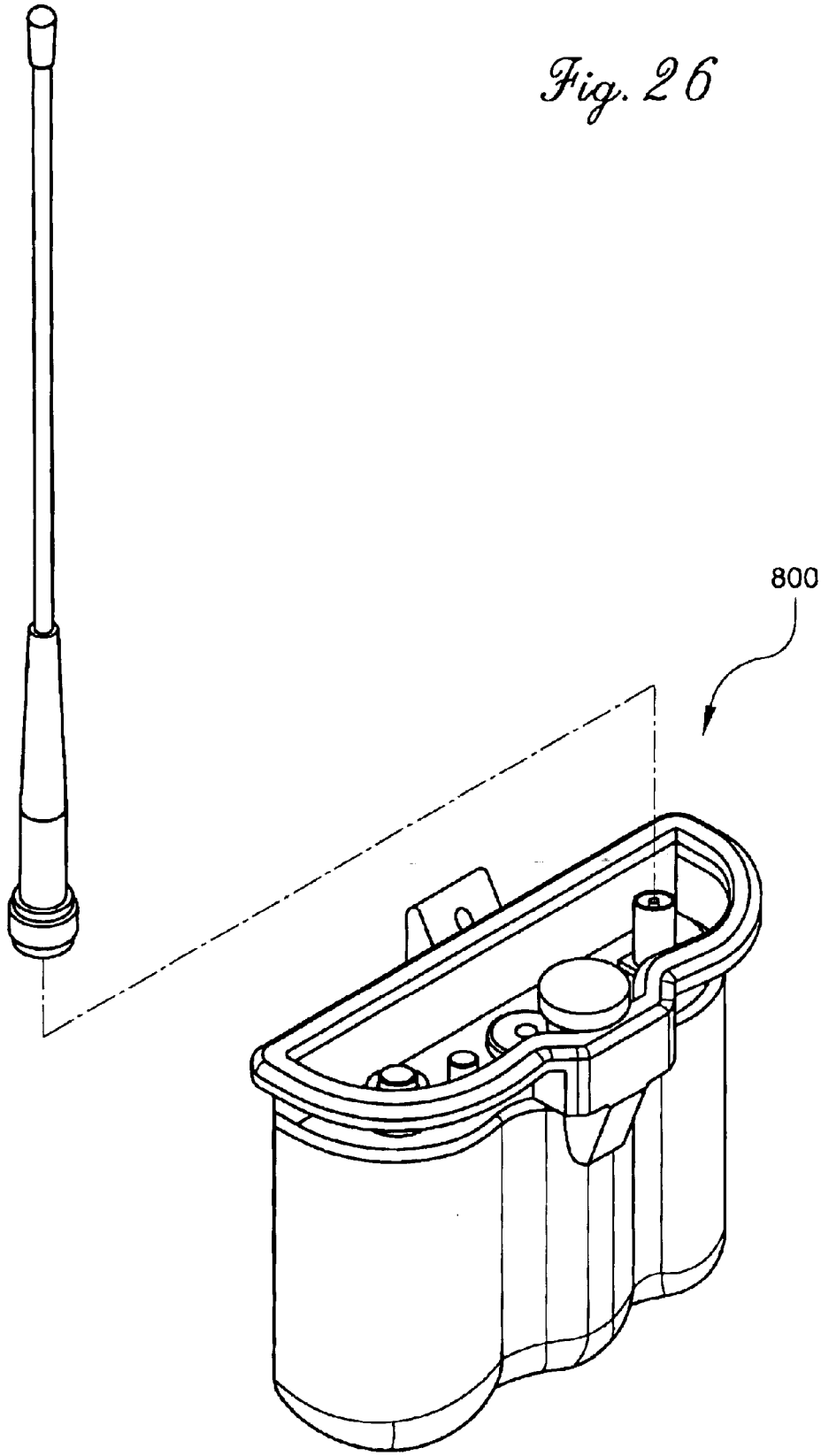
FIG. 26 is a depiction of a remote LOCK-OUT controller in accordance with an embodiment of the present invention.
Figure 27:
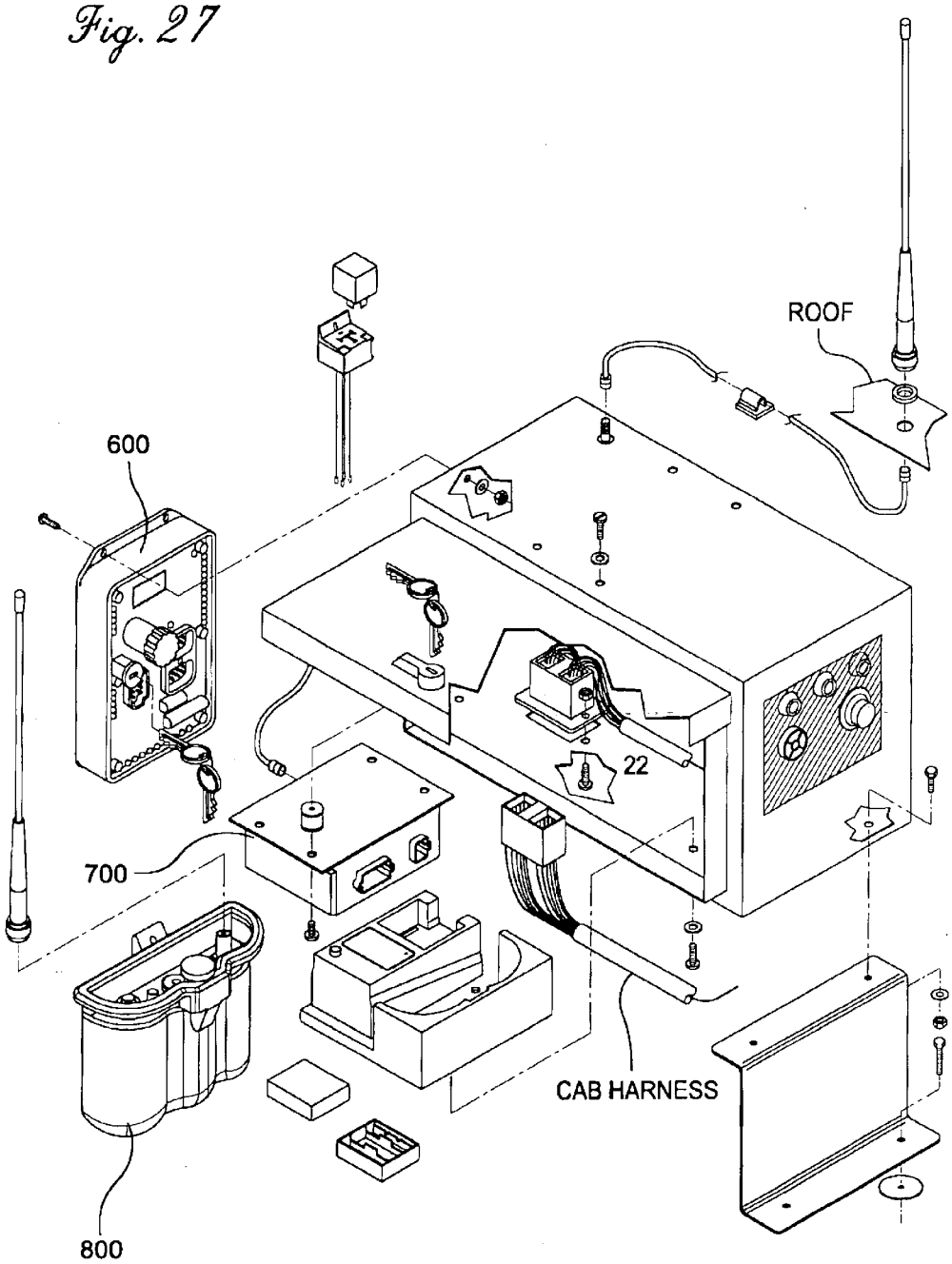
FIG. 27 is a depiction a remote LOCK-OUT override system in accordance with an embodiment of the present invention.

As illustrated in the illustrative embodiments of FIGS. 26 and 27, and as seen in the system block diagram of FIG. 18, the remote LOCK-OUT controller 800 includes a housing with a removable battery pack and several indicators. The indicators or outputs include a red LOCK-OUT light 802, a green run or not locked-out light 804, a horn 806 and a vibrator 808. The inputs include a LOCK-OUT button 810, which is a momentary switch, a green run button 812, which is also a momentary switch, and a black power button 814, which is also a momentary switch. In addition, there is a transceiver coil that is capable of transmitting (outputting) information and receiving (inputting) information, and a bidirectional communication capability provided by on-board radio 700.

Figures 1, 23:
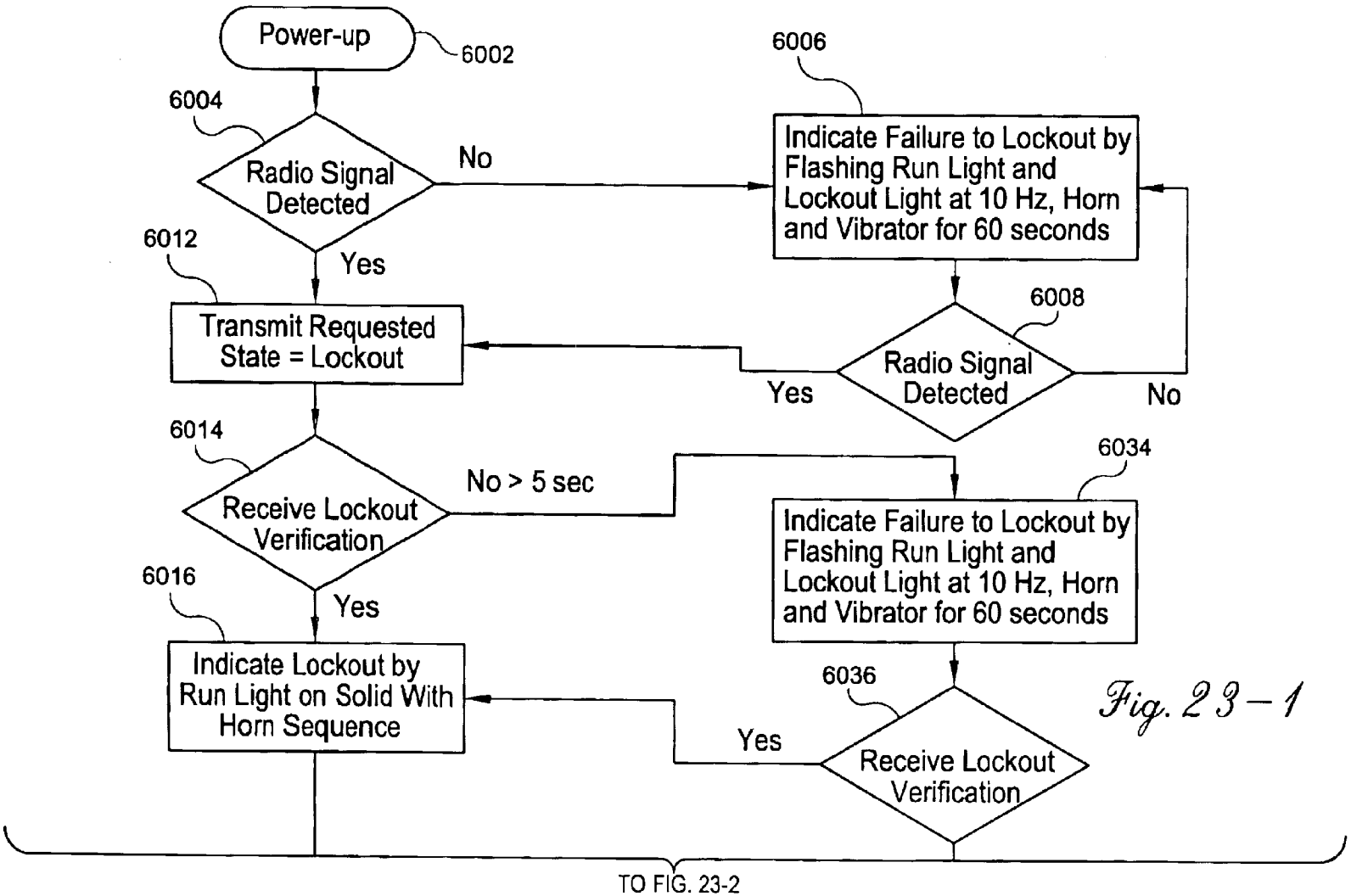
FIG. 23 is a flow chart of start-up logic implemented by a remote LOCK-OUT controller of the present invention.
Figures 2, 23:
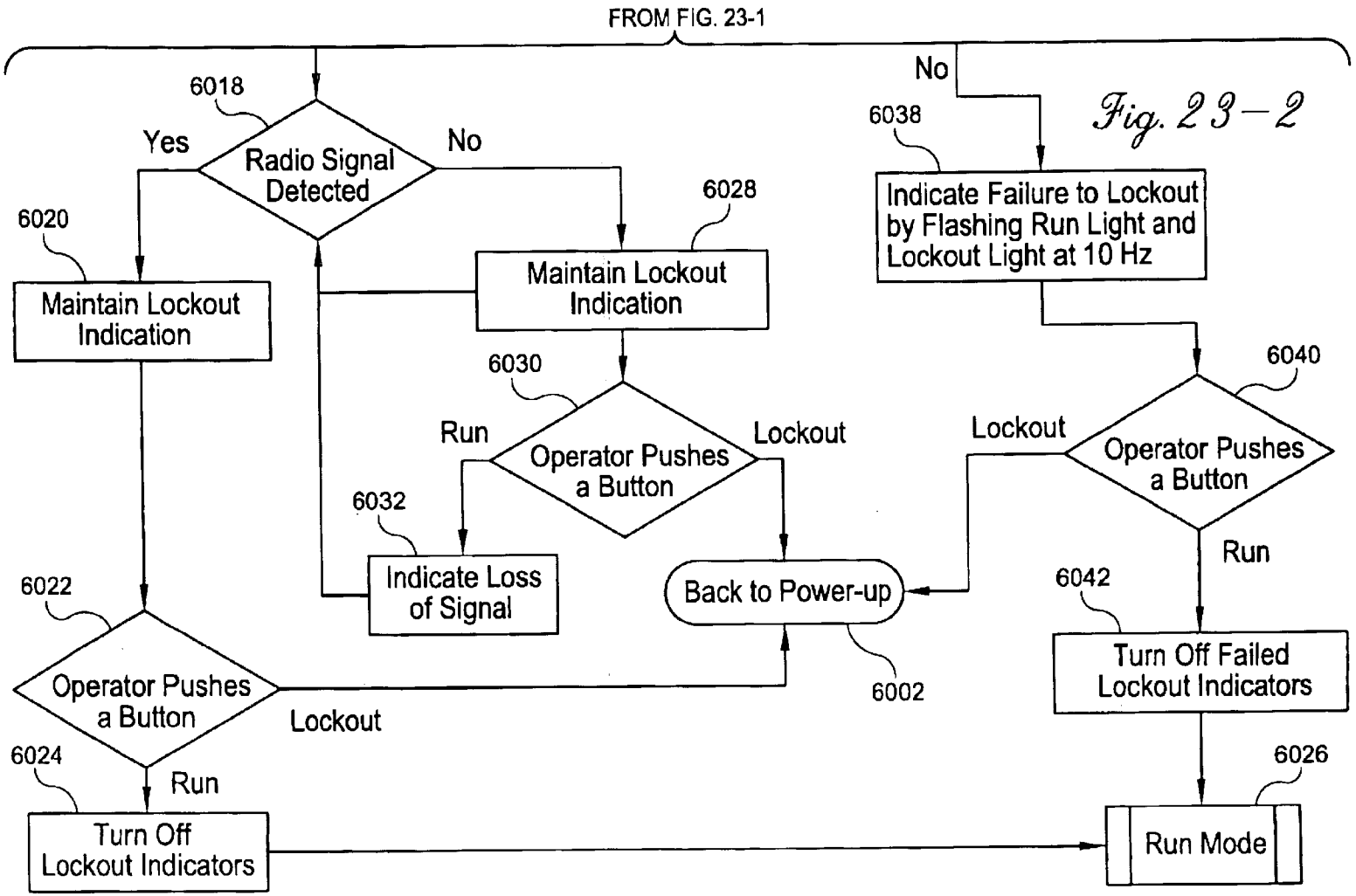

FIG. 23 Illustrates power-up logic implemented by the remote LOCK-OUT controller 800 in accordance with an embodiment of the present invention. The power-up logic is initiated immediately whenever the red LOCK-OUT button 810 is depressed at block 6002. The system then immediately checks for radio communication with the on-board radio 700 at block 6004. If there is no communication within 3 seconds, a Failure to Lockout indication is initiated at block 6006, such as by flashing the green run light 804 and red LOCK-OUT light 802 at 10 Hz continuously and energizing the horn 806 for 60 seconds.

The system continues to monitor for a radio signal at block 6008. If a radio signal is received, then the Failure to Lockout Indicator is turned off and the unit transmits a requested state of LOCK-OUT at block 6012. If no radio signal is received, the Failure to Lockout indication continues to be displayed, with both lights 802 and 804 flashing at 10 Hz.

As soon as the radio signal is received, a LOCK-OUT request is sent at block 6012 by continuously transmitting a LOCK-OUT request to the on-board radio 700. The system then starts a timer, and waits for a verification signal from the drill rig at block 6014, generated from the remote LOCK-OUT override module 600 and the on-board radio 700. If the verification signal is received within 5 seconds, then a LOCK-OUT is indicated at block 6016. The LOCK-OUT state is indicated by the red LOCK-OUT light 802 being energized continuously while the horn 806 is energized to the following sequence 3 times: 3 sequences of on for 0.5 seconds, off for 0.5 seconds for 3 cycles followed by 1 second off.

Once the LOCK-OUT signal is indicated, the system monitors for a radio signal again at block 6018. If the radio signal is still present, the LOCK-OUT Indication is maintained at block 6020 and the system waits at block 6022 for an input from the operator requesting a state. If the operator requests a run state, the LOCK-OUT indicators are turned off at block 6024 and the run mode is entered at block 6026. If the radio signal is lost at block 6018, then the LOCK-OUT indication is maintained at block 6028 until the operator requests a state at block 6030.

If the run button 812 is pushed at block 6030, then a loss of signal indication is activated at block 6032, with the same signal as at block 6006, and the system continues to monitor for radio communication at block 6018. If the LOCK-OUT button is pushed at block 6030, then the system reverts back to operation as if it were powering up at block 6002.

Returning to block 6014, if the verification signal is not received within 5 seconds, the system initiates a failed LOCK-OUT indication at block 6034. This includes flashing both the red and green lights 802 and 804 at 10 Hz continuously, energizing the horn 806 for 60 seconds, and activating the vibrator 808 for 60 seconds.

At block 6036, the system continues to monitor for the LOCK-OUT verification signal from the on-board radio 700. If detected, the failed LOCK-OUT indication is stopped and a successful LOCK-OUT is indicated at block 6016. If the LOCK-OUT verification signal is not received, then the failed LOCK-OUT indication is maintained at block 6038, the red and green lights 8002 and 8004 are left flashing at 10 Hz.

At block 6040, input from the operator is monitored. If the operator requests a new LOCK-OUT, then the system assumes a power-up and returns to block 6002. If the operator requests a run state, then the failed LOCK-OUT indicators are turned off at block 6042 and the run state is entered at step 6026.

Figure 24:
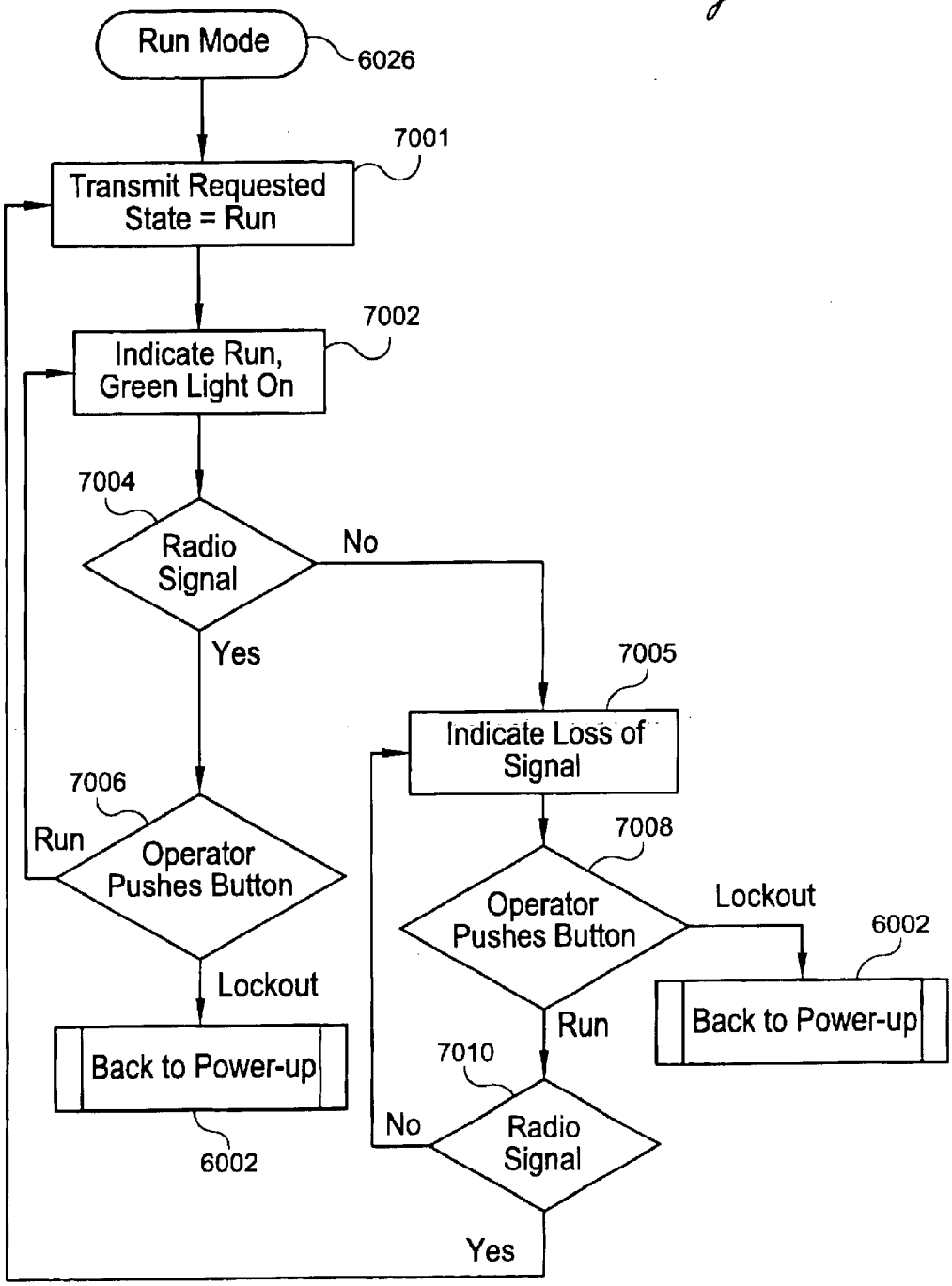
FIG. 24 is a flow chart of operating logic implemented by a remote LOCK-OUT controller of the present invention.
Figure 25:
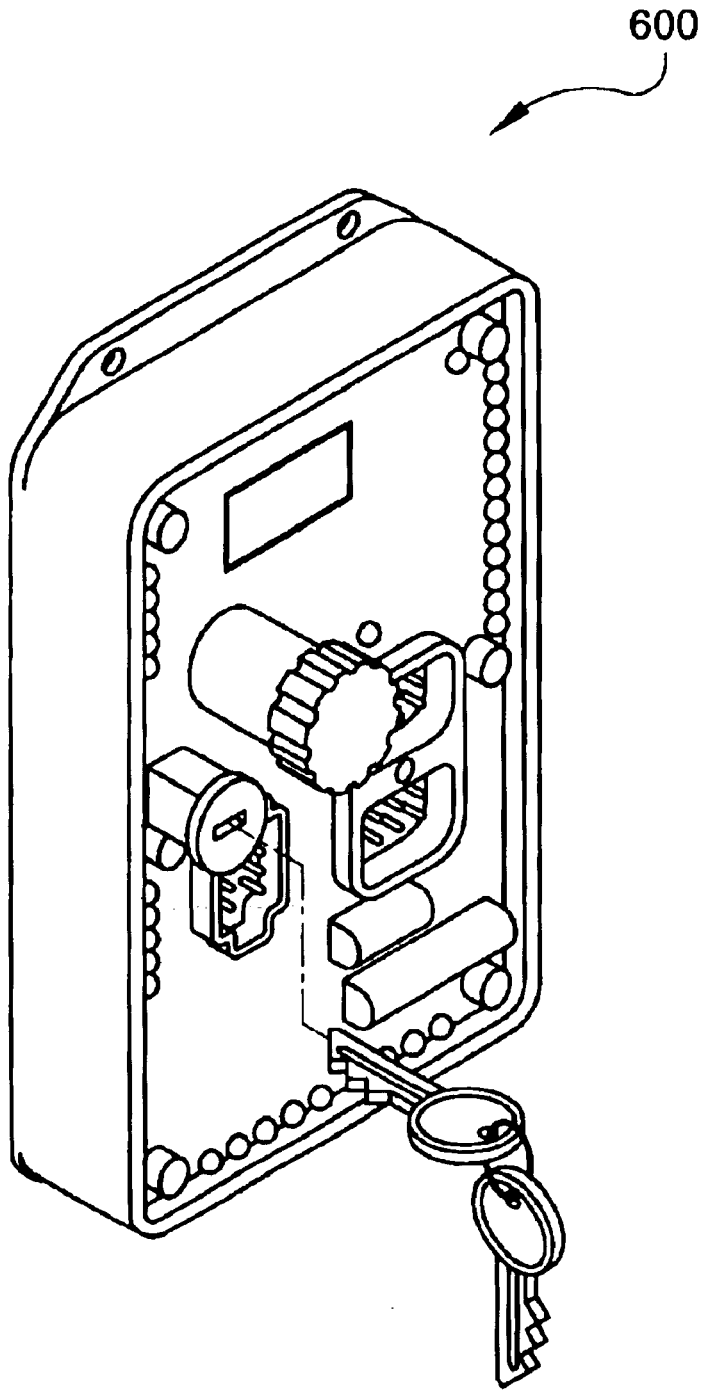
FIG. 25 is a depiction of a remote LOCK-OUT override module in accordance with an embodiment of the present invention.

FIG. 24 illustrates the run mode implemented by the remote LOCK-OUT controller 800 in accordance with an embodiment of the present invention. The run mode is entered at block 6026, as shown in FIG. 23. Once this mode is entered, a run command is continuously transmitted to the on-board radio 700 at block 7001. The run indication is activated at block 7002 by continuously energizing the green run light 804 and energizing the horn 806 for 2 seconds.

The system continuously monitors for the presence of a radio signal at block 7004. As long as a radio signal is present, the system monitors for an input from the operator at block 7006. If a LOCK-OUT is requested, the system reverts back to the power-up logic of 6002. If a run mode is again requested, the system briefly breaks transmission of the run command and then reactivates transmission of the run command, to confirm to the remote LOCK-OUT override module 600 that the remote operator has re-requested a run condition.

If the radio signal is lost at block 7004, then the system will indicate a loss of communication at block 7005, as in block 6006, and then monitor for an operator input at block 7008. If a LOCK-OUT is requested, the system reverts back to the power-up logic of block 6002. If a run state is requested, the system checks again for radio communication at block 7010. If there is no radio communication, the loss of signal indicator is maintained as at block 7005. If the radio signal is present, then the system briefly breaks transmission of the run command and then reactivates transmission of the run command, to confirm to the remote LOCK-OUT override module 600 that the remote operator has re-requested a run condition. Afterward, a requested state of run is transmitted.

A main advantage of the cooperative functions of the remote LOCK-OUT override module 600 and the remote LOCK-OUT controller 800 is the capability to avoid unintentional shutdowns due to interruption of the radio signal between these two components. This capability is facilitated by two-way communication between the units 600, 800. The embodiment described above is but one of many possible techniques to provide varying levels of functionality. Alternative examples are illustrated in FIGS. 28, 28*a*–8*d*, 29, and 29*a*.

Figure 28:
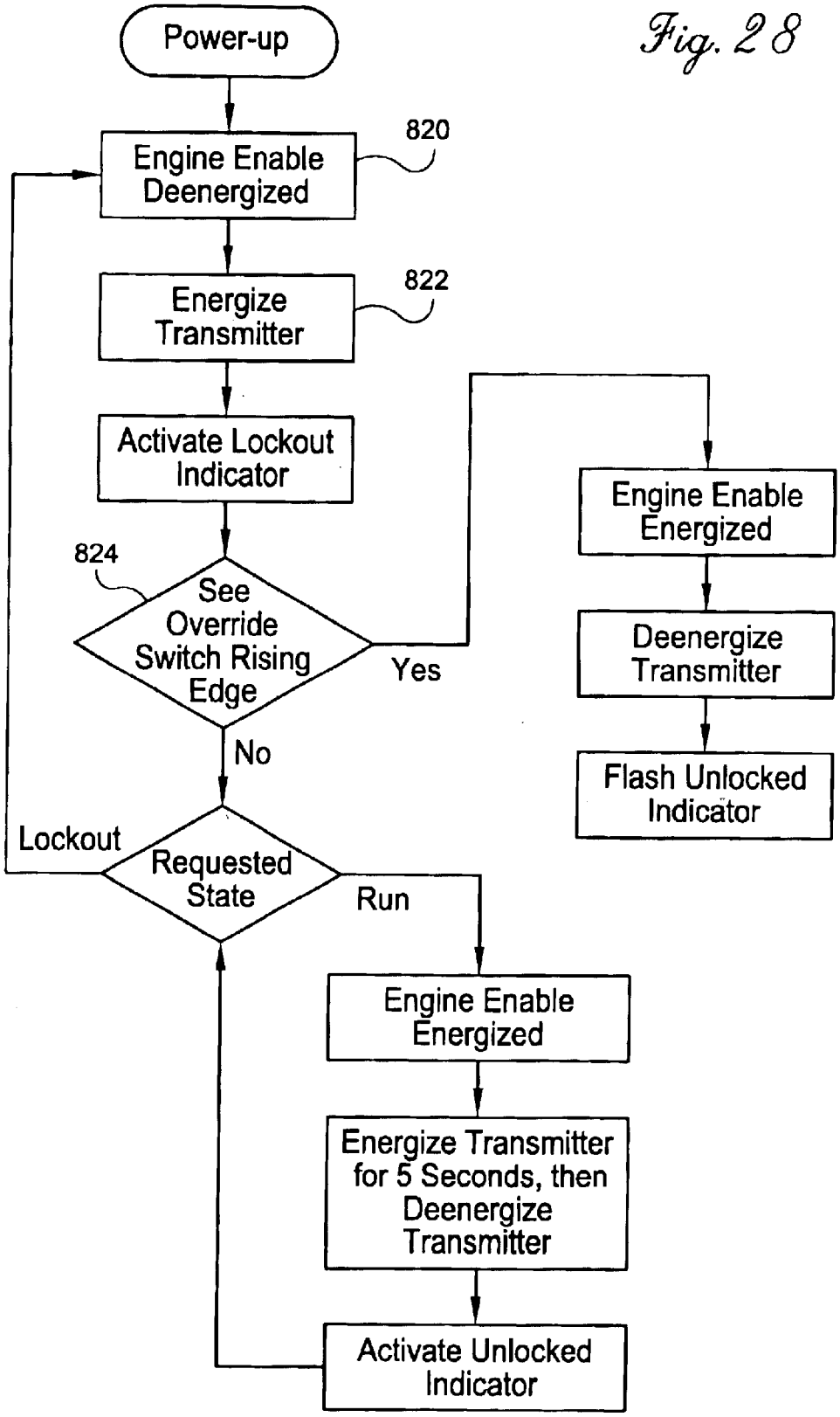
FIG. 28 is a flow chart of operating logic implemented in accordance with another embodiment of a remote LOCK-OUT override module of the present invention.
Figure 28D:
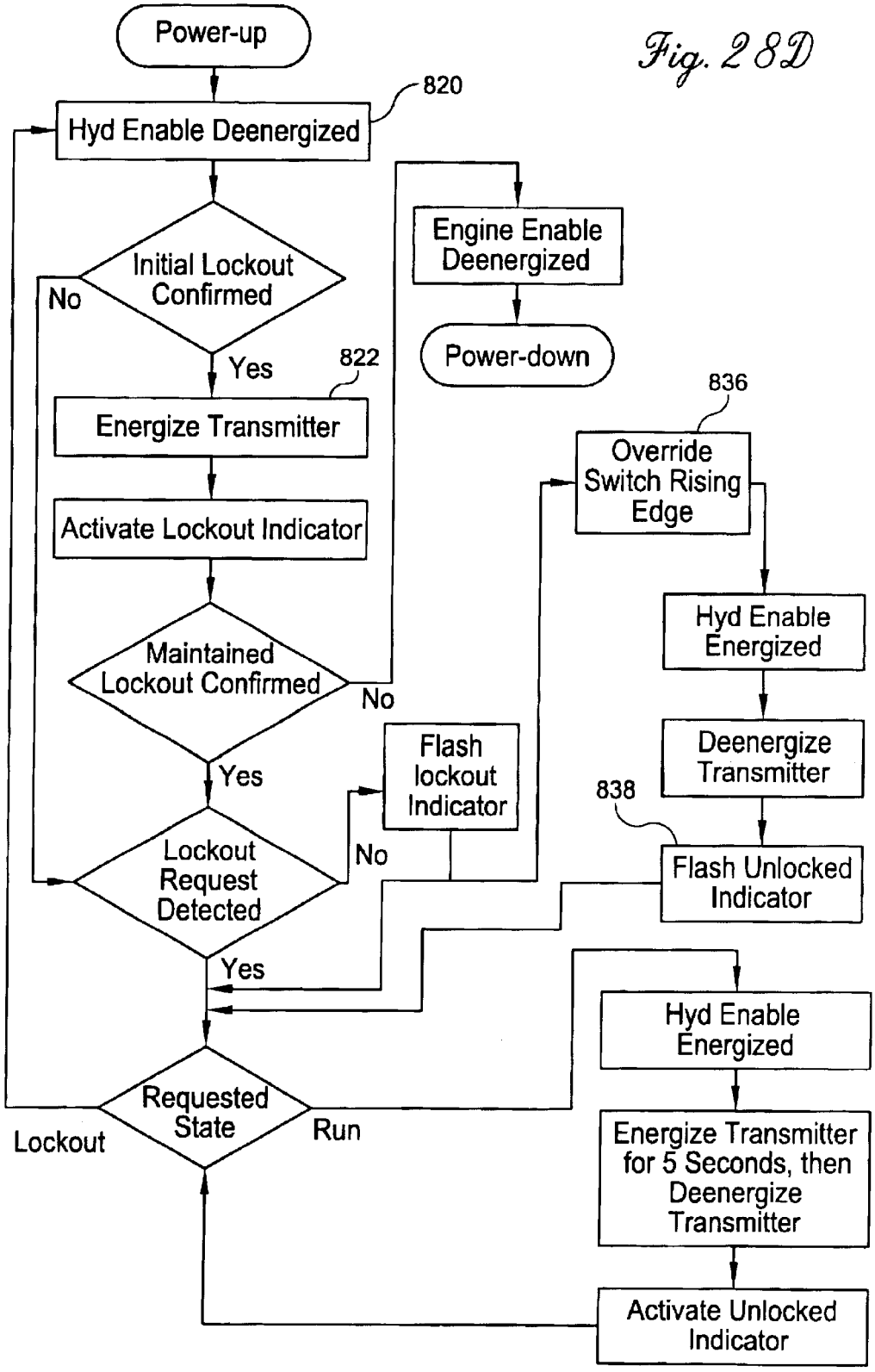
FIG. 28*d* is a flow chart of operating logic implemented in accordance with another embodiment of a remote LOCK-OUT override module of the present invention with an additional override mode function.
Figure 29:
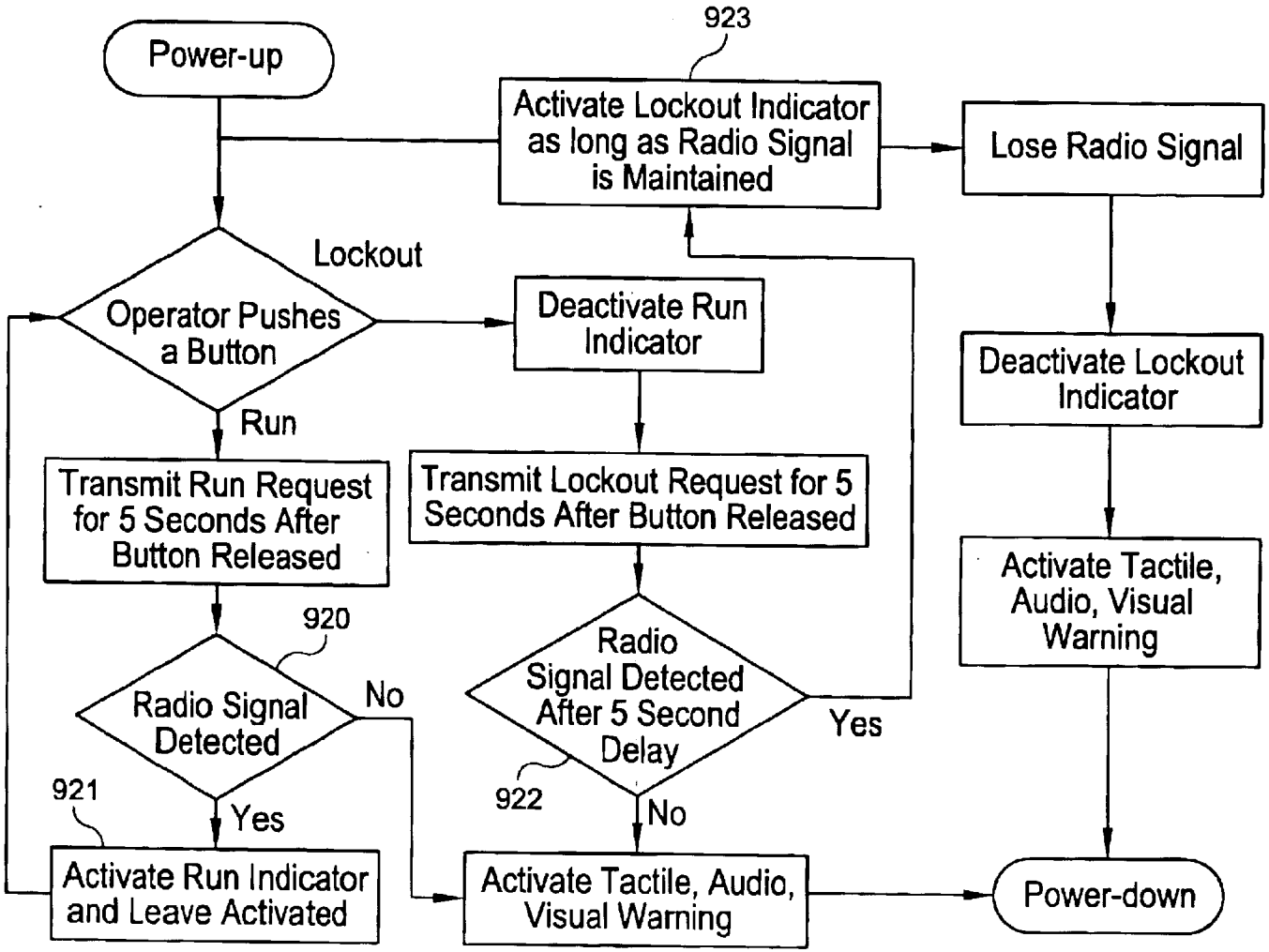
FIG. 29 is a flow chart of operating logic implemented in accordance with another embodiment of a remote LOCK-OUT controller of the present invention working in cooperation with a remote LOCK-OUT override module according to logic of FIGS. 28, 28*a*, 28*b*, or 28*c;*

An alternative embodiment is illustrated in FIGS. 28 and 29, where FIG. 28 illustrates the function of the remote LOCK-OUT override module 600, and FIG. 29 illustrates the function of the remote LOCK-OUT controller 800. The key to providing the capability of avoiding unintentional shutdown is the use of the communication link from the drill to the remote unit only as a type of handshake signal. This use of the communication link is illustrated at blocks 820 and 822 in FIGS. 28–28D, where the signal 664 to the on-board radio 700 from the remote LOCK-OUT override module 600, as illustrated in FIG. 18, controls the transmitter of the on-board radio 700 to simply power-up, energize to transmit, or power down, de-energize. This functionality combines with the logic of the remote LOCK-OUT controller 800 illustrated in FIG. 29 at blocks 920, 922, and 923. At block 920, a run indicator is only activated at block 921 if the radio signal is detected. It is assumed that if the signal from the drill rig to the remote unit is received, the signal from the remote unit to the drill rig will be successfully received, resulting in a handshake. The radios could be set-up so that the transmit portion of the on-board radio 700 is slightly lower power than the transmit portion of the remote LOCK-OUT controller 800, to improve this assumption.

The remote LOCK-OUT controller 800 will not indicate LOCK-OUT at block 923 unless it is continuously receiving a signal from the transmitter of the on-board radio 700 as at block 922, and will not indicate run unless it receives a short signal from the on-board radio 700. If the signal is not detected, the unit will activate the tactile, audio and visual warnings and then power down, indicating to the operator that the requested action was not successful.

An additional feature, to avoid unwanted machine shutdown, is an ability to allow the machine to function somewhat independently of the remote LOCK-OUT condition. FIG. 28 includes an override function at block 824, where the drilling machine can be enabled when an operator at the drilling machine presses an override switch 688. The override switch 688 would necessarily be placed in a position where the operator would need to move from the normal operating position to activate the switch 688. This would ensure that activation of the switch 688 by the operator is a deliberate action. Activating the override switch 688 results in the machine being enabled even if the remote unit may be indicating a LOCK-OUT condition, which could, under certain circumstance, result in a potential hazard.

Thus, FIG. 28*a* illustrates an alternative approach that replaces the override action with a standby action at block 826. In this embodiment, the operator would depress the same switch 688, however, the system would take an extra action in examining the previously requested state at block 828. If a LOCK-OUT had previously been requested, then the machine will not be enabled.

Figure 28B:
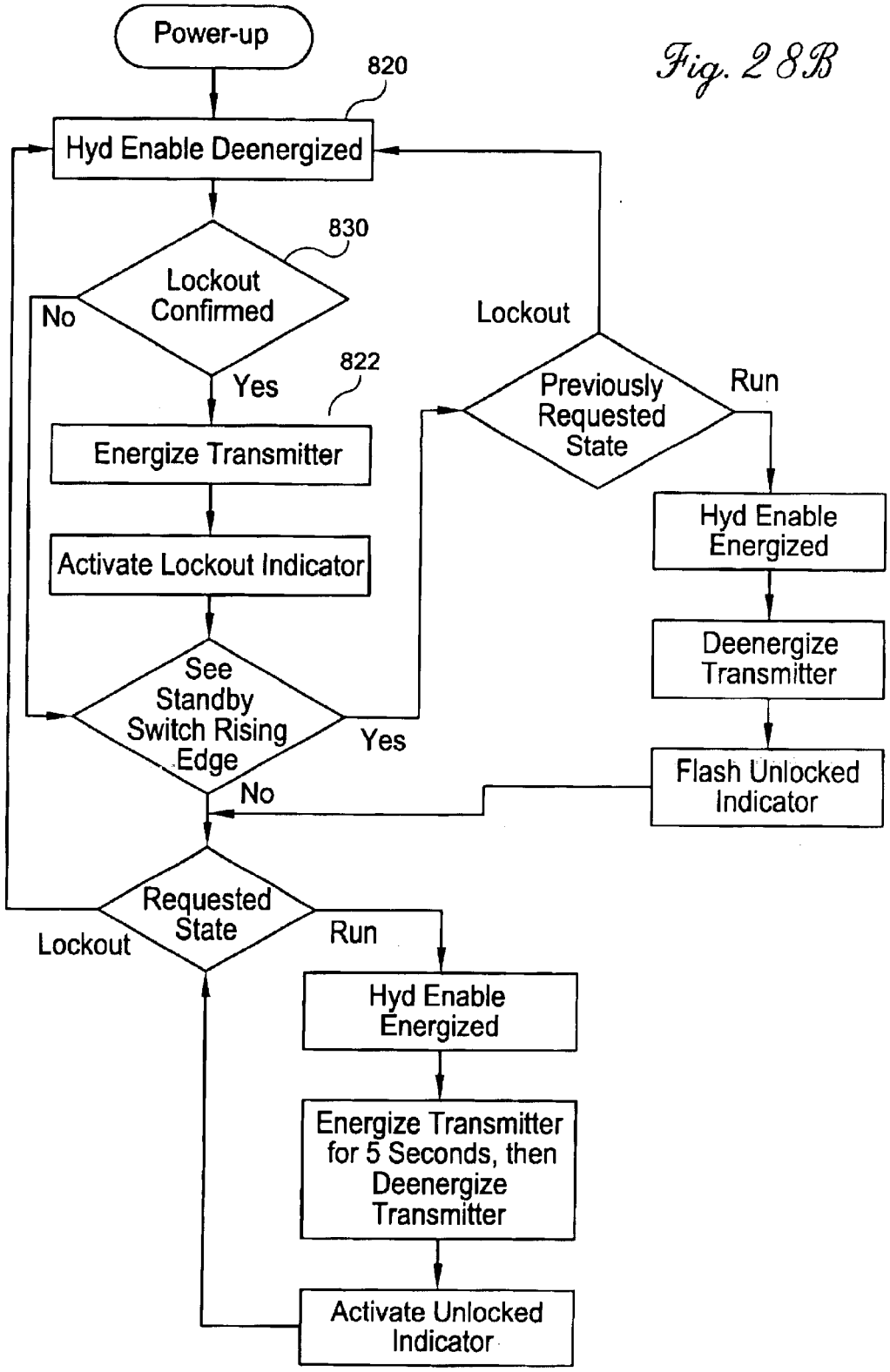
FIG. 28*b* is a flow chart of operating logic implemented in accordance with another embodiment of a remote LOCK-OUT override module of the present invention with an additional function of generating a verification signal.

FIG. 28*b* illustrates another potential embodiment, where the system utilizes a hydraulic shutdown rather than an engine shutdown utilized in FIGS. 28 and 28A. The use of a hydraulic shutdown is enabled by the incorporation of the LOCK-OUT confirmation technique previously described, and illustrated at block 830.

Figure 28C:
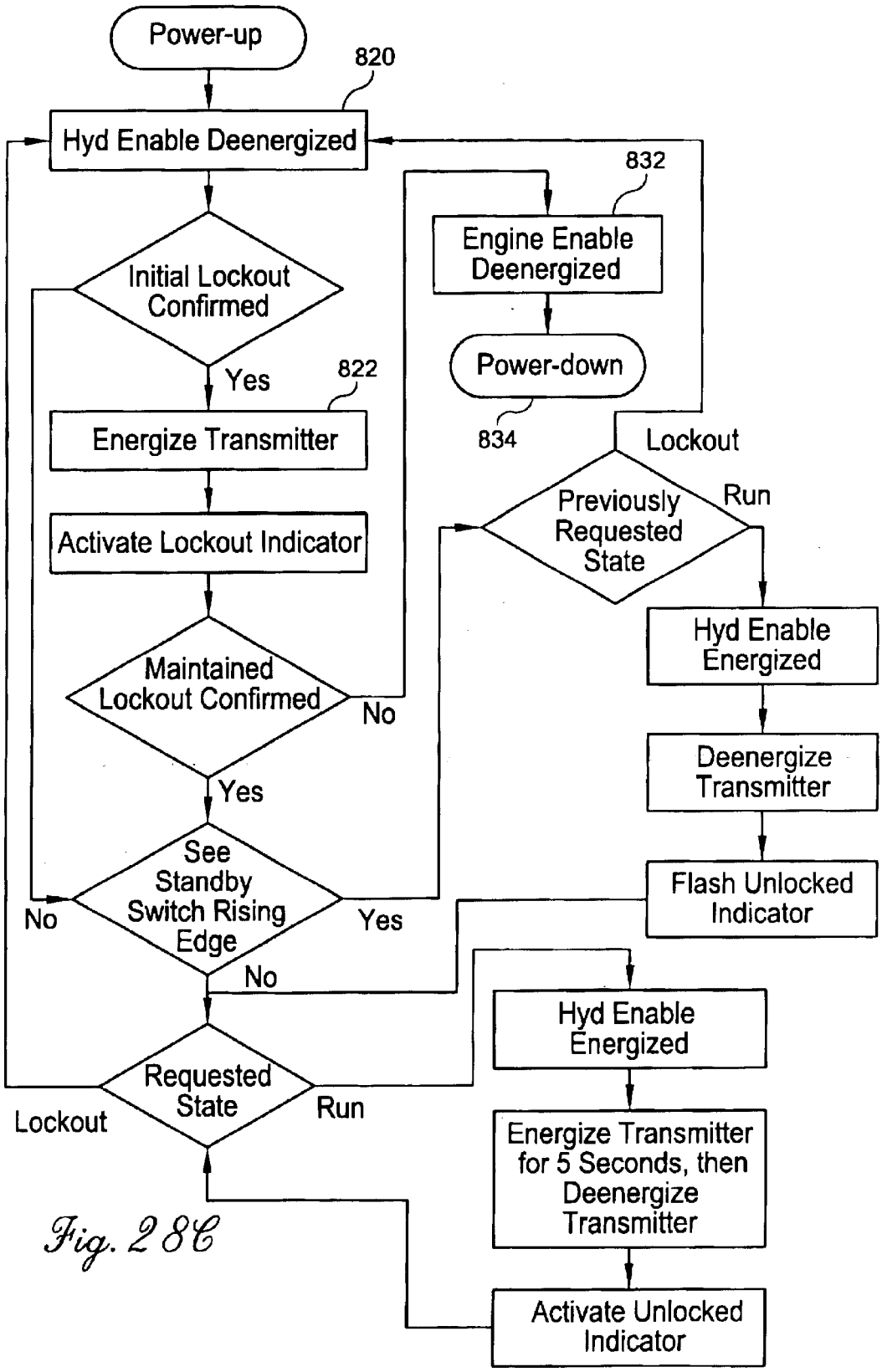
FIG. 28*c* is a flow chart of operating logic implemented in accordance with another embodiment of a remote LOCK-OUT override module of the present invention with an additional secondary shutdown function.

FIG. 28*c* illustrates a further potential embodiment, where the system incorporates the hydraulic shutdown as the primary LOCK-OUT, and also an engine shutdown as the secondary shutdown as illustrated at blocks 832 and 834.

Figure 29A:
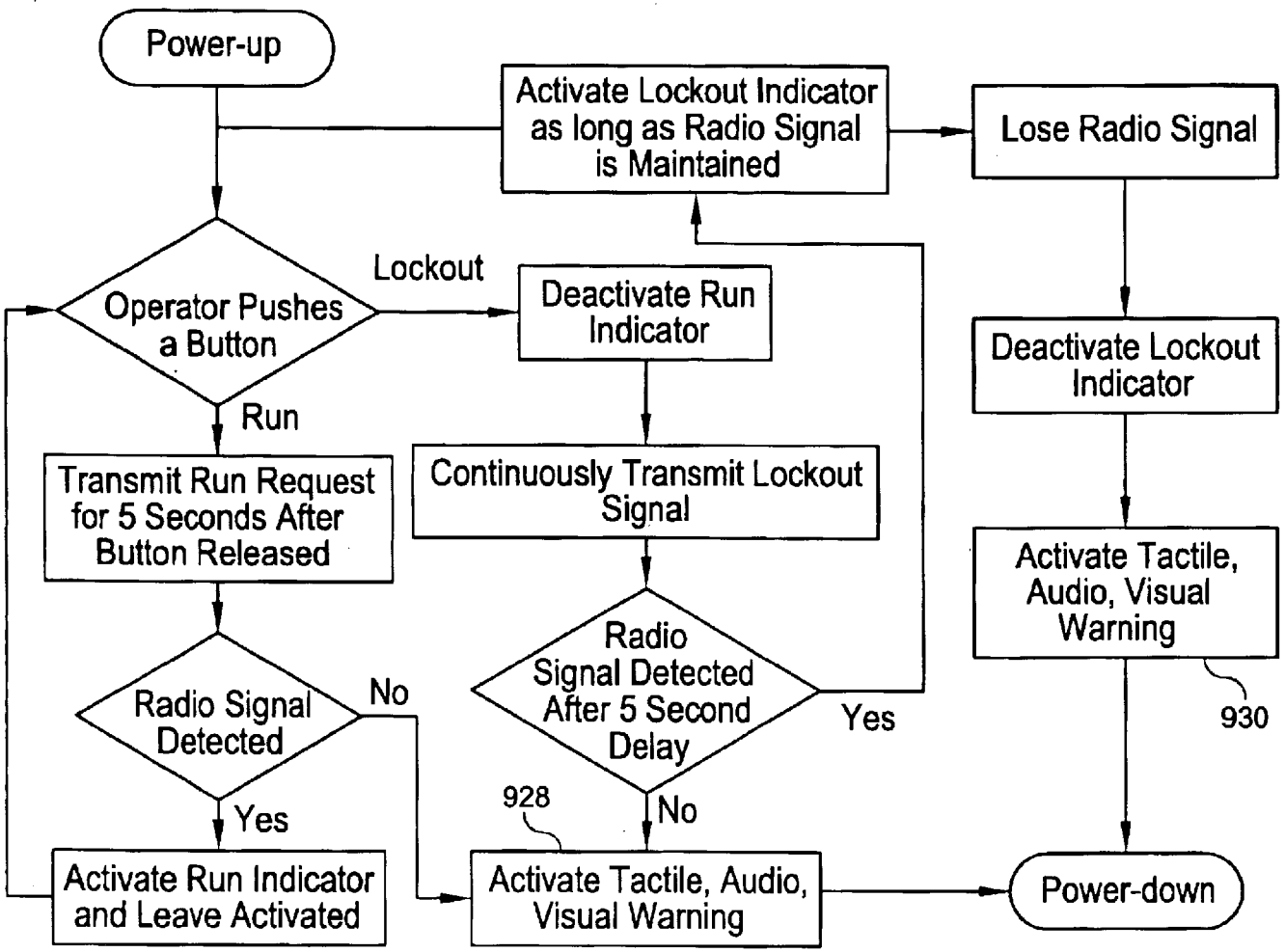
FIG. 29*a* is a flow chart of operating logic implemented in accordance with another embodiment of a remote LOCK-OUT controller of the present invention working in cooperation with a remote LOCK-OUT override module according to logic of FIG. 28*d*.

FIG. 28*d* illustrates yet another potential embodiment, similar to FIG. 28*c*, where an override function is provided. This function is provided at block 836, where the system checks for a LOCK-OUT request. This functionality is enabled by a slight modification to the functionality of the remote LOCK-OUT controller 800, as illustrated in FIG. 29*a*. When in a LOCK-OUT state, the remote LOCK-OUT controller 800 will continuously transmit the LOCK-OUT signal. As long as this signal is received at the on-board radio 700 and detected by the remote LOCK-OUT override module 600, the override switch 688 is not activated. Even if an operator were to activate the override switch 688, the system will not recognize it. If, however, the signal is no longer received, the LOCK-OUT indicator at the machine will be flashed at block 838. At this point, if the operator activates the override switch at block 840, the machine is enabled.

The remote LOCK-OUT controller 800 cooperates in accordance with this functionality as illustrated in FIG. 29*a* by providing a LOCK-OUT signal as long as the communication link is maintained. However, as soon as the communication link is lost, the remote LOCK-OUT controller 800 indicates the loss of the LOCK-OUT state as at blocks 928 and 930.

Figure 30:
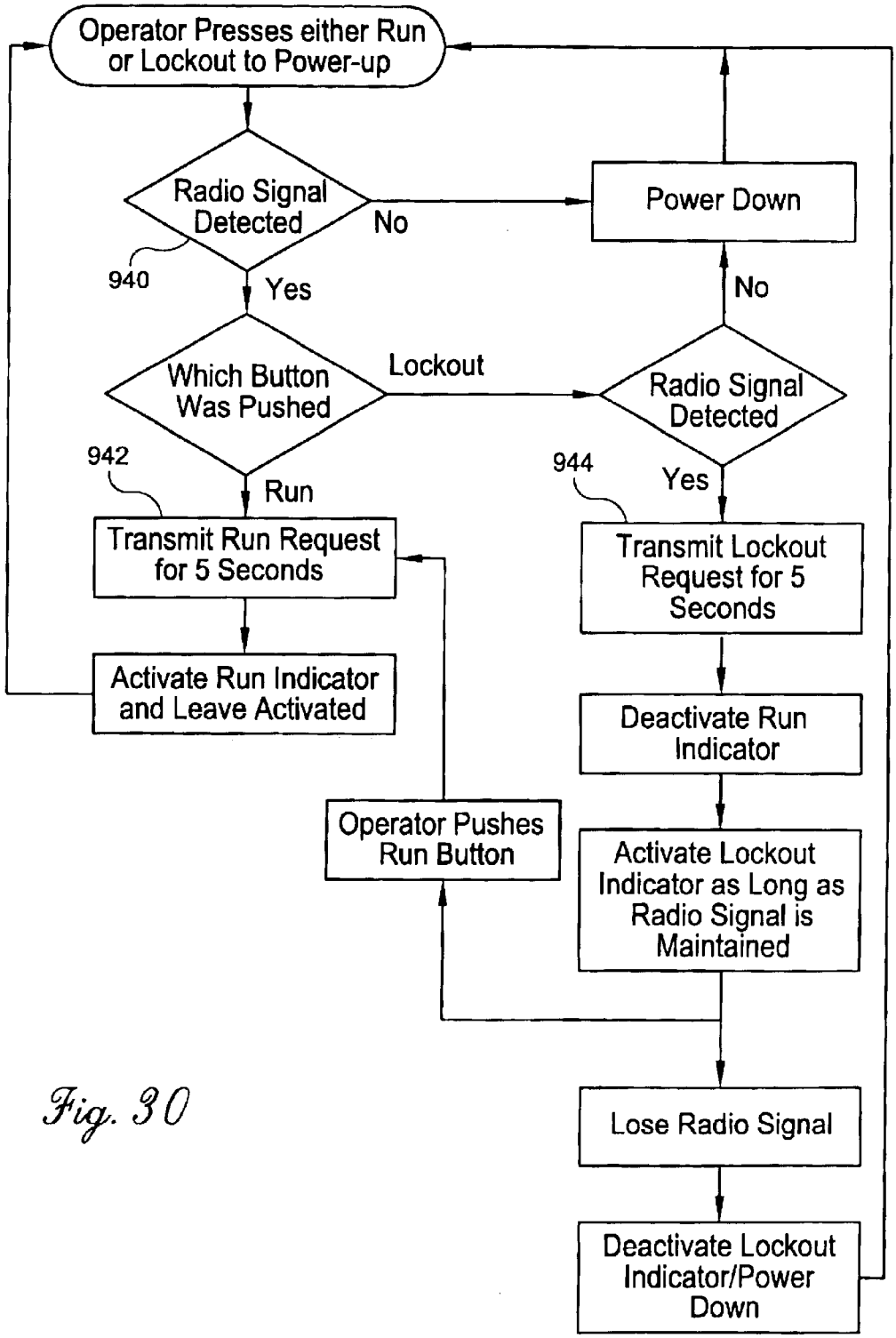
FIG. 30 is a flow chart of operating logic implemented in accordance with a further embodiment of a remote LOCK-OUT controller of the present invention.

FIG. 30 illustrates another optional embodiment. In this embodiment, the transmitter portion of on-board radio 700 is continuously energized to transmit a signal. This signal is the key, at block 940, to enabling the remote LOCK-OUT controller 800 to function. If the signal transmitted by the on-board radio 700 is not detected when the operator requests either a run state or a LOCK-OUT state, then the unit will not respond. The remote LOCK-OUT controller 800 will only respond if it is in communication with the on-board radio 700. This, combined with the fact that the run request or the LOCK-OUT request is only transmitted for a short period of time at blocks 942 and 944, enables the system to allow subsequent operation even if the communication link is lost. Several options for the functionality of the remote LOCK-OUT override module 600 are available, similar to those previously described in FIGS. 28–28*d*. In addition, block 944 could be modified to continuously transmit the LOCK-OUT request, for similar reasons described for the embodiment illustrated in FIGS. 28*d* and 29*a*.

In accordance with the above-described embodiments, the system configuration, including transceivers at both the remote LOCK-OUT controller 800 and the on-board radio 700, provides the capability to provide confirmation of communication in a manner that provides improved functionality.

As was described previously in accordance with the embodiments of a remote unit 100 of FIGS. 1–17, the remote LOCK-OUT controller 800 may be incorporated into a portable locator or tracking unit, such as a locator disclosed in the aforementioned listed U.S. patents. In addition to standard locator functionality, an integrated remote LOCK-OUT controller 800/locator provides for the various remote LOCK-OUT functions described hereinabove. Such a locator can include all or some of the various constituent elements of the remote LOCK-OUT controller 800 illustrated in FIG. 18, for example. As such, a locator implemented to include a remote LOCK-OUT capability according to the principles of the present invention can include a LOCK-OUT button 810, run button 812, off button 814, red LOCK-OUT light 802, green run or not locked out light 804, horn 806 or other audio broadcast device, and vibrator 808, for example. A common locator transceiver for both locator and LOCK-OUT communications or, alternatively, separate locator and remote LOCK-OUT transceivers, may be incorporated into the locator electronics.

A remote lockout override module 600 of the present invention can be incorporated as part of a control system of an excavator (e.g., HDD machine). Alternatively, a remote lockout override module 600 of the present invention can be packaged as a control module separate from the excavator control system circuitry. In this configuration, an illustrative example of which is shown in FIG. 27, the remote lockout override module 600 can be communicatively coupled to the excavator control system through appropriate interconnections/interfaces and cooperate with the excavator's control system programming to effect the remote LOCK-OUT functionality described herein. In this regard, the remote lockout override module 600 and remote LOCK-OUT controller 800 can define a remote LOCK-OUT subsystem that can be adapted for use with a wide variety of excavating equipment, include HDD machines, with minimal impact to excavator design/programming and cost.

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth below and equivalents thereof.

What is claimed is:

1. A system for remotely altering operation of a horizontal directional drilling machine, the drilling machine comprising a control system, a driving apparatus coupled to a drill string, a cutting head or reamer coupled to the drill string, the system comprising:

a remote lock-out override controller capable of interrupting a drilling operation of the drilling machine, the remote lock-out override controller comprising a transmitter and a receiver; and a remote lock-out controller capable of issuing a lock-out signal and a run signal, the lock-out signal, when received by the horizontal directional drilling machine, initiating suspension of the horizontal directional drilling machine drilling operation, and the run signal initiating enablement of the horizontal directional drilling machine drilling operation, the remote lock-out controller comprising a transmitter and a receiver;

wherein the signal transmitted by the remote lock-out override controller is utilized as a handshake signal by the remote lock-out controller.

2. The system of claim 1, wherein each of the remote lock-out override controller and remote lock-out controller is embodied as a module separate from the control system of the horizontal directional drilling machine, the remote lock-out override controller comprising an interface for communicatively coupling to the horizontal directional drilling machine control system.

3. The system of claim 1, wherein the remote lock-out override controller is integral to the control system of the horizontal directional drilling machine.

4. The system of claim 1, wherein drilling machine operation is enabled only if the handshake signal is detected as between the remote lock-out override controller and remote lock-out controller.

5. The system of claim 1, wherein the remote lock-out controller does not indicate a lock-out condition unless the handshake signal generated by the remote lock-out override controller is continuously received by the remote lock-out controller.

6. The system of claim 1, wherein the remote lock-out controller does not indicate a run condition unless the handshake signal is repeatedly received by the remote lock-out controller.

7. The system of claim 1, wherein the horizontal directional drilling machine drilling operation comprises displacing and rotating the drill string.

8. The system of claim 1, wherein the horizontal directional drilling machine drilling operation comprises supplying a drilling fluid through the drill string.

9. The system of claim 1, wherein the remote lock-out override controller transmits a notification signal to the remote lock-out controller and the horizontal directional drilling machine remains in a current operating state in response to loss of lock-out signal detection by the remote lock-out override controller, the current operating state being one of a lock-out state or a run state.

10. A system for remotely altering operation of a horizontal directional drilling system, the drilling system comprising a drilling machine having a control system, a drill string, and a mud system to pump drilling mud through the drill string, the system comprising:

a remote lock-out controller capable of transmitting a lock-out signal or a run signal;

a remote lock-out override module capable of controlling primary and secondary power transmission components of the horizontal drilling system; and at least one sensor on the drilling machine capable of providing input that corresponds to transmission of power to the drill string or mud system;

wherein the remote lock-out override module disrupts power transmission to the drill string by disabling the primary power transmission system upon receiving a lock-out request indicative of a lock-out state from the remote lock-out controller, and transmits a verification signal only after the sensor indicates an absence of power transfer; and wherein the remote lock-out override module continues to monitor the sensor while in the lock-out state and disrupts power transmission to the drill string by the secondary power transmission system if the sensor indicates a subsequent transfer of power while still in the lock-out state.

11. The system of claim 10, wherein the primary power transmission system comprises a hydraulic power system.

12. The system of claim 10, wherein the secondary power transmission system comprises an internal combustion engine.

13. The system of claim 10, wherein each of the remote lock-out override controller and remote lock-out controller is embodied as a module separate from the control system of the horizontal directional drilling machine, the remote lockout override controller comprising an interface for communicatively coupling to the horizontal directional drilling machine control system.

14. A remote lock-out system for a horizontal directional drilling system, the horizontal directional drilling system including a drilling machine and a control system, the remote lock-out system comprising:

a remote lock-out controller comprising a transceiver for transmitting and receiving radio communications; and a remote lock-out override module capable of controlling power transmission components of the horizontal directional drilling system, the remote lock-out override module comprising a transceiver for transmitting and receiving radio communications, and a manual override switch;

wherein the remote lock-out system continuously monitors for radio communication between the remote lock-out controller and the remote lock-out override module at start-up and prevents operation of the drilling machine until the radio communication is established or until an override state is initiated in response to actuation of the manual override switch; and wherein the remote lock-out system automatically terminates the override state when the radio communication is established, such that the remote lock-out controller initiates a drilling machine lock-out even if the drilling machine were previously set into an override state.

15. The system of claim 14, wherein each of the remote lock-out override module and remote lock-out controller is embodied as a module separate from the control system of the horizontal directional drilling machine, the remote lock-out override module comprising an interface for communicatively coupling to the horizontal directional drilling machine control system.

16. A remote lock-out system for a horizontal directional drilling system, the horizontal directional drilling system including a drilling machine, a control system, and a transceiver, the remote lock-out system comprising:

a remote lock-out controller comprising indicators capable of indicating to an operator various conditions including normal run mode, lock-out mode, loss of radio communication, and failure to respond to lock-out, the remote lock-out controller further comprising a transceiver for facilitating bi-directional communications with the control system of the horizontal directional drilling system, a run switch for initiating run logic of the control system, and a lock-out switch for initiating lock-out logic of the control system.

17. The remote lock-out system of claim 16, wherein actuation of the lock-out switch initiates lock-out logic for interrupting power transmission to the drilling machine.

18. The remote lock-out system of claim 16, wherein actuation of the lock-out switch initiates lock-out logic for interrupting power transmission to the drilling machine via a primary power transmission system in accordance with first lock-out logic and for interrupting power transmission to the drilling machine via a secondary power transmission system in accordance with second lock-out logic.

19. The remote lock-out system of claim 16, wherein drilling machine operation is enabled only if a handshake signal is detected as between the control system of the horizontal directional drilling system and remote lock-out controller.

20. The remote lock-out system of claim 16, wherein the lock-out mode indicator does not activate so as to indicate a lock-out condition unless a signal generated by the control system is continuously received by the remote lock-out controller.

21. The remote lock-out system of claim 16, wherein the normal run mode indicator will not indicate a run condition unless a signal generated by the control system is continuously received by the remote lock-out controller.

22. A method for remotely altering operation of a horizontal directional drilling machine, comprising:

continuously monitoring for radio communication between a remote lock-out controller and a remote lock-out override module at horizontal directional drilling machine start-up, the remote lock-out override module communicatively coupled to a control system of the horizontal directional drilling machine;

preventing operation of the drilling machine until the radio communication is established or until an override state is initiated in response to actuation of a manual override switch; and automatically terminating the override state when the radio communication is established, such that a drilling machine lock-out is initiated even if the drilling machine were previously set into an override state.

23. The method of claim 22, wherein a handshake signaling protocol is employed to establish the radio communication.

24. The method of claim 22, wherein preventing operation of the drilling machine comprises suspending supplying of drilling fluid.

25. The method of claim 22, further comprising transmitting a notification signal to the remote lock-out controller and remaining in a current horizontal directional drilling machine operating state in response to loss of the radio communication, the current operating state being one of a lock-out state or a run state.

* * * * *